US005298383A

United States Patent [19]

Mihayashi et al.

[11] Patent Number: 5,298,383

[45] Date of Patent: * Mar. 29, 1994

[54] SILVER HALIDE COLOR PHOTOGRAPHIC MATERIAL

[75] Inventors: Keiji Mihayashi; Naoki Saito; Shunichi Aida, all of Kanagawa, Japan

[73] Assignee: Fuji Photo Film Co., Ltd., Kanagawa, Japan

[ * ] Notice: The portion of the term of this patent subsequent to Mar. 16, 2010 has been disclaimed.

[21] Appl. No.: 840,949

[22] Filed: Feb. 25, 1992

[30] Foreign Application Priority Data

Feb. 26, 1991 [JP] Japan ..... 3-53263

[51] Int. Cl.[5] ..... G03C 1/08; G03C 7/26; G03C 7/32

[52] U.S. Cl. ..... 430/557; 430/567; 430/611; 430/600; 430/603

[58] Field of Search ..... 430/557, 957, 567, 600, 430/603, 607, 611

[56] References Cited

U.S. PATENT DOCUMENTS

| | | | |
|---|---|---|---|
| 4,149,886 | 3/1979 | Tanaka et al. | 430/382 |
| 4,579,816 | 4/1986 | Ohlschlager et al. | 430/544 |
| 4,923,793 | 5/1990 | Shibara | 430/567 |
| 5,068,173 | 11/1991 | Takehara et al. | 430/567 |

FOREIGN PATENT DOCUMENTS

| | | |
|---|---|---|
| 169458 | 1/1986 | European Pat. Off. . |
| 282896 | 9/1988 | European Pat. Off. . |
| 337370 | 10/1989 | European Pat. Off. . |
| 0447920 | 9/1991 | European Pat. Off. . |
| 1558452 | 2/1969 | France . |
| 1204680 | 9/1970 | United Kingdom . |
| 1477410 | 6/1977 | United Kingdom . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

Disclosed is a silver halide color photographic material having at least one light-sensitive emulsion layer on a support, in which at least 50%, as the total projected area, of all the silver halide grains in at least one light-sensitive emulsion layer are tabular grains having a mean aspect ratio of 2 or more and at least one layer constituting the material contains a coupler of the following formula (I) and/or a coupler of the following formula (II):

(I)

(II)

where $X^1$ and $X^2$ each represents an alkyl group, an aryl group, or a heterocyclic group; $X^3$ represents an organic residue forming a nitrogen-containing heterocyclic group along with >N— in the formula; Y represents an aryl group or a heterocyclic group; and Z represents a group capable of being released from the formula when the coupler of the formula reacts with an oxidation product of a developing agent. The material preferably contains a compound of formula (A):

$$Q—SM^1 \quad (A)$$

where Q represents a heterocyclic residue having at least one substituent selected from the group consisting of $—SO_3M^2$, $—COOM^2$, —OH and $—NR^1R^2$ bonded thereto directly or indirectly; $M^1$ and $M^2$ independently represent a hydrogen atom, an alkali metal, a quaternary ammonium group, or a quaternary phosphonium group; and $R^1$ and $R^2$ independently represent a hydrogen atom, or a substituted or unsubstituted alkyl group. The material has a high sensitivity and has excellent graininess, pressure resistance, color reproducibility and sharpness.

22 Claims, No Drawings

SILVER HALIDE COLOR PHOTOGRAPHIC MATERIAL

FIELD OF THE INVENTION

The present invention relates to a silver halide color photographic material, in particular, to a silver halide color photographic material containing tabular silver halide emulsion(s) and new yellow coupler(s). The silver halide color photographic material has a high sensitivity and has excellent graininess, sharpness and pressure resistance. It is free from fluctuation of photographic properties during storage between exposure and color development, and it has an excellent color reproducibility in processing and an excellent color image storability after processing.

BACKGROUND OF THE INVENTION

Silver halide color photographic materials, especially those for taking pictures, are required to have a high sensitivity and excellent graininess, color reproducibility and sharpness. They are further required to be free from fluctuation of the photographic properties during storage and have an excellent color image storability after processing.

Yellow couplers for forming color photographic images include the generally known acylacetanilide couplers having active methylene (methine) group(s) (T. H. James, *The Theory of the Photographic Process*, 4th Ed., pages 354 to 356). However, these couplers have some drawbacks because the dyes to be formed from them have a low color density and because the couplers themselves have a low dye forming speed. In particular, when the couplers are used as so-called DIR couplers, a large amount of these couplers must be used since they have a low activity. Incorporation of such a large amount of such couplers into photographic materials causes some problems because the color image fastness is lowered, the color hue becomes worse and the cost is elevated.

Malondianilide couplers which are known yellow couplers are described in, for example, U.S. Pat. Nos. 4,149,886, 4,095,984 and 4,477,563 and British Patent 1,204,680. However, the known couplers have a drawback in that the images to be formed from them have a poor image storability. In particular, the images are hardly fast to moisture and heat. In addition, with respect to spectral absorption of the azomethine dyes to be obtained from the couplers, the foot of the absorption spectrum is prolonged in the long wavelength side of yellow. Therefore, improved color reproducibility of these couplers is desired.

As a technique of providing a photographic material having a high sensitivity and excellent graininess and sharpness, incorporation of tabular silver halide grains having an aspect ratio (diameter/thickness) of 8/1 or more into a photographic material has been proposed, for example, in JP-A-58-113934. However, the proposed photographic material does not still have satisfactory color reproducibility, graininess, pressure resistance and storability. Additionally, the image storability of the processed material was still poor.

SUMMARY OF THE INVENTION

The first object of the present invention is to provide a photographic material having a high sensitivity and excellent graininess, color reproducibility, sharpness and pressure resistance.

The second object of the present invention is to provide a photographic material having an excellent yellow image storability.

The third object of the present invention is to provide a photographic material which is free from fluctuation of photographic properties during storage.

The fourth object of the present invention is to provide a photographic material which contains a small amount of emulsion(s) each having a good graininess and a small amount of high-activity yellow coupler(s). The cost of the material is therefore low and the material may give color images of excellent quality.

These objects have been attained by a silver halide color photographic material having at least one light-sensitive emulsion layer on a support, in which at least 50%, as the total projected area, of all the silver halide grains in at least one light-sensitive emulsion layer are tabular grains having a mean aspect ratio of 2 or more and at least one layer constituting the material contains a coupler selected from the group consisting of a coupler of the following formula (I), a coupler of the following formula (II) and combinations thereof:

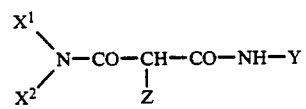

(I)

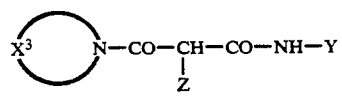

(II)

wherein $X^1$ and $X^2$ each represents an alkyl group, an aryl group, or a heterocyclic group;

$X^3$ represents an organic residue capable of forming a nitrogen-containing heterocyclic group along with >N— in the formula;

Y represents an aryl group or a heterocyclic group; and

Z represents a group capable of being released from the formula when the coupler of the formula reacts with an oxidation product of a developing agent.

DETAILED DESCRIPTION OF THE INVENTION

Couplers of formula (I) and couplers of formula (II) for use in the present invention is described hereinafter in detail.

When $X^1$ and $X^2$ each represents an alkyl group, the group is a straight, branched or cyclic, saturated or unsaturated, substituted or unsubstituted alkyl group having from 1 to 30 carbon atoms, preferably from 1 to 20 carbon atoms. Examples of such an alkyl group include methyl, ethyl, propyl, butyl, cyclopropyl, allyl, t-octyl, i-butyl, dodecyl and 2-hexyldecyl groups.

When $X^1$ and $X^2$ each represents a heterocyclic group, the group is a 3-membered to 12-membered, preferably 5-membered or 6 membered, saturated or unsaturated, substituted or unsubstituted, mono-cyclic or condensed ring heterocyclic group having at least one hetero atom selected from, for example, a nitrogen atom, an oxygen atom and a sulfur atom and having from 1 to 20, preferably from 1 to 10, carbon atoms. Examples of such a heterocyclic group include 3-pyrrolidinyl, 1,2,4-triazol-3-yl, 2-pyridyl, 4-pyrimidinyl, 3-pyrazolyl, 2-pyrrolyl, 2,4-di-oxo-1,3-imidazolidin-5-yl and pyranyl groups.

When $X^1$ and $X^2$ each represents an aryl group, the group is a substituted or unsubstituted aryl group having from 6 to 20, preferably from 6 to 10, carbon atoms. Typical examples of such an aryl group include phenyl and naphthyl groups.

When $X^3$ forms a nitrogen-containing heterocyclic group along with >N— in the formula, the group is a 3-membered to 12-membered, preferably 5-membered or 6-membered, substituted or unsubstituted, saturated or unsaturated, monocyclic or condensed ring heterocyclic group having from 1 to 20, preferably from 1 to 15, carbon atoms and optionally containing, in addition to nitrogen atom(s), one or more hetero atoms selected from, for example, an oxygen atom and a sulfur atom. Examples of such a heterocyclic group include pyrrolidino, piperidino, morpholino, 1-piperazinyl, 1-indolinyl, 1,2,3,4-tetrahydroquinolin-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thiazine-S,S-dioxo-4-yl and benzoxazin-4-yl groups.

When $X^1$ and $X^2$ each represents a substituted alkyl, aryl or heterocyclic group, and when $X^3$ forms a substituted nitrogen-containing heterocyclic group along with >N— in the formula, the group may be substituted by various substituents. For instance, the substituents are a halogen atom (e.g., fluorine, chlorine), an alkoxycarbonyl group (having from 2 to 30, preferably from 2 to 20, carbon atoms, such as methoxycarbonyl, dodecyloxycarbonyl, hexadecyloxycarbonyl), an acylamino group (having from 2 to 30, preferably from 2 to 20, carbon atoms, such as acetamido, tetradecanamido, 2-(2,4-di-t-amylphenoxy)butanamido, benzamido), a sulfonamido group (having from 1 to 30, preferably from 1 to 20, carbon atoms, such as methanesulfonamido, dodecanesulfonamido, hexadecylsulfonamido, benzenesulfonamido), a carbamoyl group (having from 1 to 30, preferably from 1 to 20, carbon atoms, such as N-butylcarbamoyl, N,N-diethylcarbamoyl), an N-sulfonylcarbamoyl group (having from 1 to 30, preferably from 1 to 20, carbon atoms, such as N-mesylcarbamoyl, N-dodecylsulfonylcarbamoyl), a sulfamoyl group (having from 1 to 30, preferably from 1 to 20, carbon atoms, such as N-butylsulfamoyl, N-dodecylsulfamoyl, N-hexadecylsulfamoyl, N-3-(2,4-di-t-amylphenoxy)butylsulfamoyl, N,N-diethylsulfamoyl), an alkoxy group (having from 1 to 30, preferably from 1 to 20, carbon atoms, such as methoxy, hexadecyloxy, isopropoxy), an aryloxy group (having from 6 to 20, preferably from 6 to 10, carbon atoms, such as phenoxy, 4-methoxyphenoxy, 3-t-butyl-4-hydroxyphenoxy, naphthoxy), an aryloxycarbonyl group (having from 7 to 21, preferably from 7 to 11, carbon atoms, such as phenoxycarbonyl), an N-acylsulfamoyl group (having from 2 to 30, preferably from 2 to 20, carbon atoms, such as N-propanoylsulfamoyl, N-tetradecanoylsulfamoyl), a sulfonyl group (having from 1 to 30, preferably from 1 to 20, carbon atoms, such as methanesulfonyl, octanesulfonyl, 4-hydroxyphenylsulfonyl, dodecanesulfonyl), an alkoxycarbonylamino group (having from 1 to 30, preferably from 1 to 20, carbon atoms, such as ethoxycarbonylamino), a cyano group, a nitro group, a carboxyl group, a hydroxyl group, a sulfo group, an alkylthio group (having from 1 to 30, preferably from 1 to 20, carbon atoms, such as methylthio, dodecylthio, dodecylcarbamoylmethylthio), an ureido group (having from 1 to 30, preferably from 1 to 20, carbon atoms, such as N-phenylureido, N-hexadecylureido), an aryl group (having from 6 to 20, preferably from 6 to 10, carbon atoms, such as phenyl, naphthyl, 4-methoxyphenyl), a heterocyclic group (e.g., 3-membered to 12-membered, preferably 5-membered or 6-membered, monocyclic or condensed ring heterocyclic group having from 1 to 20, preferably from 1 to 10, carbon atoms and having at least one hetero atom selected from, for example, a nitrogen atom, an oxygen atom and a sulfur atom; such as 2-pyridyl, 3-pyrazolyl, 1-pyrrolyl, 2,4-dioxo-1,3-imidazolidin-1-yl, 2-benzoxazolyl, morpholino, indolyl), an alkyl group (e.g., straight, branched or cyclic, saturated or unsaturated group having from 1 to 30, preferably from 1 to 20, carbon atoms; such as methyl, ethyl, isopropyl, cyclopropyl, t-pentyl, t-octyl, cyclopentyl, t-butyl, s-butyl, dodecyl, 2-hexyldecyl), an acyl group (having from 1 to 30, preferably from 2 to 20, carbon atoms, such as acetyl, benzoyl), an acyloxy group (having from 2 to 30, preferably from 2 to 20, carbon atoms, such as propanoyloxy, tetradecanoyloxy), an arylthio group (having from 6 to 20, preferably from 6 to 10, carbon atoms, such as phenylthio, naphthylthio), a sulfamoylamino group (having from 0 to 30, preferably from 0 to 20, carbon atoms, such as N-butylsulfamoylamino, N-dodecylsulfamoylamino, N-phenylsulfamoylamino), and an N-sulfonylsulfamoyl group (having from 1 to 30, preferably from 1 to 20, carbon atoms, such as N-mesylsulfamoyl, N-ethanesulfonylsulfamoyl, N-dodecanesulfonylsulfamoyl, N-hexadecanesulfonylsulfamoyl). These substituents may each be further substituted by one or more other substituents. Examples of the other substituents include those as described above.

Of the above-described substituents, preferred are an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group and an aryl group.

In formulae (I) and (II), when Y represents an aryl group, the aryl group may be a substituted or unsubstituted aryl group having from 6 to 20, preferably from 6 to 10, carbon atoms. Typical examples of the aryl group include phenyl and naphthyl groups.

In formulae (I) and (II), when Y represents a heterocyclic group, the same as those mentioned for the heterocyclic group of $X^1$ or $X^2$ may apply thereto.

When Y represents a substituted aryl or heterocyclic group, examples of the substituents of the above-described group $X^1$ may apply to the group of Y. Preferred examples of substituents of Y include those wherein one hydrogen atom of the group of Y is substituted by a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group or an alkyl group.

In formulae (I) and (II), Z may be any known coupling releasing group. Preferred examples of the group Z include a nitrogen-containing heterocyclic group capable of bonding to the coupling position of the formula via the nitrogen atom of the group, and an aromatic oxy group, an aromatic thio group, a heterocyclic oxy group, a heterocyclic thio group, an acyloxy group, a carbamoyloxy group, an alkylthio group and a halogen atom.

The releasing group may be anyone of the nonphotographically useful groups and the photographically useful groups or their precursors (e.g., development inhibitor, development accelerator, desilvering accelerator, foggant, dye, hardening agent, coupler, scavenger for oxidation product of developing agent, fluorescent dye, developing agent, electron transferring agent).

When Z is a photographically useful group, it may be any known one. For instance, Z may be photographically useful groups or split off groups capable of releasing such photographically useful groups (e.g., timing group) as described in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, 4,741,994, and European Patent Publication Nos. 193389A, 348139A and 272573A.

When Z represents a nitrogen-containing heterocyclic group capable of bonding to the coupling position of the formula via the nitrogen atom of the group, the group is preferably a 5-membered or 6-membered, substituted or unsubstituted, saturated or unsaturated, monocyclic or condensed ring heterocyclic group having from 1 to 15, preferably from 1 to 10, carbon atoms. It may contain, in addition to nitrogen atom(s), one or more hetero atoms selected from, for example, an oxygen atom and a sulfur atom. Preferred examples of such a heterocyclic group include 1-pyrazolyl, 1-imidazolyl, pyrrolino, 1,2,4-triazol-2-yl, 1,2,3-triazol-3-yl, benzotriazolyl, benzimidazolyl, imidazolidine-2,4-dione-3-yl, oxazolidine-2,4-dione-3-yl, 1,2,4-triazolidine-3,5-dione-4-yl, 2-imidazolinon-1-yl, 3,5-dioxomorpholino and 1-indazolyl groups. When the heterocyclic group has substituent(s), examples of the substituents of the above-described group $X^1$ may apply to them. As preferred examples of substituents of the heterocyclic group, one of the substituents is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group or a sulfonyl group.

When Z represents an aromatic oxy group, it is preferably a substituted or unsubstituted aromatic oxy group having from 6 to 10 carbon atoms. It is especially preferably a substituted or unsubstituted phenoxy group. When the group has substituent(s), examples of the substituents of the above described group $X^1$ may apply to them. As preferred examples of substituents of the aromatic oxy group, at least one of the substituents is an electron attracting substituent. Examples of the substituent include a sulfonyl group, an alkoxycarbonyl group, a sulfamoyl group, a halogen atom, a carboxyl group, a carbamoyl group, a nitro group, a cyano group and an acyl group.

When Z represents an aromatic thio group, it is preferably a substituted or unsubstituted aromatic thio group having from 6 to 10 carbon atoms. It is especially preferably a substituted or unsubstituted phenylthio group. When the group has substituent(s), examples of the substituents of the above-mentioned group $X^1$ may apply to them. As preferred examples of substituents of the aromatic thio group, at least one of the substituents is an alkyl group, an alkoxy group, a sulfonyl group, an alkoxycarbonyl group, a sulfamoyl group, a halogen atom, a carbamoyl group or a nitro group.

When Z represents a heterocyclic oxy group, the hetero ring moiety in the group may be 3-membered to 12-membered, preferably 5-membered or 6-membered, substituted or unsubstituted, saturated or unsaturated, monocyclic or condensed ring heterocyclic group having from 1 to 20, preferably from 1 to 10, carbon atoms and containing at least one hetero atom selected from, for example, a nitrogen atom, an oxygen atom and a sulfur atom. Examples of such a heterocyclic oxy group for Z include a pyridyloxy group, a pyrazolyloxy group and a furyloxy group. When the group has substituent(s), examples of the substituents of the above-described group $X^1$ may apply to them. As preferred examples of substituents of the group, one of the substituents is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group or a sulfonyl group.

When Z represents a heterocyclic thio group, the hetero ring moiety in the group may be 3-membered to 12-membered, preferably 5-membered or 6-membered, substituted or unsubstituted, saturated or unsaturated, monocyclic or condensed ring heterocyclic group having from 1 to 20, preferably from 1 to 10, carbon atoms and containing at least one hetero atom selected from, for example, a nitrogen atom, an oxygen atom and a sulfur atom. Examples of such a heterocyclic thio group for Z include a tetrazolylthio group, a 1,3,4-thiadiazolylthio group, a 1,3,4-oxadiazolylthio group, a 1,3,4-triazolylthio group, a benzimidazolylthio group, a benzothiazolylthio group and a 2-pyridylthio group. When the group has substituent(s), examples of the substituents of the above-described group $X^1$ may apply to them. As preferred examples of substituents of the group, at least one of the substituents is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group or a sulfonyl group.

When Z represents an acyloxy group, it is preferably a monocyclic or condensed ring, substituted or unsubstituted aromatic acyloxy group having from 6 to 10 carbon atoms, or a substituted or unsubstituted aliphatic acyloxy group having from 2 to 30, preferably from 2 to 20, carbon atoms. When the group has substituent(s), examples of the substituents of the above-described group $X^1$ may apply to them.

When Z represents a carbamoyloxy group, it may be an aliphatic, aromatic or heterocyclic, substituted or unsubstituted carbamoyloxy group having from 1 to 30, preferably from 1 to 20, carbon atoms. For instance, examples of the group include N,N-diethylcarbamoyloxy, N-phenylcarbamoyloxy, 1-imidazolylcarbonyloxy and 1-pyrrolocarbonyloxy groups. When the group has substituent(s), examples of the substituents of the above-described group $X^1$ may apply to them.

When Z represents an alkylthio group, it may be a straight, branched or cyclic, saturated or unsaturated, substituted or unsubstituted alkylthio group having from 1 to 30, preferably from 1 to 20, carbon atoms. When the group has substituent(s), examples of the substituents of the above-described group $X^1$ may apply to them.

Next, especially preferred ranges of the couplers of formulae (I) and (II) for use in the present invention are described below.

In formula (I), the $X^1$ group is preferably an alkyl group, especially preferably an alkyl group having from 1 to 10 carbon atoms.

In formulae (I) and (II), the Y group is preferably an aromatic group, especially preferably a phenyl group having at least one substituent at the ortho-position. As substituents of the phenyl group of Y, those of the substituted aromatic group Y described above may apply thereto. Regarding the preferred examples of the substituents of the phenyl group of Y, the same as those described above may also apply thereto.

The group Z in formulae (I) and (II) is preferably a 5-membered or 6-membered nitrogen-containing heterocyclic group as bonded to the coupling position of the formula via the nitrogen atom of the group, an aromatic oxy group, a 5-membered or 6-membered heterocyclic oxy group, or a 5-membered or 6-membered heterocyclic thio group.

Of couplers of formulae (I) and (II), preferred are those of the following formulae (III), (IV) and (V):

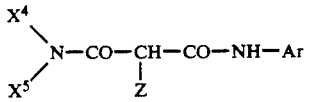
(III)

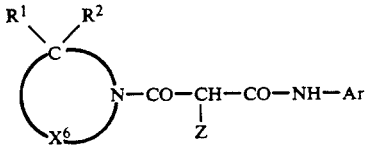
(IV)

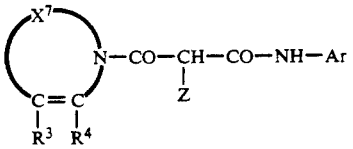
(V)

wherein Z has the same meaning as that defined in formula (I);

$X^4$ represents an alkyl group;

$X^5$ represents an alkyl group or an aromatic group;

Ar represents a phenyl group having at least one substituent at the ortho-position;

$X^6$ represents an organic residue capable of forming a nitrogen-containing monocyclic or condensed ring heterocyclic group along with $-C(R^1R^2)-N<$ in the formula;

$X^7$ represents an organic residue capable of forming a nitrogen-containing monocyclic or condensed ring heterocyclic group along with $-C(R^3)=C(R^4)-N<$ in the formula; and $R^1$, $R^2$, $R^3$ and $R^4$ each represents a hydrogen atom or a substituent.

In formulae (III) to (V), the details and the preferred ranges of $X^4$ to $X^7$, Ar and Z are the same as those of the corresponding groups in the aforesaid formulae (I) and (II). When $R^1$ to $R^4$ each represents a substituent, examples of the substituents of the above-described group $X^1$ may apply to them.

Of the above-described couplers, especially preferred are those of formulae (IV) and (V).

Couplers of formulae (I) to (V) may be in the form of dimers or higher telomers or polymers, in which two or more molecules are bonded to each other at the group of $X^1$ to $X^7$, Y, Ar, $R^1$ to $R^4$ and Z via a divalent or polyvalent group therebetween. In this case, the previously defined range for the number of the carbon atoms of constituting the respective substituents does not apply to the dimers or higher telomers or polymers.

Couplers of formulae (I) to (V) for use in the present invention are preferably non-diffusible couplers. Non-diffusible couplers are those having group(s) therein capable of sufficiently increasing the molecular weight of the molecule for making the coupler immobile in the layer to which they have been added. In general, couplers having, as non-diffusible group(s), alkyl group(s) with a total carbon number of from 8 to 30, preferably from 10 to 20, and/or substituted aryl group(s) with a total carbon number of from 4 to 20 are used. Such a non-diffusible group may be at any position of the coupler molecule, and the coupler may have two or more such non-diffusible groups.

Specific examples of yellow couplers of formulae (I) to (V) for use in the present invention are illustrated below, but the invention is not limited thereto.

(1)

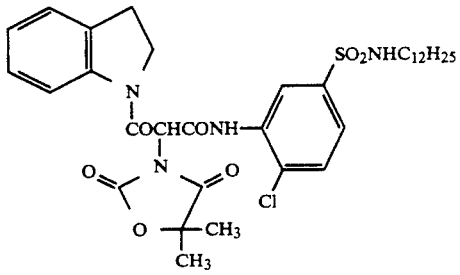

(2)

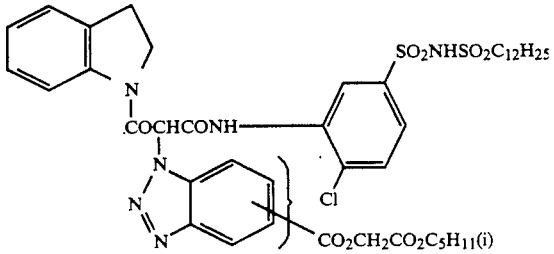

-continued
(3)
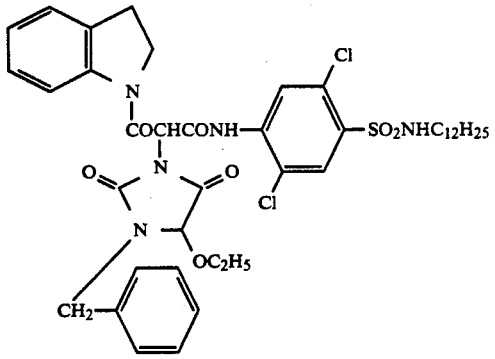
(4)
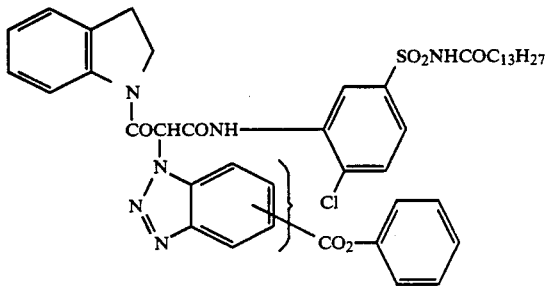
(5)
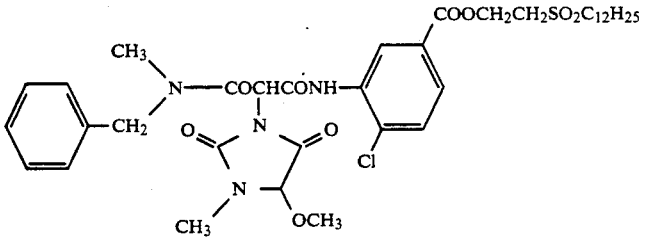
(6)
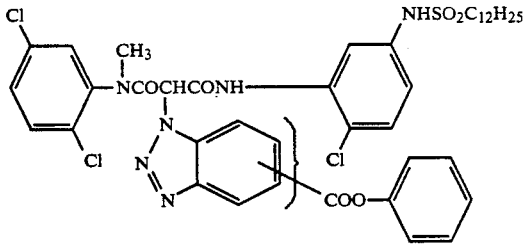
(7)
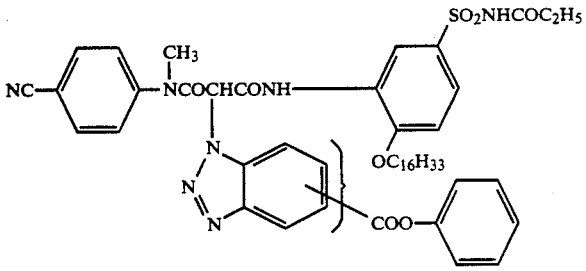

-continued
(8)
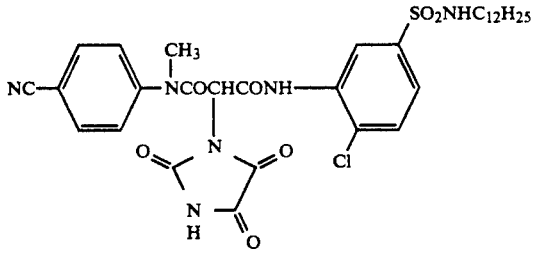
(9)
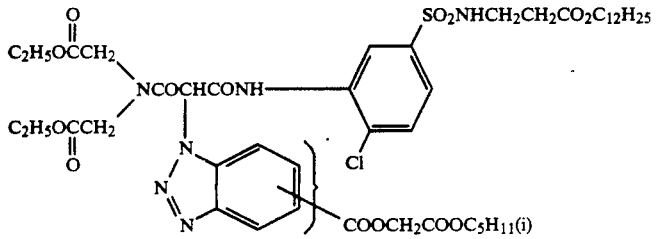
(10)
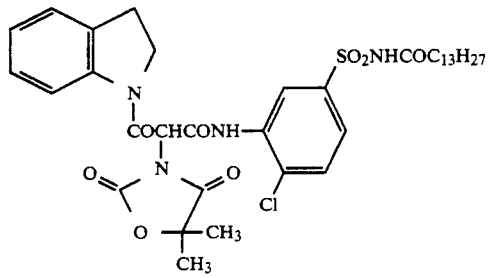
(11)
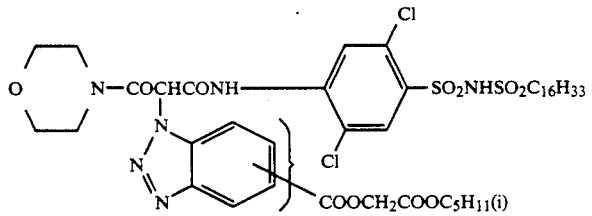
(12)
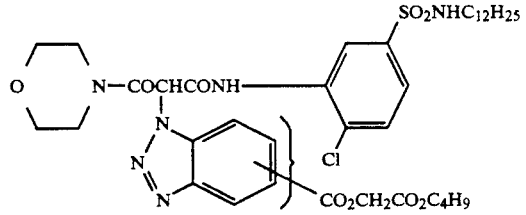
(13)
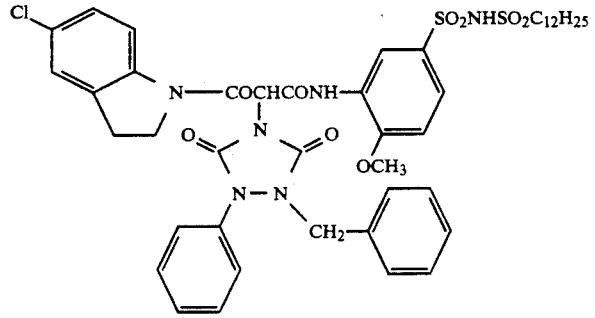

-continued
(14)
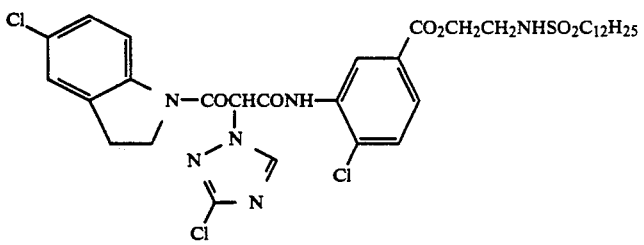
(15)
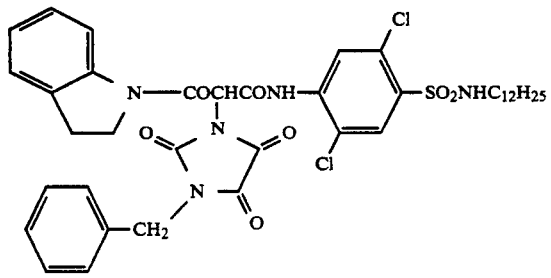
(16)
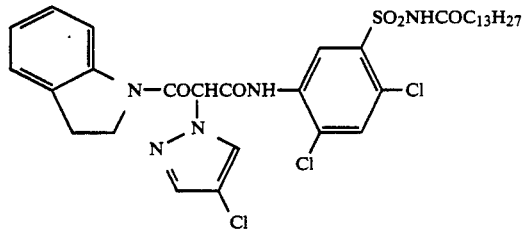
(17)
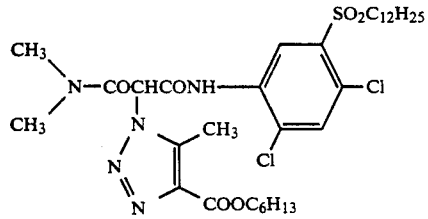
(18)
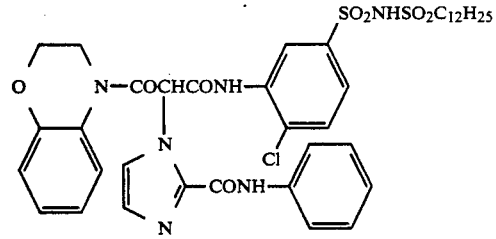
(19)
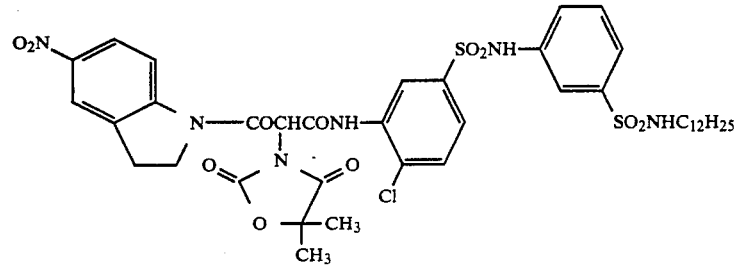

-continued
(20)
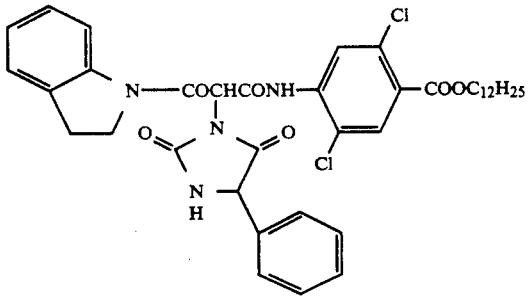
(21)
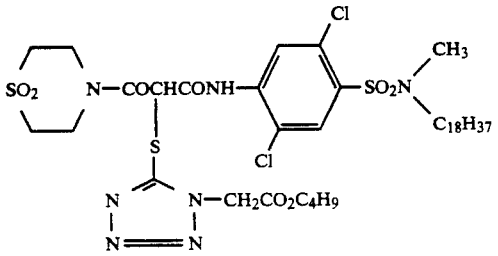
(22)
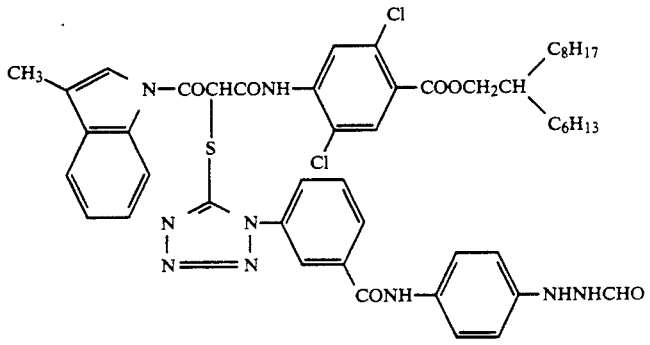
(23)
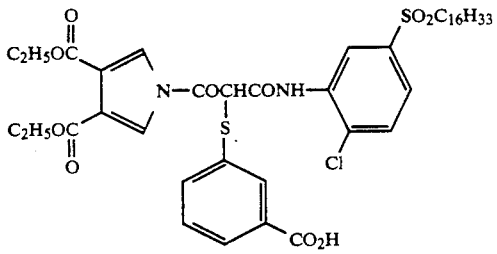
(24)
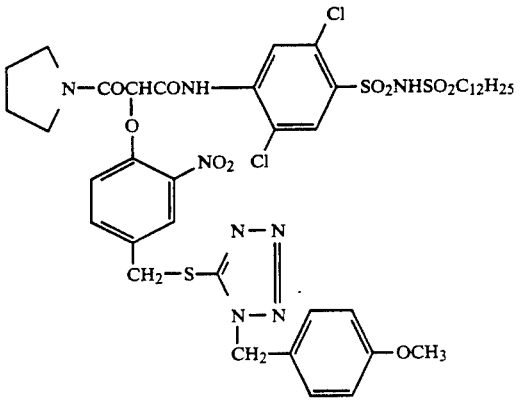

-continued
(25)
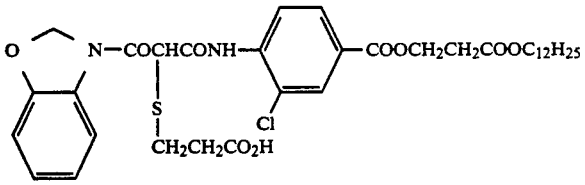
(26)
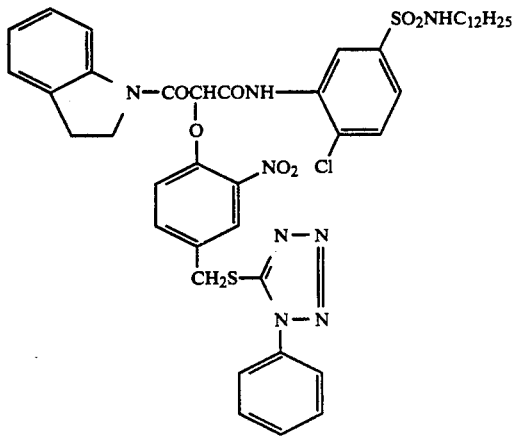
(27)
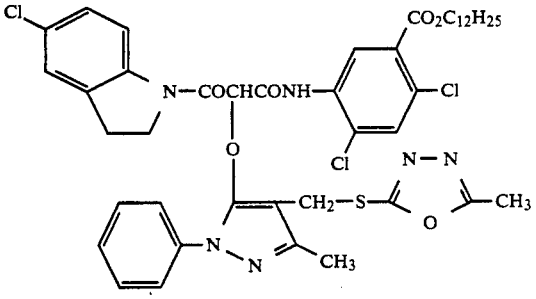
(28)
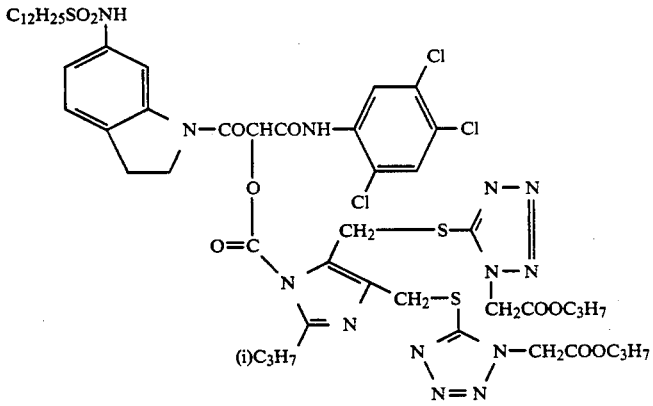
(29)
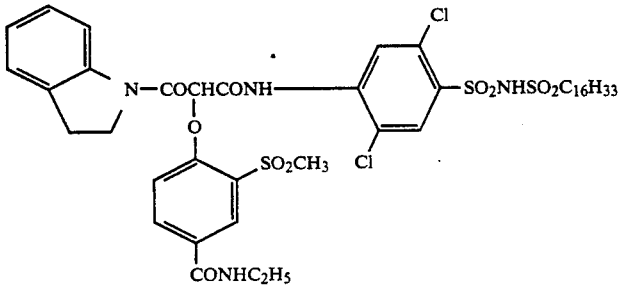

-continued
(30)
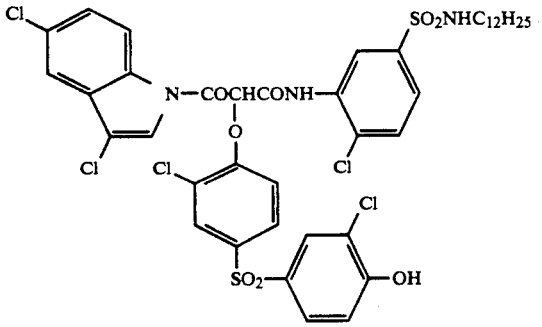
(31)
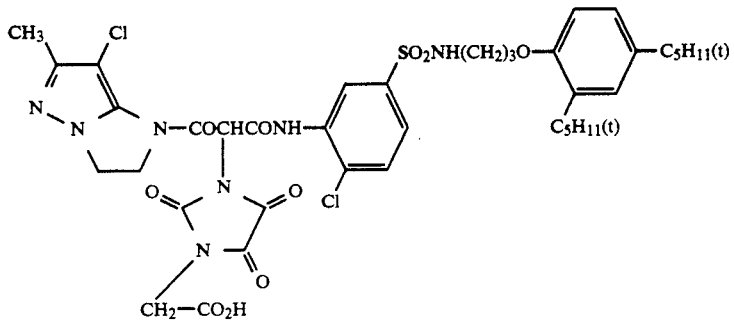
(32)
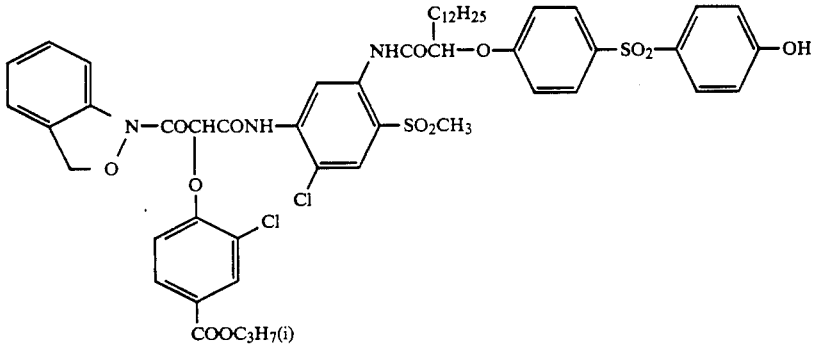
(33)
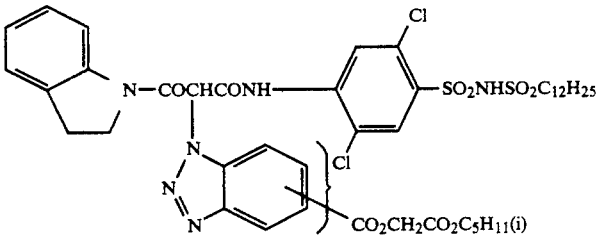
(34)
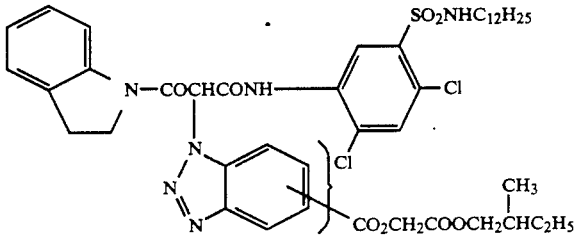

-continued
(35)
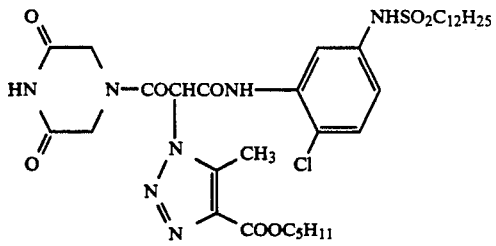
(36)
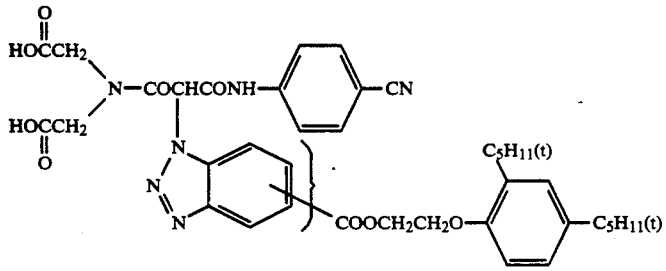
(37)
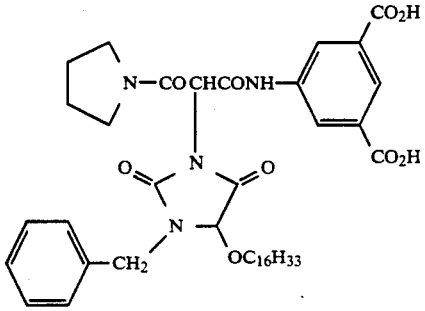
(38)
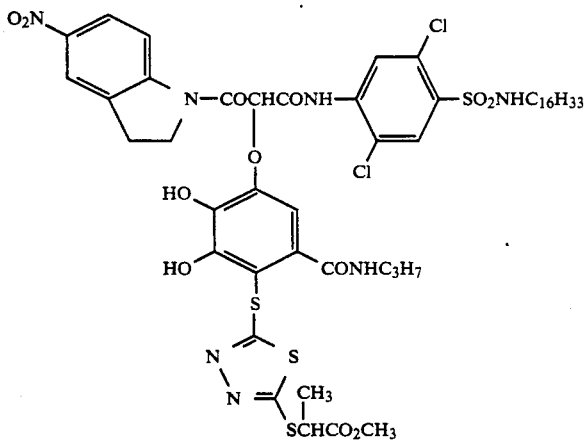
(39)
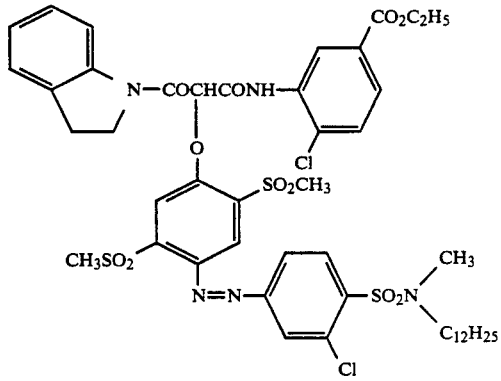

-continued
(40)
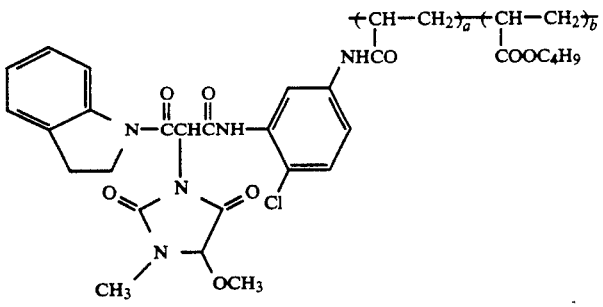
a/b = 1/1 (by weight)
average molecular weight: 30,000
(41)
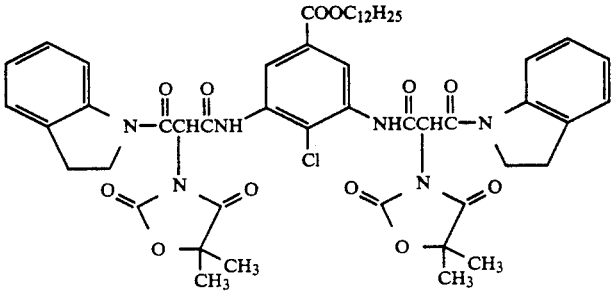
(42)
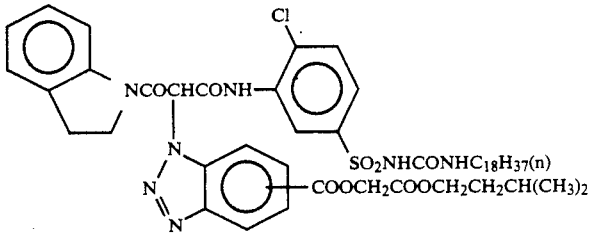
(43)
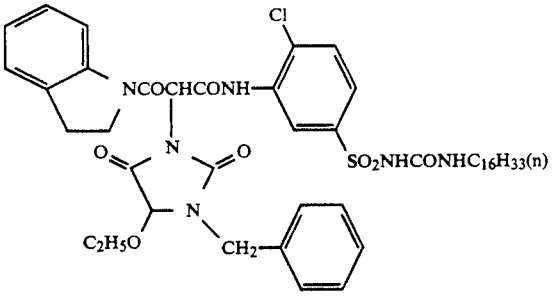
(44)
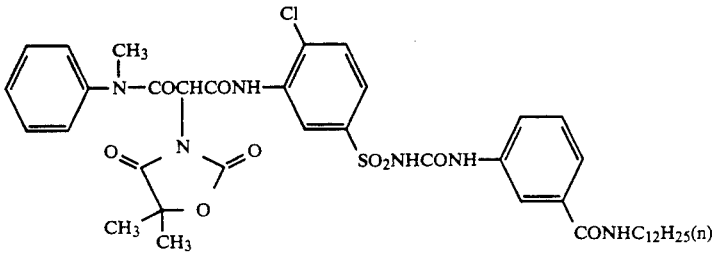

-continued (45)

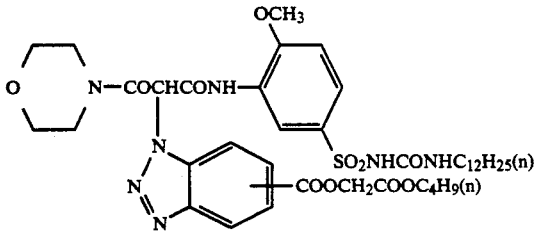

(46)

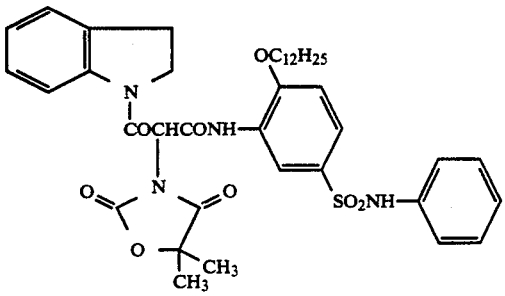

Yellow couplers of the present invention may preferably be incorporated into a light-sensitive silver halide emulsion layer or into the adjacent layers constituting the photographic material of the present invention. Especially preferably, they are incorporated into a light-sensitive silver halide emulsion layer of the material. The total amount of yellow coupler to be incorporated into the photographic material is from 0.0001 to 0.80 g/m$^2$, preferably from 0.0005 to 0.50 g/m$^2$, more preferably from 0.02 to 0.30 g/m$^2$, if the releasing group Z of the coupler molecule contains a photographically useful group component. If the group Z does not contain the same, the amount may be from 0.001 to 1.20 g/m$^2$, preferably from 0.01 to 1.00 g/m$^2$, more preferably from 0.10 to 0.80 g/m$^2$.

Yellow couplers of the present invention can be added to the photographic material in the same manner as that of adding ordinary couplers thereto, for example, as described hereinafter.

Yellow couplers of the present invention can be produced, for example, as described below.

PRODUCTION EXAMPLE 1

Production of Illustrated Coupler (1)

Illustrated coupler (1) was produced in accordance with the following reaction scheme.

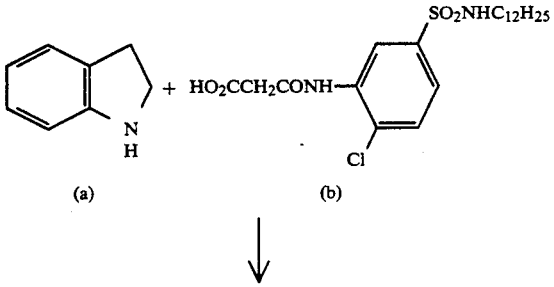

-continued

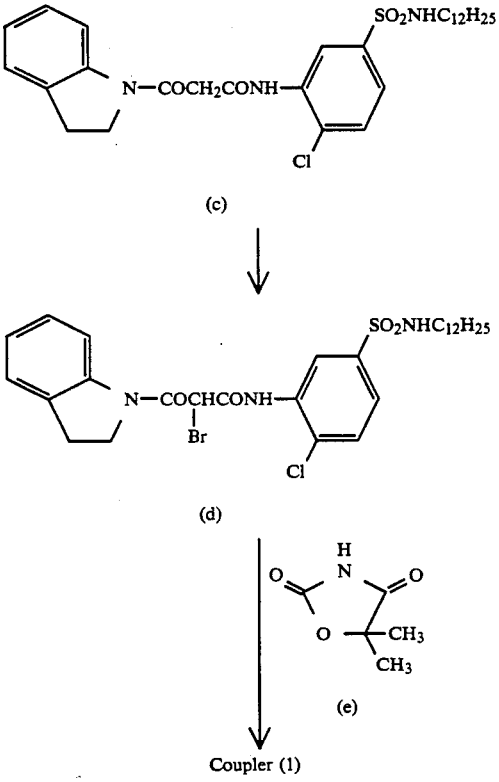

Step (1)

3.5 g of (a) and 13 g of (b) were dissolved in a mixed solvent comprising 100 ml of N,N-dimethylformamide and 100 ml of acetonitrile. To the solution was dropwise added 40 ml of an acetonitrile solution containing 6 g of N,N'-dicyclohexylcarbodiimide dissolved therein, at room temperature. After reacting for 2 hours, N,N'-dicyclohexylurea which precipitated out was removed by filtration. The resulting filtrate was added to 500 ml of water, which was then extracted with 500 ml of ethyl acetate. The extract was transferred to a separating funnel and washed with water, and the oily layer was separated. The solvent was removed by distillation under reduced pressure, and hexane was added to the residue for crystallization. 16.1 g of (c) was obtained.

Step (2)

16 g of (c) was blended with 150 ml of dichloromethane. A solution of 10 ml of dichloromethane containing 4.8 g of bromine was dropwise added thereto while cooling with ice (at 5° C. to 10° C.). After reacting for 10 minutes, the reaction mixture was transferred to a separating funnel and washed with water. The oily layer (containing (d)) was removed and this was used in the next step.

Step (3)

8.2 g of (e) and 8.8 ml of triethylamine were added to 160 ml of N,N-dimethylformamide. To the solution was dropwise added the previously prepared dichloromethane solution of (d), at room temperature. After reacting for 1 hour, 500 ml of ethyl acetate was added to the reaction mixture, which was then transferred to a separating funnel and washed with water. After neutralizing with a diluted hydrochloric acid, it was again washed with water. The oily layer was separated, and the solvent was removed by distillation under reduced pressure. The residue was isolated and purified by column chromatography, whereupon silica gel was used as a filler and ethyl acetate/hexane (1/1 by volume) as an eluent. Fractions containing the indented product were collected and the solvent was removed therefrom by distillation under reduced pressure to obtain 16.3 g of coupler (1) as a waxy substance.

PRODUCTION EXAMPLE 2

Production of Illustrated Coupler (2)

15.4 g of a waxy coupler (2) was produced in the same manner as described in Production Example 1, except that (b) was replaced by the same molar amount of (f) and (e) was replaced by the same molar amount of (g).

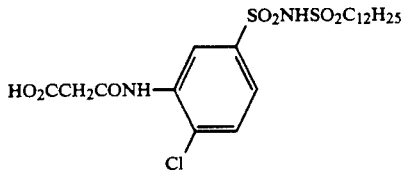

(f)

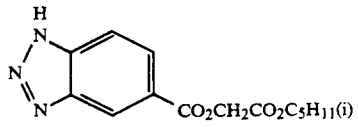

(g)

PRODUCTION EXAMPLE 3

Production of Illustrated Coupler (6)

Coupler (6) was produced in accordance with the following reaction scheme.

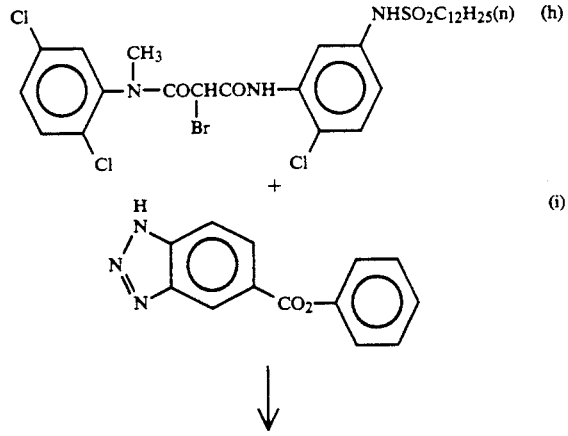

(h)

(i)

Coupler (6)

Precisely, 4.42 9 of compound (i) and 1.87 q of triethylamine were added to 50 ml of N,N-dimethylformamide and stirred for 10 minutes. To the solution was dropwise added a solution prepared by dissolving 6.23 g of compound (h) in 20 ml of methylene chloride, at room temperature over a period of 15 minutes. After reacting for 1 hour at room temperature, the reaction solution was poured into ice water and then extracted with ethyl acetate. The organic layer was dried with magnesium sulfate, the drying agent was removed by filtration, and the solvent was removed by distillation under reduced pressure. The product was purified by silica gel column chromatography to obtain 4.7 of the desired coupler (6) as a white powder.

Next, an emulsion containing tabular silver halide grains for use in the present invention is described hereinafter in detail.

The mean aspect ratio for defining the tabular silver halide grains in the emulsion for use in the present invention indicates a mean value of the ratio of thickness/diameter of silver halide grains. That is, it means a mean value of the data as obtained by dividing the diameter of the respective silver halide grains by the thickness thereof. The diameter of silver halide grains indicates a diameter of the circle having the same area as the projected area of each grain, when a silver halide emulsion is observed with a microscope or an electronic microscope. Accordingly, the mean aspect ratio of 2 or more means that the diameter of the circle is 2 times or more of the thickness of the grain.

The tabular silver halide grains for use in the present invention have a diameter of two times or more, preferably from 3 to 20 times, more preferably from 4 to 15 times, especially preferably from 5 to 10 times, of the thickness of the grain. The proportion of such tabular silver halide grains in all the silver halide grains in the emulsion is 50% or more as the projected area, and it is preferably 70% or more, especially preferably 85% or more.

Using such an emulsion, a silver halide photographic material having an excellent sharpness can be obtained. The reason why the material having such an emulsion has such an excellent sharpness is because light scattering in the emulsion layer of such an emulsion is much smaller than that in a conventional emulsion layer. This can easily be ascertained by any experimental method which is generally used by those skilled in the art.

Though it is not clear, the reason why light scattering in an emulsion layer containing tabular silver halide grains may be presumed to be low is because the main plane of each of the tabular silver halide grains in the emulsion layer is oriented in parallel to the surface of the support.

The diameter of the tabular silver halide grains for use in the present invention may be from 0.02 to 10 μm, preferably from 0.3 to 10.0 μm, especially preferably from 0.4 to 5.0 μm. The thickness of the grains may be preferably 0.5 μm or less. The diameter of the tabular silver halide grains as referred to herein indicates a diameter of a circle having the same area as the projected area of the grain. The thickness of the grains is represented by the distance between the two parallel planes of constituting the tabular silver halide grain.

In the present invention, more preferred tabular silver halide grains have a grain diameter from 0.3 μm to 10.0 μm, a grain thickness of 0.3 μm or less, and a mean aspect ratio (diameter/thickness) from 5 to 10. Other tabular grains than the defined ones are not preferred, since they may cause problems with respect to the photographic properties of the photographic materials when the materials are folded, when the materials are firmly rolled up or are brought into contact with a sharp body. Especially preferred for use in the present invention is a silver halide emulsion, containing tabular silver halide grains having a grain diameter of from 0.4 μm to 5.0 μm and a mean aspect ratio (diameter/thickness) of 5 or more in an amount of 85% or more as the total projected area of all the grains in the emulsion.

The tabular silver halide grains for use in the present invention may be any of the silver chloride, silver bromide, silver chlorobromide, silver iodobromide or silver chloroiodobromide grains. More preferred are the silver bromide grains, silver iodobromide grains having a silver iodide content of 15 mol % or less, and silver chloroiodobromide or silver chlorobromide grains having a silver chloride content of 50 mol % or less and a silver iodide content of 2 mol % or less. The halogen composition distribution in the mixed silver halide grains may be either uniform or localized.

Tabular silver halide emulsions for use in the present invention are described in Cugnac Chateau's report; Duffin, *Photographic Emulsion Chemistry* (published by Focal Press, New York, 1966), pages 66 to 72; and A. P. H. Trivelli & W. F. Smith, *Phot. Journal*, 80 (1940), page 285. They may easily be prepared by reference to the methods described in JP-A-58-113927, JP-A-58-113928 and JP-A-58-127921.

For instance, seed crystals containing 40% by weight or more tabular grains are formed in an atmosphere having a relatively high pAg value and having pBr of 1.3 or less. The seed crystals are grown under the condition of having the same pBr by simultaneously adding a silver salt solution and a halide solution thereto, to thereby obtain the desired tabular grains. In the grain growing step, it is desired that the silver salt solution and halide solution are added to the seed crystals in such a way that any new crystal nuclei are not formed by the addition.

The size of the tabular silver halide grains to be formed can be controlled by well adjusting and selecting the temperature, the kind and the quality of the solvent, and the speed of addition of the silver salt and the halides to be added for growth of the seed grains.

In preparation of tabular silver halide grains for use in the present invention, a silver halide solvent can be added to the reaction system, if desired, whereby the grain size, the shape of the grains to be formed (aspect ratio of diameter/thickness, etc.), the grain size distribution and the grain growing speed may well be controlled. The amount of the solvent to be added is desirably from $10^{-3}$ to 1.0% by weight, especially preferably from $10^{-2}$ to $10^{-1}$% by weight, based on the weight of the reaction solution. In the present invention, the grain size distribution can be monodispersed and the grain growing speed can be elevated by increasing the amount of the solvent to be used. The thickness of the grains to be formed is apt to increase with an increase of the amount of the solvent.

In the present invention, any known silver halide solvent can be used. Silver halide solvents often used in the present invention include ammonia, thioethers, thioureas, thiocyanates and thiazolinethiones. Regarding thioethers, those described in U.S. Pat. Nos. 3,271,157, 3,574,628 and 3,790,387 may be used. Regarding thioureas, those described in JP-A-53-82408 and JP-A-55-77737 may be used; regarding thiocyanates, those described in U.S. Pat. Nos. 2,222,264, 2,448,534 and 3,320,069 may be used; and regarding thiazolinethiones, those described in JP-A-53-144319 may be used.

In the step of forming silver halide grains for use in the present invention or of physically ripening them, a cadmium salt, a zinc salt, a thallium salt, an iridium salt or a complex salt thereof, a rhodium salt or a complex salt thereof, or an iron salt or a complex salt thereof can be incorporated into the reaction system.

In preparation of tabular silver halide grains for use in the present invention, the speed of addition of the silver salt solution (e.g., aqueous $AgNO_3$ solution) and the halide solution (e.g., aqueous KBr solution), the amounts added, and the concentration thereof are desired to be elevated for the purpose of promoting the rate of growth of the grains. Regarding the means of elevating them, the descriptions of U.S. Pat. Nos. 1,335,925, 3,650,757, 3,672,900 and 4,242,445 and JP-A-55-142329 and JP-A-55-158124 can be referred to.

The tabular silver halide grains for use in the present invention can be chemically sensitized, if desired. For chemical sensitization of the grains, for example, the methods described in H. Frieser, *Die Grundlagen der Photographichen Prozesse mit Silberhaligeniden* (published by Adakemische Verlagsgesellschaft, 1968), pages 675 to 735 can be referred to.

Briefly, a sulfur sensitization method using sulfur-containing compounds capable of reacting with an active gelatin or silver (for example, thiosulfates, thioureas, mercapto compounds, rhodanines); a reduction sensitizing method using a reducing substance (for example, stannous salts, amines, hydrazine derivatives, formamidinesulfinic acids, silane compounds); and a noble metal sensitization method using a noble metal compound (for example, gold complexes, as well as complexes of metals of the Group VIII of the Periodic Table such as Pt, Ir or Pd) can be employed singly or in combination for chemical sensitization of the grains.

Details of sulfur sensitization methods are described in, for example, U.S. Pat. Nos. 1,574,944, 2,278,947, 2,410,689, 2,728,668 and 3,656,955; those of reduction sensitization are described in, for example, U.S. Pat. Nos. 2,419,974, 2,983,609 and 4,054,458; and those of noble metal sensitization are described in, for example, U.S. Pat. Nos. 2,399,083, 2,448,060 and British Patent 618,061.

For the purpose of economizing silver, it is preferred that the tabular silver halide grains of the present invention are chemically sensitized by gold sensitization and/or sulfur sensitization.

The tabular silver halide grains for use in the present invention can be spectrally sensitized, if desired, by methine dyes and others. As another characteristic of the tabular silver halide grains of the present invention, in addition to the improved sharpness as mentioned above, the grains are characterized by a high color-sensitizing rate. As dyes usable for color sensitization, there are mentioned cyanine dyes, merocyanine dyes, complex cyanine dyes, complex merocyanine dyes, holopolar cyanine dyes, hemicyanine dyes, styryl dyes and hemioxonol dyes. Of them, especially useful are cyanine dyes, merocyanine dyes and complex merocyanine dyes.

Examples of useful sensitizing dyes for color sensitization of the tabular silver halide grains of the present invention include those described in German Patent 929,080, U.S. Pat. Nos. 2,493,748, 2,503,776, 2,519,001, 2,912,329, 3,656,959, 3,672,897, 4,025,349, British Patent 1,242,588, and JP-B-44-14030.

These sensitizing dyes may be used singly or in combination. Combination of plural sensitizing dyes is often employed especially for the purpose of super-color sensitization. Typical examples of the combination of sensitizing dyes for super-color sensitization are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609, 4,026,707, British Patent 1,344,281, JP-B-43-4936, JP-B-53-12375, and JP-A-52-109925, JP-A-52-110618.

The photographic emulsions for use in the present invention can contain various compounds, for the purpose of preventing fogging of photographic materials containing them during manufacture, storage or processing of the materials or for stabilizing the photographic properties of the materials. For instance, they may contain various compounds known as an antifoggant or stabilizer, such as azoles, for example, benzothiazolium salts, nitroimidazoles, triazoles, benzotriazoles, and benzimidazoles (especially, nitro- or halogen-substituted ones); heterocyclic mercapto compounds, for example, mercaptothiazoles, mercaptobenzothiazoles, mercaptobenzimidazoles, mercaptothiadiazoles, mercaptotetrazoles (especially, 1-phenyl-5-mercaptotetrazole), and mercaptopyrimidines; the above-mentioned heterocyclic mercapto compounds having a water-soluble group such as carboxyl group or sulfone group; thioketo compounds such as oxadolinethione; azaindenes such as triazaindenes, and tetrazaindenes (especially, 4-hydroxy-substituted (1,3,3a,7)tetrazaindenes); benzenethiosulfonic acids; and benzenesulfinic acids. For further detailed examples and methods of using them, for example, the descriptions of U.S. Pat. Nos. 3,954,474, 3,982,947 and 4,021,248 and JP-B-52-28660 can be referred to.

The above-described emulsions for use in the present invention are preferably monodispersed ones.

Monodispersed emulsions for use in the present invention are those having a grain size distribution of 0.25 or less as the variation coefficient relating to the grain size of silver halide grains therein. The variation coefficient indicates a value as obtained by dividing the standard deviation relating to the grain size by the mean grain size. Precisely, the mean grain size is defined as follows, where the grain size of the respective emulsion grains is represented by ri and the number of the grains is represented by ni:

$$\bar{r} = \frac{\Sigma ni \cdot ri}{\Sigma ni}$$

The standard deviation is defined as follows:

$$S = \sqrt{\frac{\Sigma(\bar{r} - ri)^2 \cdot ni}{\Sigma ni}}$$

The grain size of the respective grains as referred to herein means a "projected area corresponding diameter" which corresponds to the diameter of an area as projected by microscopic projection by an ordinary method well known in this technical field (generally, by electromicroscopic photography), for example, as described in T. H. James et al, *The Theory of the Photographic Process*, 3rd Ed., pages 36 to 43 (published by Macmillan Publishing Co., 1966). The projected area corresponding diameter of silver halide grains as referred to herein is defined by the diameter of the circle having the same area as the projected area of the silver halide grains, as stated in the above-described literature. Accordingly, even though the shapes of the silver halide grains are not spherical but are, for example, cubic, octahedral, tetradecahedral, tabular or potato-like, it is possible to obtain the above-described mean grain size r and the standard deviation S.

The variation coefficient relating to the grain size of the tabular silver halide grains of the present invention is 0.25 or less, preferably 0.20 or less, more preferably 0.15 or less.

The tabular silver halide grain emulsion of the present invention is especially preferably a monodispersed hexagonal tabular silver halide grain emulsion as described in JP-A-63-151618.

The hexagonal tabular silver halide grains as referred to herein are characterized in that the shape of the {1,1,1} plane is hexagonal and that the proportion of the adjacent sides to each other in the hexagonal plane is 2 or less. The proportion of the adjacent sides to each other in the hexagonal plane indicates a ratio of the side having a minimum length to the side having a maximum length in the hexagonal plane. The hexagonal tabular silver halide grains of the present invention may have somewhat roundish angles, so far as the proportion of the adjacent sides to each other in the hexagonal plane is 2 or less. For hexagonal tabular grains having roundish angles, the linear part of the side is prolonged while the linear part of the adjacent side is also prolonged, and the distance between the intersection points to be formed by the lines from the two prolonged sides indicates the side of the plane. ½ or more, especially preferably 4/5 or more, of the sides forming the hexagonal tabular grain of the present invention are desired to be substantially straight lines. In the present invention, the proportion of the adjacent sides to each other in the hexagonal plane is preferably from 1 to 1.5.

The hexagonal tabular silver halide grain emulsion of the present invention is composed of a dispersion medium and silver halide grains, and 50% or more, preferably 70% or more, more preferably 90% or more, as the total projected area, of all the silver halide grains are the above-mentioned hexagonal tabular silver halide grains.

In the present invention, the halogen composition of the hexagonal tabular silver halide grains may be any of silver bromide, silver iodobromide, silver chlorobromide or silver chloroiodobromide. Preferred are silver bromide and silver iodobromide. In the latter case of silver iodobromide grains, the silver iodide content in the grain may be from 0 to 30 mol %, preferably from 2 to 15 mol %, more preferably from 4 to 12 mol %. The intramolecular distribution of silver iodide in the grain may be uniform throughout the grain, or the silver iodide content in the inside of the grain may differ from that in the surface layer of the same. In addition, the grain may have a so-called multi-layer structure having plural layers each having a different silver iodide content in the inside of the grain. Preferred is a so-called iodide-rich core grain in which the silver iodide content in the surface of the grain is smaller than that in the inside of the same.

For preparation of such a hexagonal tabular silver halide grain emulsion for use in the present invention, the description of U.S. Pat. No. 4,797,354 can be referred to.

In preparing a monodispersed hexagonal tabular silver halide grain emulsion for use in the present invention, for example, the process is grouped into a nucleation step, an Ostwald ripening step and a grain growing step. In the first nucleation step, the pBr value is maintained within the range from 1.0 to 2.5 and nucleation is effected in a supersaturated condition for forming a large number of nuclei (tabular grain nuclei) each having twin planes as parallel as possible to each other (with respect to the temperature, gelatin concentration, speed of addition of aqueous silver salt solution and aqueous alkali halide solution, pBr, iodide content, stirring rotation number, pH, amount of silver halide solvent, salt concentration, etc.). In the next Ostwald ripening step, the temperature, pBr, pH gelatin concentration and amount of silver halide solvent are adequately controlled in order that any other grains than the tabular grain nuclei as formed in the nucleation step are decomposed and removed and thereby only the tabular grain nuclei are grown to give well monodispersed nuclei. In the last grain growing step, the pBr and the amounts of silver ions and halide ions to be added are adequately controlled whereby hexagonal tabular silver halide grains each having a desired aspect ratio and a desired size can be obtained. In the last grain growing step, it is desired that the addition speed of silver ions and halide ions is controlled to fall within the range from 30 to 100% of the critical crystal growing speed.

In the above-mentioned emulsion of the present invention, 50% by number or more of the silver halide grains therein are desired to contain 10 or more dislocations per one grain.

Dislocations of tabular grains can be observed by a direct method of using a transmission electronic microscope at a low temperature, for example, as described in J. F. Hamilton, *Phot. Sci, Eng.*, 11, 57 (1967) or T. Shiozawa, *J. Soc. Phot. Sci. Japan*, 35, 213 (1972). Briefly, silver halide grains are carefully taken out from an emulsion in such a way that any pressure causing dislocation of grains is not imparted to the grains, the grains are put on a mesh for electromicroscopic observation and they are electromicroscopically observed by a transmission method under a cooled condition for the purpose of preventing damage (such as print-out) of the grains by electronic rays thereto. In the observation, since transmission of electronic rays through thicker grains are more difficult, it is recommended to use a high-voltage electronic microscope for attaining sharper observation. (For instance, a 200 KV electronic microscope may be used for observation of 0.25 μm thick grains.) From photographs of grains thus obtained by this method, the positions and numbers of dislocations in each grain in the vertical direction from the main plane of this grain can be determined.

The positions of the dislocations of the tabular grains of the present invention are in the range from x% of the length between the center of the major axis direction and the side, to the side. The value of x is preferably $10 \leqq x < 100$, more preferably $30 \leqq x < 98$, most preferably $50 \leqq x < 95$. The shape to be obtained by linking the positions initiating the dislocations is nearly similar to the shape of the grain but is not completely similar to the latter. The former is often deformed. The directions of the dislocation lines are almost from the center to the sides but they often meander.

Regarding the number of the dislocations of the tabular grains of the present invention, it is desired that the tabular grain emulsion contains 50% by number or more, more preferably, 80% by number or more tabular grains each containing 10 or more dislocations per one grain, especially preferably contains 80% by number or more tabular grains each containing 20 or more dislocations per one grain.

In the preferred tabular silver halide grain emulsion for use in the present invention, which contains 50% by number or more tabular grains each containing 10 or more dislocations per one grain, it is more preferred that the respective silver tabular silver halide grains each have a relative standard deviation of the silver iodide content of 30% or less, especially preferably 20% or less.

The silver iodide content of the respective emulsion grains can be measured by analyzing the composition of each grain, for example, by the use of an X ray microanalyzer. The "relative standard deviation of the silver iodide content of each grain" as referred to herein indicates a value to be obtained by measuring the silver iodide content of each of at least 100 emulsion grains with, for example, an X-ray microanalyzer, dividing the standard deviation of the silver iodide content by the mean silver iodide content, and multiplying the resulting answer to the division by 100. A concrete method of measuring the silver iodide content of each of the emulsion grains is described, for example, in European Patent 147,868A.

If the relative standard deviation of the silver iodide content of the respective emulsion grains is large, the adequate point for chemical sensitization of the respective grains would vary so that it would be impossible to take out the properties of all the grains and that the intergranular relative standard deviation to the number of the dislocations would also be large.

The silver iodide content Yi (mol %) of the respective grains correlates with or does not correlate with the sphere-corresponding diameter Xi (micron) of them, and the latter having no correlation therebetween is desired in the present invention.

The structure of the halogen composition of the tabular grains of the present invention can be identified by X-ray diffraction, EPMA (in which silver halide grains are scanned by electronic rays to detect the silver halide composition of the grains—this may also be called XMA), or ESCA (in which the X ray is irradiated to silver halide grains and the photoelectrons to be emitted out from the surfaces of the irradiated grains are spectrally analyzed—this may also be called XPS), or a combination thereof.

The surface of a silver halide grain as referred to herein indicates a region from the surface to the depth of about 50 Å (angstrom) of one grain. The halogen composition in the region may be measured generally by ESCA. The inside of a silver halide grain as referred to herein indicates the other region of one grain than the above-defined surface region thereof.

An emulsion containing tabular grains having the above-mentioned dislocation lines can be prepared on the basis of the method described in JP-A-63-220238 or Japanese Patent Application No. 2-310862. The silver halide emulsion for use in the present invention is desired to have a narrow grain size distribution. For obtaining such a preferred emulsion, a method comprising a nucleation step, Ostwald ripening step and a grain growing step, as described in JP-A-63-151618, is preferably employed.

However, the silver iodide content of the respective grains constituting the emulsion as obtained by the method was often non-uniform, unless the method is controlled particularly severely.

For the purpose of unifying the silver iodide content of the respective grains in the emulsion, it is necessary to unify as much as possible the size and the shape of the grains after Ostwald ripening. In addition, in the next grain growing step, it is desired that the aqueous silver nitrate solution and the aqueous alkali halide solution are added by a double jet method while maintaining a constant pAg value falling within the range from 6.0 to 10.0 in the reaction system. In particular, for the purpose of forming a uniform coat over each grain, the supersaturation degree of the solutions being added is desired to be higher. For instance, the method described in U.S. Pat. No. 4,242,445 is preferred, in which solutions each having a relatively high supersaturation degree are added in order that the growing speed of the crystals in the reaction system could be from 30 to 100% of the critical crystal growing speed.

Dislocation of the tabular grains of the present invention can be controlled by providing a particular high iodide phase in the inside of the grain. More specifically, base grains are prepared, then a high iodide phase is introduced in each grain, and thereafter the outer surface of the grain is covered with a phase having a lower iodide content than the introduced high iodide phase. As a result, tabular grains with intended dislocations can be obtained. In order to unify the silver iodide content of each grain, it is important to suitably select the condition for forming the above-described high iodide phase.

The inside high iodide phase as referred to herein indicates an iodine-containing silver halide solid solution. The silver halide in the phase is preferably silver iodide, silver iodobromide or silver chloroiodobromide. More preferably, it is silver iodide or silver iodobromide (having a silver iodide content of from 10 to 40 mol %). Especially preferably, it is silver iodide.

It is important that the inside high iodide phase is not uniformly deposited on the plane surface of the tabular grain base but is rather locally positioned thereon. Localization of the phase may be effected on any site of the main planes, side planes, edges or angles of the grain base. If desired, such an inside high iodide phase may be positioned in such sites selectively and epitaxially.

For such localization, a so-called conversion method of singly adding an iodide salt to the grain bases, or an epitaxial junction method as described in, for example, JP-A-59-133540, JP-A-58-108526 and JP-A-59-162540 can be employed. In carrying out the method, selection of the following conditions is effective for unifying the silver iodide content of the respective grains to be formed. That is, the pAg value in the reaction system to which the iodide salt is added is to fall within the range from 8.5 to 10.5, especially preferably from 9.0 to 10.5. Addition of the iodide salt is effected under a sufficiently stirred condition in such a way that 1 mol % or more iodide to the total silver amount is added over a period from 30 seconds to 5 minutes.

The iodide content of the tabular grain base is lower than the high iodide phase and is preferably from 0 to 12 mol %, more preferably from 0 to 10 mol %.

The outside phase to cover the high iodide phase has a lower iodide content than the high iodide phase and it has an iodide content from 0 to 12 mol %, more preferably from 0 to 10 mol %, most preferably from 0 to 3 mol %.

It is preferred that the inside high iodide phase is, on average, within a circular range around the center of the grain, which is from 5 mol % to 80 mol %, more preferably from 10 mol % to 70 mol %, especially preferably from 20 mol % to 60 mol %, as the total silver content in the grain from the center of the grain with respect to the major axis direction of the grain.

The major axis direction of the grain as referred to herein indicates a diameter direction of the tabular grain; while the minor axis direction of the same indicates a thickness direction of the tabular grain.

The iodide content of the inside high iodide phase is higher than the mean iodide content in the silver iodide, silver iodobromide or silver chloroiodobromide as existing on the surface of the grain, and the former is preferably 5 times or more, especially preferably 20 times or more, of the latter.

The amount of the silver halide forming the inside high iodide phase is desired to be 50 mol % or less, more preferably 10 mol % or less, most preferably 5 mol % or less, as silver, of the total amount of the grain.

By incorporating various compounds into the step of forming silver halide precipitates, the properties of the silver halide grains to be formed can be controlled. Such additive compounds may initially be in the reactor. Alternatively, they may added to the reactor along with the addition of one or more salts, by an ordinary method. For instance, as described in U.S. Pat. Nos. 2,448,060, 2,628,167, 3,737,313 and 3,772,031 and Research Disclosure No. 134, Item 13452 (June, 1975), compounds of copper, iridium, lead, bismuth, cadmium, zinc (e.g., in the form of chalcogen compounds of sulfur, selenium or tellurium), gold or noble metals of the Group VII may be added to the step of forming silver halide precipitates so as to control the characteristics of the silver halide grains to be formed. As described in JP-B-58-1410, and Moisar et al, *Journal of Photographic Science,* Vol. 25, pages 19 to 27 (1977), the inside of the respective silver halide grains in a silver halide emulsion can be sensitized by reduction sensitization during the step of forming silver halide precipitates.

The tabular silver halide grains for use in the present invention may have different halogen compositions in one grain as bonded to each other by epitaxial junction; or they may have any other compound than silver halides such as silver rhodanide or lead oxide as bonded to the silver halide of the grain by junction. Such grains are illustrated, for example, in U.S. Pat. Nos. 4,094,684, 4,142,900, 4,459,353, British Patent 2,038,792, U.S. Pat.

Nos. 4,349,622, 4,395,478, 4,433,501, 4,463,087, 3,656,962, 3,852,067, and JP-A-59-162540.

The tabular silver halide grain emulsion of the present invention is, in general, chemically sensitized.

Chemical sensitization of the emulsion is effected after formation of the emulsion. If desired, the emulsion may be rinsed with water after formation of the emulsion and before chemical sensitization of the same.

Details of chemical sensitization of emulsions are described in Research Disclosure Item 17643 (December 1978, page 23) and Item 18716 (November 1979, page 648, right column). Briefly, the emulsion of the present invention can be sensitized with one or more sensitizing agents of sulfur, selenium, tellurium, gold, platinum, palladium and iridium compounds, at pAg from 5 to 10 and pH from 5 to 8 and at a temperature from 30° to 80° C.

The tabular silver halide grain emulsion of the present invention is desired to be chemically sensitized in the presence of color sensitizing dye(s). A method of chemically sensitizing an emulsion in the presence of color sensitizing dye(s) is described in, for example, U.S. Pat. Nos. 4,425,426 and 4,442,201, and JP-A-59-9658, 61-103149 and 61-133941. Any color sensitizing dyes generally known usable in ordinary silver halide photographic materials can be employed. Examples of usable color sensitizing dyes are described in Research Disclosure Item 17643, pages 23 to 24 and Item 18716, from page 648, right column to page 649, right column. Color sensitizing dyes can be used either singly or plurally in combination for attaining the purpose.

The time of adding color sensitizing dye(s) may be anytime before initiation of chemical sensitization (during formation of grains, after formation of grains, after rinsing of grains), during the course of chemical sensitization or after finish of chemical sensitization. Preferably, such dye(s) are added after formation of grains and before initiation of chemical sensitization of them or after finish of chemical sensitization of the formed grains.

The amount of the color sensitizing dye(s) to be added is not specifically defined, and it is preferably from 30 to 100%, more preferably from 50 to 90%, of the saturated adsorption amount of them.

The tabular silver halide grain emulsion of the present invention is generally color-sensitized. As color sensitizing dyes to be used for color sensitization of the emulsion, those mentioned in the aforesaid two Research disclosures are referred to. Where the emulsion is chemically sensitized in the presence of color sensitizing dye(s) as mentioned above, it is also color-sensitized. Therefore, further dye(s) of the same kind(s) or different kind(s) may be or may not be added to the emulsion for further color sensitization.

The emulsion of the present invention can be in a light-sensitive layer singly or along with additional one or more emulsions each having a different mean grain size. Where two or more emulsions are employed, they may be in different layers but they are preferably in one and the same light-sensitive layer. Where two or more emulsions are employed, they may be combination of the emulsion having the particular mean aspect ratio as defined in the present invention and other(s) not having the same. Such combination of different emulsions is preferred, in view of control of gradation, control of graininess in all the range from the low exposure range to high exposure range, and control of color development dependence (development time dependence, developer composition (e.g., color developing agent, sodium sulfite) dependence and pH dependence).

The emulsion of the present invention is especially desired to have a relative standard deviation of the intergranular silver iodide content of being 20% or less. Details of "relative standard deviation of intergranular silver iodide content" of silver halide grains are described in JP-A-60 143332 and JP-A-60-254032.

Especially preferably, the silver halide photographic material of the present invention contains a compound of the following general formula (A), for the purpose of further improving the sensitivity, graininess and desilverability:

$$Q—SM^1 \qquad (A)$$

wherein Q represents a heterocyclic residue having at least one selected from the group consisting of $—SO_3M^2$, $—COOM^2$, —OH and $—NR^1R^2$ bonded thereto directly or indirectly;

$M^1$ and $M^2$ independently represents a hydrogen atom, an alkali metal, a quaternary ammonium group, or a quaternary phosphonium group; and $R^1$ and $R^2$ independently represents a hydrogen atom, or a substituted or unsubstituted alkyl group.

Specific examples of the heterocyclic residue of Q in formula (A) include an oxazole ring, a thiazole ring, an imidazole ring, a selenazole ring, a triazole ring, a tetrazole ring, a thiadiazole ring, an oxadiazole ring, a pentazole ring, a pyrimidine ring, a thiazine ring, a triazine ring, and a thiadiazine ring; and a condensed hetero ring as condensed with other carbon ring(s) and/or hetero ring(s), such as a benzothiazole ring, a benzotriazole ring, a benzimidazole ring, a benzoxazole ring, a benzoselenazole ring, a naphthoxazole ring, a triazaindolidine ring, a diazaindolidine ring, and a tetrazaindolidine ring.

Of the mercapto-heterocyclic compounds of formula (A), especially preferred are those of the following formulae (B) and (C):

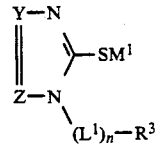

(B)

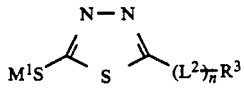

(C)

In formula (B), Y and Z independently represents a nitrogen atom or $CR^4$;

$R^4$ represents a hydrogen atom, a substituted or unsubstituted alkyl group, or a substituted or unsubstituted aryl group;

$R^3$ represents an organic residue substituted by at least one substituent selected from the group consisting of $—SO_3M^2$, $—COOM^2$, —OH and $—NR^1R^2$, and more specifically, the organic residue is an alkyl group having from 1 to 20 carbon atoms (e.g., methyl, ethyl, propyl, hexyl, dodecyl, octadecyl), or an aryl group having from 6 to 20 carbon atoms (e.g., phenyl, naphthyl);

$L^1$ represents a linkinq group selected from the group consisting of —S—, —O—, —N—, —CO—, —SO— and —$SO_2$—; and n represents 0 or 1.

The alkyl or aryl group may further be substituted by one or more substituents selected from, for example, a halogen atom (e.g., F, Cl, Br), an alkoxy group (e.g., methoxy, methoxyethoxy), an aryloxy group (e.g., phenoxy), an alkyl group (when $R^2$ is an aryl group), an aryl group (when $R^2$ is an alkyl group), an amido group (e.g., acetamido, benzoylamino), a carbamoyl group (e.g., unsubstituted carbamoyl, phenylcarbamoyl, methylcarbamoyl), a sulfonamido group (e.g., methanesulfonamido, phenylsulfonamido), a sulfamoyl group (e.g., unsubstituted sulfamoyl, methylsulfamoyl, phenylsulfamoyl), a sulfonyl group (e.g., methylsulfonyl, phenylsulfonyl), a sulfinyl group (e.g., methylsulfinyl, phenylsulfinyl), a cyano group, an alkoxycarbonyl group (e.g., methoxycarbonyl), an aryloxycarbonyl group (e.g., phenoxycarbonyl), and a nitro group.

When $R^3$ has two or more substituents of —$SO_3M$, —$COOM^2$, —OH and —$NR^1R^2$, they may be the same or different.

$M^2$ has the same meaning as that defined in formula (A).

In formula (C), X represents a sulfur atom, an oxygen atom, or —$N(R^5)$—; and $R^5$ represents a hydrogen atom, a substituted or unsubstituted alkyl group, or a substituted or unsubstituted aryl group.

$L^2$ represents —$CONR^6$—, —$NR^6CO$—, —$SO_2NR^6$—, —$NR^6SO_2$—, —OCO—, —COO—, —S—, —$NR^6$—, —CO—, —SO—, —OCOO—, —$NR^6CONR^7$—, —$NR^6COO$—, —$OCONR^6$—, or —$NR^6SO_2NR^7$—; and $R^6$ and $R^7$ each represents a hydrogen atom, a substituted or unsubstituted alkyl group, or a substituted or unsubstituted aryl group.

$R^3$ and $M^2$ have the same meanings as those defined in formulae (A) and (B); and n represents 0 or 1.

As substituents of the alkyl or aryl group of $R^4$, $R^5$, $R^6$ or $R^7$, the same ones as those mentioned for the aforesaid $R^3$ group may be referred to.

In formula (A), $R^3$ is especially preferably —$SO_3M^2$ or —$COOM^2$.

Preferred examples of compounds of formula (A) for use in the present invention are mentioned below.

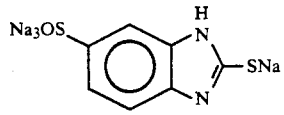
(1)

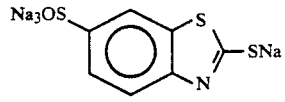
(2)

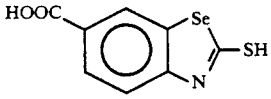
(3)

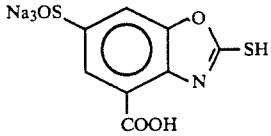
(4)

-continued

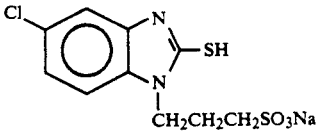
(5)

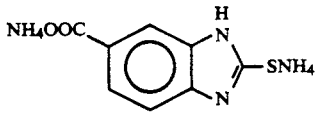
(6)

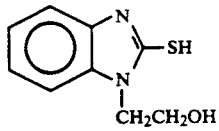
(7)

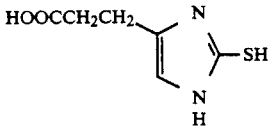
(8)

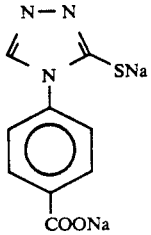
(9)

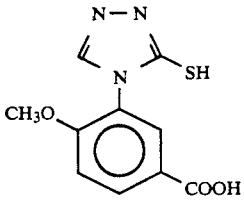
(10)

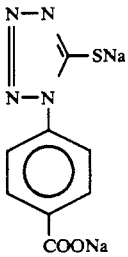
(11)

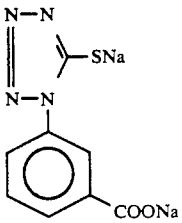
(12)

-continued
(13)
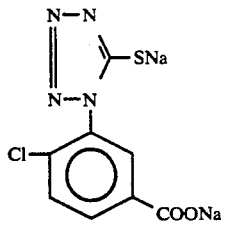
(14)
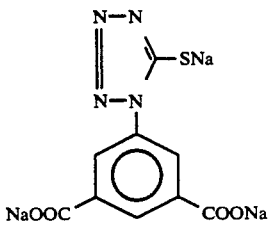
(15)
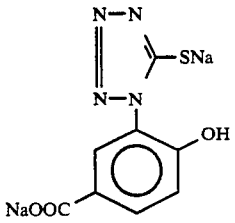
(16)
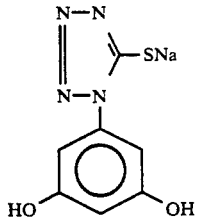
(17)
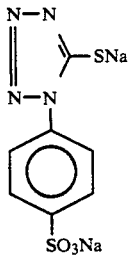
(18)
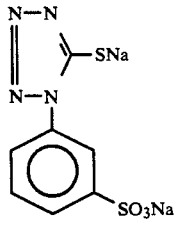
(19)
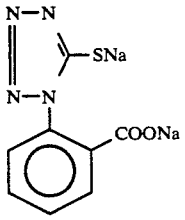
-continued
(20)
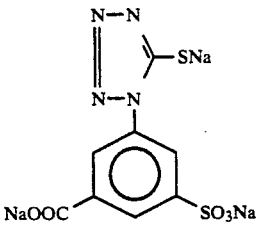
(21)
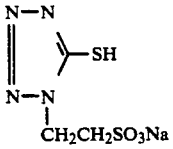
(22)
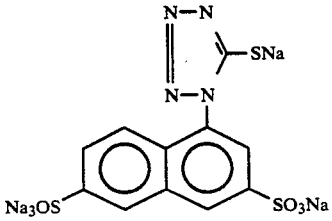
(23)
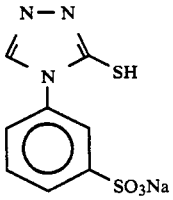
(24)
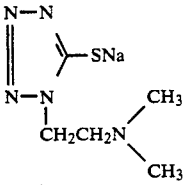
(25)
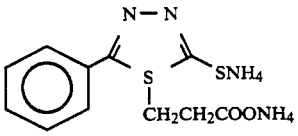
(26)
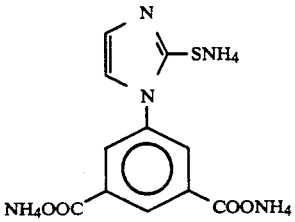
(27)
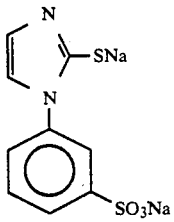

-continued (28)

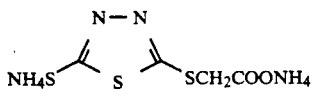

(29)

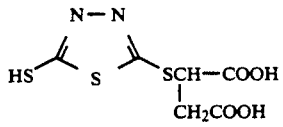

(30)

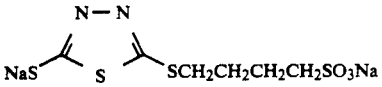

(31)

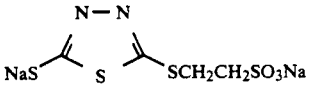

(32)

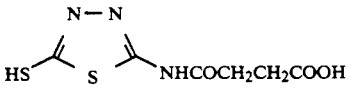

(33)

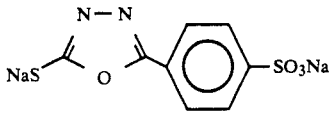

(34)

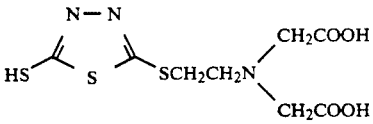

(35)

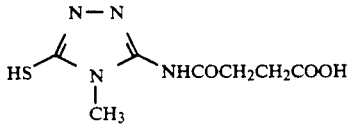

(36)

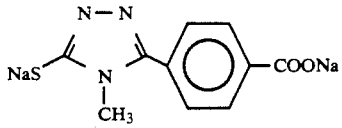

(37)

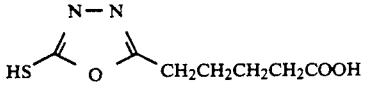

(38)

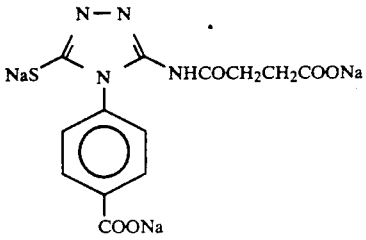

-continued (39)

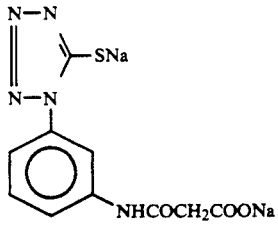

Compounds of formula (A) are known or can be produced by known methods, for example, by those described in the following patent publications or literature references: U.S. Pat. Nos. 2,585,388, 2,541,924; JP-B-42-21842; JP-A-53-50169; British Patent 1,275,701; D. A. Berges et al, *Journal of the Heterocyclic Chemistry,* Vol. 15, No. 981 (1978); *The Chemistry of Heterocyclic Chemistry,* Imidazole and Derivatives, Part I, pages 336 to 339; *Chemical Abstract,* 58, 7921 (1963), page 394; E. Hoggarth, *Journal cf Chemical Society,* pages 1160 to 1167 (1949); S. R. Saudler & W. Karo, *Organic Functional Group Preparation,* Academic Press, pages 312 to 315 (1968); M. Chamdon et al, *Bulletin de la Society Chimique de France,* 723 (1954); D. A. Shirley & D. W. Alley, *J. Amer. Chem. Soc.,* 79, 4922 (1954); A. Whol & W. Warchwald, *Ber.* (Journal of German Chemical Society), Vol. 22, page 568 (1989); *J. Amer. Chem. Soc.,* 44, pages 1502 to 1510; U.S. Pat. No. 3,017,270; British Patent 940,169; JP-B-49-8334; JP-A-55-59463; *Advanced in Heterocyclic Chemistry,* 9, 165 to 209 (1965); German Patent 2,716,707; *The Chemistry of Heterocyclic Compounds,* Imidazole and Derivatives, Vol 1, page 384; *Org. Synth.,* IV., 569 (1963); *Ber.,* 9, 465 (1976); *J. Amer. Chem. Soc.,* 45, 2390 (1923); JP-A-50-89034, JP-A-53-28426, JP-A-55-21007, JP-A-40-28496.

Compounds of formula (A) can be incorporated into silver halide emulsion layers and hydrophilic colloid layers (interlayer, surface protective layer, yellow filter layer, anti-halation layer, etc.) constituting the photographic material of the present invention, and they are preferably incorporated into silver halide emulsion layers or the adjacent layers.

The amount of the compounds of formula (A) to be incorporated in such layers is from $1\times10^{-7}$ to $1\times10^{-3}$ mol/m$^2$, preferably from $5\times10^{-7}$ to $1\times10^{-4}$ mol/m$^2$, more preferably from $1\times10^{-6}$ to $3\times10^{-5}$ mol/m$^2$.

The photographic material of the present invention is not specifically defined, provided that it has at least one blue-sensitive silver halide emulsion layer, at least one green-sensitive silver halide emulsion layer and at least one red sensitive silver halide emulsion layer on a support. In the material, the number of the silver halide emulsion layers and non-light-sensitive layers as well as the order of the layers on the support is not specifically defined. A typical example thereof is a silver halide color photographic material having plural light-sensitive layer units each composed of plural silver halide emulsion layers each having substantially the same color-sensitivity but having a different degree of sensitivity. The respective light-sensitive layers are unit light-sensitive layers each having a color-sensitivity to any-one of blue light, green light and red light. In such a multi-layer silver halide color photographic material, in general, the order of the light-sensitive layer units to be on the support comprises a red-sensitive layer unit, a green-sensitive layer unit and a blue-sensitive layer unit as formed on the support in this order. As the case may be, however, the order may be opposite to the above-mentioned one, in accordance with the object of the photographic material. As still another embodiment, a different color-sensitive layer may be sandwiched between other two and the same color-sensitive layers.

Various non-light-sensitive layers such as an interlayer may be provided between the above-mentioned silver halide light-sensitive layers, or on or below the uppermost layer or lowermost layers.

Such an interlayer may contain various couplers and DIR compounds described in JP-A-61 43748, JP-A-59-113438, JP-A-59-113440, JP-A-61-20037 and JP-A-61-20038, and it may also contain conventional color mixing preventing agents.

As the constitution of the plural silver halide emulsions constituting the respective light-sensitive layer units, preferred is a two-layered constitution composed of a high-sensitivity emulsion layer and a low-sensitivity emulsion layer as described in German Patent 1,121,470 and British Patent 923,045. In general, it is preferred that the plural light-sensitive layers are arranged on the support in such a way that the sensitivity degree of the layer is to gradually decrease in the direction to the support. In one embodiment, a non-light-sensitive layer may be provided between the plural silver halide emulsion layers. As another embodiment, a low-sensitivity emulsion layer is formed remote from the support and a high-sensitivity emulsion layer is formed near to the support, as described in JP-A-57-112751, JP-A-62-200350, JP-A-62-206541, and JP-A-62-206543.

As specific examples of the layer constitution on the support, there are mentioned an order of low-sensitivity blue sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; and an order of BH/BL/GL/GH/RH/RL; and an order of BH/BL/GH/GL/RL/RH.

Other examples include an order of blue-sensitive layer/GH/RH/GL/RL from the remotest side from the support, as described in JP-B-55-34932; and an order of blue-sensitive layer/GL/RL/GH/RH from the remotest side from the support, as described in JP-A-56-25738 and JP-A-62-63936.

A further example can be a three-layer unit constitution as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of this type, the degree of sensitivity of each emulsion layer is gradually lowered to the direction of the support. Even in the three-layer constitution of this type, each of the same color-sensitivity layers may be composed of three layers of a middle-sensitivity emulsion layer/high sensitivity emulsion layer/low-sensitivity emulsion layer as formed in this order from the remotest side from the support, as described in JP-A-59-202464.

As still other examples of the layer constitution of the photographic material of the present invention, there are mentioned an order of a high-sensitivity emulsion layer/low-sensitivity emulsion layer/middle-sensitivity emulsion layer, and an order of a low-sensitivity emulsion layer/middle-sensitivity emulsion layer/high-sensitivity emulsion layer. When the photographic material of the invention has four or more layers, the layer constitution thereof may be varied in accordance with the manner mentioned above.

In order to improve the color reproducibility, it is desired to provide a donor layer (CL) which has an interlayer effect and which has a different color sensitivity distribution from that of the essential light-sensitive layers of BL, GL and RL, adjacent to or near to the essential light-sensitive layers, in the manner described in U.S. Pat. Nos. 4,663,271, 4,705,744 and 4,707,436 and JP-A-62-160448 and JP-A-63-89580.

As described above, various layer constitutions and arrangements may be selected in accordance with the object of the photographic material of the invention.

The silver halide to be preferably used in the photographic emulsion layer constituting the photographic material of the present invention is silver iodobromide, silver iodochloride or silver iodochlorobromide having a silver iodide content of about 30 mol % or less. Especially preferred is a silver iodobromide or silver iodochlorobromide having a silver iodide content of from about 2 mol % to about 25 mol %.

The silver halide grains to be in the photographic emulsion constituting the photographic material of the present invention may be regular crystalline ones such as cubic, octahedral or tetradecahedral grains, or irregular crystalline ones such as spherical or tabular grains, or irregular crystalline ones having a crystal defect such as a twin plane, or composite crystalline ones composed of the above mentioned regular and irregular crystalline forms.

Regarding the grain size of the silver halide grains, the grains may be fine grains having a small grain size of about 0.2 micron or less or may be large ones having a large grain size of up to about 10 microns as the diameter of the projected area. The emulsion of the grains may be either a polydispersed emulsion or a monodispersed emulsion.

The silver halide photographic emulsions to be used in the present invention may be prepared by various methods, for example, those described in Research Disclosure (RD) No. 17643 (December, 1978), pages 22 to 23 (I. Emulsion Preparation and Types); RD No. 18716 (November, 1979), pages 648; RD No. 307105 (November 1989); P. Glafkides, *Chimie et Physique Photographique* (published by Paul Montel, 1967); G. F. Duffin, *Photographic Emulsion Chemistry* (published by Focal Press, 1966); and V. L. Zelikman et al, *Making and Coating Photographic Emulsion* (published by Focal Press, 1964).

Monodispersed emulsions as described in U.S. Pat. Nos. 3,574,628 and 3,655,394 and British Patent 1,413,748 are also preferably used in the present invention.

Additionally, tabular grains having an aspect ratio of about 5 or more may also be used in the present invention. Such tabular grains may easily be prepared in accordance with the various methods, for example, as described in Gutoff, *Photographic Science and Engineering*, Vol. 14, pages 248 to 257 (1970); and U.S. Pat. Nos. 4,434,226, 4,414,310, 4,433,048, 4,439,520 and British Patent 2,112,157.

Regarding the crystal structure of the silver halide grains constituting the emulsions of the invention, the grains may have the same halogen composition throughout the whole grain, or they may have different halogen compositions between the inside part and the outside part of one grain, or they may have a layered structure. Further, the grains may have different halogen compositions as conjugated by an epitaxial bond, or they may have other components than silver halides, such as silver rhodanide or lead oxide, as conjugated with the silver halide matrix. Additionally, a mixture of various grains of different crystalline forms may be employed in the present invention.

The above-mentioned emulsions for use in the present invention may be either surface latent image type ones for forming latent images essentially on the surfaces of the grains or internal latent image type ones for forming latent images essentially in the inside of the grains, or may also be surface/inside latent image type ones for forming a latent image both on the surface of the grains and inside of the grains. In any event, the emulsions must be negative emulsions. As internal latent image type emulsions, they may be internal latent image type core/shell emulsions as described in JP-A 63-264740. A method of preparing such internal latent image type core/shell emulsions is described in JP-A-59-133542. The thickness of the shell of the emulsion grains of the type varies, depending upon the way of developing them, and is preferably from 3 to 40 nm, especially preferably from 5 to 20 nm.

The emulsions for use in the invention are generally physically ripened, chemically ripened and/or color-sensitized. Additives to be used in such a ripening or sensitizing step are described in Research Disclosure Nos. 17643, 18716 and 307105, and the related descriptions in these references are shown in the table described below.

In the photographic material of the present invention, two or more emulsions which are different from one another in at least one characteristic of light-sensitive silver halide grains constituting them, which is selected from the grain size, the grain size distribution, the halogen composition, the shape and the sensitivity of the grains, can be incorporated into one and the same layer.

Surface-fogged silver halide grains as described in U.S. Pat. No. 4,082,553; inside-fogged silver halide grains as described in U.S. Pat. No. 4,626,498 and JP-A 59-214852; as well as colloidal silver may preferably be used in the light-sensitive silver halide emulsion layers and/or substantially non-light-sensitive hydrophilic colloid layers constituting the photographic material of the present invention. Inside-fogged or surface-fogged silver halide grains are such grains that can be non-imagewise uniformly developed irrespective of the non-exposed area and the exposed area of the photographic material. A method of preparing such inside-fogged or surface-fogged silver halide grains is described in U.S. Pat. No. 4,626,498 and JP-A-59-214852.

The silver halide forming the inside nucleus of an inside-fogged core/shell type silver halide grain may be either one having the same halogen composition or one having a different halogen composition. The inside-fogged or surface-fogged silver halide may be any of silver chloride, silver chlorobromide, silver iodobromide or silver chloroiodobromide. The grain size of such a fogged silver halide grain is not specifically defined, and it is preferably from 0.01 to 0.75 μm, especially preferably from 0.05 to 0.6 μm, as a mean grain size. The shape of the grain is also not specifically defined, and it may be either a regular grain or an irregular grain. The emulsion containing such fogged grains may be either a monodispersed one or a polydispersed one. Preferred is a monodispersed one, in which at least 95% by weight or by number of all the silver halide grains therein have a grain size to fall within the range of the mean grain size +/− 40%.

The photographic material of the present invention preferably contain non-light-sensitive fine silver halide grains. Non-light-sensitive fine silver halide grains are meant to be fine silver halide grains which are not sensitive to the light as imparted to the photographic material for imagewise exposure thereof and are substantially not developed in the step of development of the exposed material. These fine grains are preferably not previously fogged.

The fine silver halide grains have a silver bromide content from 0 to 100 mol % and, if desired, they may additionally contain silver chloride and/or silver iodide. Preferably, they contain silver iodide in an amount from 0.5 to 10 mol %.

The fine silver halide grains are desired to have a mean grain size (as a mean value of the circle-corresponding diameter of the projected area) from 0.01 to 0.5 μm, more preferably from 0.02 to 0.2 μm.

The fine silver halide grains may be prepared by the same method as that of preparing ordinary light-sensitive silver halide grains. In this case, the surfaces of the fine silver halide grains to be prepared do not need to be optically sensitized and color sensitization of the grains is unnecessary. However, prior to addition of the fine grains to the coating composition, it is desired to previously add a known stabilizer, such as triazole compounds, azaindene compounds, benzothiazolium compounds or, mercapto compound or zinc compounds, to the coating composition. The fine silver halide grains-containing layer may preferably contain colloidal silver.

The amount of silver as coated in the photographic material of the present invention is preferably 6.0 g/m$^2$ or less, most preferably 4.5 g/m$^2$ or less.

Various known photographic additives which may be used in preparing the photographic materials of the present invention are mentioned in the above-described three Research Disclosures, and the related descriptions therein are shown in the following table.

| Kinds of Additives | RD 17643 | RD 18716 | RD 307105 |
|---|---|---|---|
| 1 Chemical Sensitizer | page 23 | page 648, right column | page 866 |
| 2 Sensitivity Enhancer | | page 648, right column | |
| 3 Color Sensitizing Agent | pages 23 to 24 | page 648, right column, to page 649, right column | pages 866 to 868 |
| Super Color Sensitizing Agent | pages 23 to 24 | page 648, right column, to page 649, right column | pages 866 to 868 |
| 4 Brightening Agent | page 24 | | page 868 |
| 5 Anti-foggant | pages 24 to 25 | page 649, right column | pages 868 to 870 |
| Stabilizer | pages 24 to 25 | page 649, right column | pages 868 to 870 |
| 6 Light Absorbent | pages 25 to 26 | page 649, right column to page 650, left column | page 873 |
| Filter Dye | pages 25 to 26 | page 649, right column to page 650, left column | page 873 |
| Ultraviolet Absorbent | pages 25 to 26 | page 649, right column to page 650, left column | page 873 |
| 7 Stain Inhibitor | page 25, right | page 650, left column to | page 872 |

-continued

| Kinds of Additives | RD 17643 | RD 18716 | RD 307105 |
|---|---|---|---|
| | column | right column | |
| 8 Color Image Stabilizer | page 25 | page 650, left column | page 872 |
| 9 Hardening Agent | page 26 | page 651, left column | pages 874 to 875 |
| 10 Binder | page 26 | page 651, left column | page 873 to 875 |
| 11 Plasticizer, Lubricant | page 27 | page 650, right column | page 876 |
| 12 Coating Aid | pages 26 to 27 | page 650, right column | pages 875 to 876 |
| Surfactant | pages 26 to 27 | page 650, right column | pages 875 to 876 |
| 13 Antistatic Agent | page 27 | page 650, right column | pages 876 to 877 |
| 14 Mat Agent | | | pages 878 to 879 |

In order to prevent deterioration of the photographic property of the photographic material of the invention by formaldehyde gas as imparted thereto, compounds capable of reacting with formaldehyde so as to solidify it, for example, those described in U.S. Pat. Nos. 4,411,987 and 4,435,503, are preferably incorporated into the material.

It is preferred to incorporate mercapto compounds described in U.S. Pat. Nos. 4,740,454 and 4,788,132 and JP-A-62-18539 and JP-A-1-283551 into the photographic materials of the present invention.

It is also preferred to incorporate into the photographic materials of the present invention, compounds capable of releasing a foggant, a development accelerator, a silver halide solvent or a precursor thereof, irrespective of the amount of the developed silver as formed by development, which are described in JP-A-1-106052.

It is also preferred to incorporate into the photographic materials of the present invention, dyes as dispersed by the method described in International Patent Laid-Open No. WO88/04794 and JP-W-1-502912, or dyes as described in European Patent 317,308A, U.S. Pat. No. 4,420,555 and JP-A-1-259358.

Various color couplers can be incorporated into the photographic material of the present invention, and examples of usable color couplers are described in patent publications as referred to in the above-described RD No. 17643, VII-C to G, and RD No. 307105, VII-C to G.

As yellow couplers, for example, those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A are preferred.

As magenta couplers, 5-pyrazolone compounds and pyrazoloazole compounds are preferred. For instance, those described in U.S. Pat. Nos. 4,310,619, 3,725,067, European Patent 73,636, U.S. Pat. Nos. 3,061,432, 3,725,067, RD No. 24220 (June, 1984), JP-A-60-33552, RD No. 24230 (June, 1984), JP-A-60-43659, JP-A-61-72238, JP-A-60-35730, JP A-55-118034, JP-A-60-185951, U.S. Pat. Nos. 4,500,630, 4,540,654, 4,556,630, and WO(PCT)88/04795 are preferred.

As cyan couplers, phenol couplers and naphthol couplers are preferred. For instance, those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, German Patent (OLS) No. 3,329,729, European Patents 121,365A, 249,453A, U.S. Pat. Nos. 3,446,622, 4,333,999, 4,753,871, 4,451,559, 4,427,767, 4,690,889, 4,254,212, 4,296,199, and JP-A-61-42658 are preferred. In addition, pyrazoloazole couplers described in JP-A-64-553, JP-A-64-554, JP-A-64-555 and JP-A-64-556 and imidazole couplers as described in U.S. Pat. No. 4,818,672 are also usable.

Polymerized dye-forming couplers may also be used, and typical examples of such couplers are described in U.S. Pat. Nos. 3,451,820, 4,080,211, 4,367,282, 4,409,320, 4,576,910, British Patent 2,102,137 and European Patent 341,188A.

Couplers capable of forming colored dyes having a pertinent diffusibility may also be used, and those described in U.S. Pat. No. 4,366,237, British Patent 2,125,570, European Patent 96,570, and German Patent OLS No. 3,234,533 are preferred.

As colored couplers for correcting the unnecessary absorption of colored dyes, those described in RD No. 17643, VII-G, RD No. 307105, VII-G, U.S. Pat. No. 4,163,670, JP-B-57-39413, U.S. Pat. Nos. 4,004,929, 4,138,258, and British Patent 1,146,368 are preferred. Additionally, couplers correcting the unnecessary absorption of the colored dyed by the phosphor dye to be released during coupling, as described in U.S. Pat. No. 4,774,181, as well as couplers having a dye precursor group capable of reacting with a developing agent to form a dye, as a releasing group, as described in U.S. Pat. No. 4,777,120 are also preferably used.

Couplers capable of releasing a photographically useful residue along with coupling may also be used in the present invention. For instance, as DIR couplers releasing a development inhibitor, those described in the patent publications as referred to in the above-mentioned RD No. 17643, Item VII-F, RD No. 307105, Item VII-F, as well as those described in JP-A-57-151944, 57-154234, 60-184248, 63-37346 and 63 37350 and U.S. Pat. Nos. 4,248,962 and 4,782,012 are preferred.

Couplers releasing a bleaching accelerator, as described in RD Nos. 11449 and 24241 and JP-A-61-201247, are effective for shortening the time for the processing step with a processing solution having a bleaching capacity, and the effect is especially noticeable when they are added to the photographic material of the present invention containing the above-mentioned tabular silver halide grains.

As couplers imagewise releasing a nucleating agent or development accelerator during development, those described in British Patents 2,097,140 and 2,131,188, and JP-A-59-157638 and 59-170840 are preferred. In addition, compounds releasing a foggant, a development accelerator or a silver halide solvent by a redox reaction with an oxidation product of a developing agent, as described in JP-A-60-107029, JP-A-60-252340, JP-A-1-44940 and JP-A-1-45687, are also preferably used.

Additionally, as examples of compounds which may be incorporated into the photographic materials of the present invention, there are further mentioned competing couplers described in U.S. Pat. No. 4,130,427; polyvalent couplers described in U.S. Pat. Nos. 4,283,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and 62-24252; couplers releasing a dye which recolors after releasing from the coupler, as described in European Patents 173,302A and 313,308A; ligand-releasing couplers described in U.S. Pat. No. 4,555,477; leuco dye-releasing couplers described in JP-A-63-75747; and couplers releasing a phosphor dye as described in U.S. Pat. No. 4,774,181.

The above-described couplers can be incorporated into the photographic materials of the present invention by various known dispersion methods.

For instance, an oil-in-water dispersion method may be employed for the purpose. Examples of high boiling point solvents usable in the method are described in U.S. Pat. No. 2,322,027. As examples of high boiling point organic solvents having a boiling point of 175° C. or higher at normal pressure, which are used in an oil-in-water dispersion, there are mentioned phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4 di-tert-amylphenol), aliphatic carboxylates (e.g., bis(2-ethylhexyl) sebacate, dioctyl azelate, glycerol tributylate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene). As an auxiliary solvent, organic solvents having a boiling point of approximately from 30° to 160° C., preferably from 50° to 160° C. can be used. As examples of such auxiliary organic solvents, there are mentioned ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of carrying out the dispersion method, the effect of the method and examples of latexes usable in the method for impregnation are described in U.S. Pat. No. 4,199,363, German Patent (OLS) Nos. 2,541,274 and 2,541,230.

The color photographic material of the present invention preferably contains an antiseptic or fungicide of various kinds, for example, selected from phenethyl alcohol and those described in JP-A-63-257747, 62-272248 and 1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention may apply to various color photographic materials. For instance, there are mentioned, as typical examples, color negative films for general use or for movie use, color reversal films for slide use or for television use, as well as color papers, color positive films and color reversal papers.

Suitable supports which are usable in the present invention are described in, for example, the above-mentioned RD No. 17643, page 28, RD No. 18716, from page 647, right column to page 648, left column, and RD No. 307105, page 897.

It is desired that the total film thickness of all the hydrophilic colloid layers as provided on the surface of the support having emulsion layers is 28 microns or less, preferably 23 microns or less, more preferably 18 microns or less, especially preferably 16 microns or less, in the photographic material of the present invention. It is also desired that the photographic material of the invention has a film swelling rate (T ½) of 30 seconds or less, preferably 20 seconds or less. The film thickness as referred to herein is one as measured under the controlled condition of a temperature of 25° C. and a relative humidity of 55% (for 2 days); and the film swelling rate as referred to herein may be measured by any means known in this technical field. For instance, it may be measured by the use of a swellometer of the model as described in A. Green et al., Photographic Science Engineering, Vol. 19, No. 2, pages 124 to 129. The film swelling rate (T ½) is defined as follows: 90% of the maximum swollen thickness of the photographic material as processed in a color developer under the condition of 30° C. and 3 minutes and 15 seconds is called a saturated swollen thickness. The time necessary for attaining a half (½) of the saturated swollen thickness is defined to be a film swelling rate (T ½).

The film swelling rate (T ½) can be adjusted by adding a hardening agent to the gelatin of a binder or by varying the condition for storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness − original film thickness)/(original film thickness).

It is preferred that the photographic material of the present invention has a hydrophilic colloid layer having a total dry thickness from 2 μm to 20 μm on the side opposite to the side having the emulsion layers. The layer is referred to as a backing layer. It is preferred that the backing layer contains various additives of the above-mentioned light absorbent, filter dye, ultraviolet absorbent, antistatic agent, hardening agent, binder, plasticizer, swelling agent, coating aid and surfactant. The backing layer is desired to have a swelling degree of from 150 to 500%.

The color photographic material of the present invention can be developed by any ordinary method, for example, in accordance with the process described in the above-mentioned RD No. 17643, pages 28 and 29, RD No. 18716, page 615, from left column to right column, and RD No. 307105, pages 880 to 881.

The color developer to be used for development of the photographic material of the present invention is preferably an aqueous alkaline solution consisting essentially of an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfoneamidoethylaniline, 3-methyl-4-amino-N-ethyl-N-β-methoxyethylaniline, as well as sulfates, hydrochlorides and p-toluenesulfonates of the compounds. Above all, 3-methyl-4-amino-N-ethyl-N-β-hydroxyethylaniline sulfate is especially preferred.

These compounds can be used in combination of two or more thereof, in accordance with the object.

The color developer generally contains a pH buffer such as alkali metal carbonates, borates or phosphates, and a development inhibitor or anti foggant such as chlorides bromides, iodides, benzimidazoles, benzothiazoles or mercapto compounds. If desired, it may also contain various preservatives such as hydroxylamine, diethylhydroxylamine, sulfites, hydrazines such as N,N-biscarboxymethylhydrazine, phenylsemicarbazides, triethanolamine, catechol-sulfonic acids; an organic solvent such as ethylene glycol, and diethylene glycol; a development accelerator such as benzyl alcohol, polyethylene glycol, quaternary ammonium salts, and amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. As specific examples of chelating agents which may be incorporated into the color developer, there are mentioned ethylenediamine-tetraacetic acid, nitrilo-triacetic acid, diethylenetriamine-pentaacetic acid, cyclohexanediaminetetraacetic acid, hydroxylethylimino-diacetic acid, 1-hydroxyethylidene-1,1-diphosphonic acid, nitrilo-N,N,N-trimethylene-phosphonic acid, ethylenediamine-N,N,N',N'-tetramethylene-phosphonic acid, ethylenediamine-di(o-hydroxyphenylacetic acid) and their salts.

Where the photographic material is processed for reversal finish, in general, it is first subjected to black-and-white development and then subjected to color development. For the first black-and-white development is used a black-and-white developer, which contains a conventional black-and-white developing agent, for example, dihydroxybenzenes such as hydroquinone, 3-pyrazolidones such as 1-phenyl-3-pyrazolidone, or aminophenols such as N-methyl-p-aminophenol, singly or in combination. The color developer and the black-and-white developer generally has a pH value from 9 to 12. The amount of the replenisher to the developer is, though depending upon the the color photographic material to be processed, generally 3 liters or less per $m^2$ of the material to be processed. It may be reduced to 500 ml or less per $m^2$ of the material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The contact surface area of the processing solution with air in the processing tank is represented by the opening ratio which is defined by the following formula:

Opening Ratio=(Contact Surface Area ($cm^2$) of Processing Solution with Air)/(Volume ($cm^3$) of Processing Tank)

The above-mentioned opening ratio is preferably 0.1 or less, more preferably from 0.001 to 0.05. Various means can be employed for the purpose of reducing the opening ratio, which include, for example, provision for a masking substance such as a floating lid on the surface of the processing solution in the processing tank, employment of the mobile lid described in JP-A-1-82033 and employment of the slit-developing method described in JP-A-63-216050. Reduction of the opening ratio is preferably applied to not only both the steps of color development and black-and-white development but also to all the subsequent steps such as bleaching, bleach-fixing, fixing, rinsing and stabilization steps. In addition, the amount of the replenisher to be added may also be reduced by means of suppressing accumulation of bromide ions in the developer.

The time for color development is generally within the range from 2 minutes to 5 minutes, but the processing time may be shortened by elevating the processing temperature, elevating the pH value of the processing solution and elevating the concentration of the processing solution.

After color development, the photographic emulsion layer is generally bleached Bleaching may be effected simultaneously with fixing (bleach-fixing) or separately therefrom. In order to accelerate the processing speed, a system of bleaching followed by bleach-fixing may also be employed. If desired, a system of using a bleach-fixing bath of continuous two tanks, a system of fixing followed by bleach-fixing, or a system of bleach-fixing followed by bleaching may also be employed, in accordance with the object. As the bleaching agent, for example, compounds of polyvalent metals such as iron(III), as well as peracids, quinones and nitro compounds can be used. Specific examples of the bleaching agent usable in the present invention include organic complexes of iron(III), such as complexes thereof with amino-polycarboxylic acids such as ethylenediaminetetraacetic acid, diethylenetriaminepentaacetic acid, cyclohexanediamine-tetraacetic acid, methyliminodiacetic acid, 1,3-diaminopropane-tetraacetic acid or glycol ether-diamine-tetraacetic acid or with organic acids such as citric acid, tartaric acid or malic acid. Among them, aminopolycarboxylato/iron(III) complexes such as ethylenediaminetetraacetato/iron(III) complex and 1,3-diaminopropane-tetraacetato/iron(III) complex are preferred in view of the rapid processability thereof and of prevention of environmental pollution. The aminopolycarboxylato/iron(III) complexes are especially useful both in a bleaching solution and in a bleach-fixing solution. The bleaching solution or bleach-fixing solution containing such aminopolycarboxylato/iron(III) complexes generally has a pH value from 4.0 to 8.0, but the solution may have a lower pH value for rapid processing.

The bleaching solution, the bleach-fixing solution and the previous bath may contain a bleaching accelerating agent, if desired. Various bleaching accelerating agents are known, and examples of the agents which are advantageously used in the present invention include mercapto group- or disulfide group-containing compounds described in U.S. Pat. No. 3,893,858, German Patents 1,290,812 and 2,059,988, JP-A-53-32736, JP A-53-57831, JP-A-53-37418, JP A 53-72623, JP-A-53-95630, JP-A-53-95631, JP-A-53-104232, JP-A-53-124424, JP-A-53-141623 and JP-A-53-28426, RD No. 17129 (July, 1978); thiazolidine derivatives as described in JP-A-50-140129; thiourea derivatives as described in JP-B-45-8506, JP-A 52-20832 and JP-A-53-32735 and U.S. Pat. No. 3,706,561; iodide salts as described in German Patent 1,127,715 and JP-A-58-16235; polyoxyethylene compounds as described in German Patents 966,410 and 2,748,430; polyamine compounds as described in JP-B-45-8836; other compounds as described in JP-A-49-40943, JP-A-49-59644, JP-A-53-94927, JP-A-54-35727, JP-A-55-26506 and JP-A-58-163940; and bromide ions.

Above all, mercapto group- or disulfide group-containing compounds, in particular, those as described in U.S. Pat. No. 3,893,858, German Patent 1,290,812 and JP-A-53 95630 are preferred, as having a large accelerating effect. In addition, compounds described in U.S. Pat. No. 4,552,834 are also preferred. These bleaching accelerators may be incorporated into the photographic material of the invention. Where the material of the invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for the purpose are those having an acid dissociating constant (pKa) from 2 to 5. For instance, acetic acid and propionic acid are preferably used.

As the fixing agent in the fixing solution or bleach-fixing solution to be applied to the photographic material of the invention, usable are thiosulfates, thiocyanates, thioether compounds, thioureas, and a large amount of iodide salts. Use of thiosulfates is general for the purpose. Above all, ammonium thiosulfate is most widely used. Additionally, a combination of thiosulfates and thiocyanates, thioether compounds or thioureas is also preferred. As the preservative to be used in the fixing solution or bleach-fixing solution, preferred are sulfites, bisulfites and carbonyl-bisulfite adducts, as well as sulfinic acid compounds as described in European Patent 294769A. Further, the fixing solution or bleach-fixing solution may preferably contain various aminopolycarboxylic acids or organic phosphonic acids for the purpose of stabilizing the solution.

It is preferred that the fixing solution of bleach fixing solution to be used for processing the photographic material of the present invention contains compounds having a pKa value of from 6.0 to 9.0, for the purpose of adjusting the pH value of the solution. As such compounds, preferably added are imidazoles such as imidazole, 1-methylimidazole, 1-ethylimidaozle or 2-mehtylimidazole, in an amount of from 0.1 to 10 mol/liter.

The total time for the desilvering process is preferably shorter within the range of not causing desilvering insufficiency. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and generation of stains in the processed material may effectively be prevented.

In the desilvering process, it is desired that stirring of the processing solution during the process is promoted as much as possible. As examples of reinforced stirring means for forcedly stirring the photographic material during the desilvering step, there are mentioned a method of running a jet stream of the processing solution to the emulsion-coated surface of the material, as described in JP-A-62-183460; a method of promoting the stirring effect by the use of a rotating means, as described in JP-A-62-183461; a method of moving the photographic material being processed in the processing bath while the emulsion-coated surface of the material is brought into contact with a wiper blade as provided in the processing bath, whereby the processing solution as applied to the emulsion-coated surface of the material is made turbulent and the stirring effect is promoted; and a method of increasing the total circulating amount of the processing solution. Such reinforced stirring means are effective to any of the bleaching solution, bleach-fixing solution and fixing solution. It is considered that reinforcement of stirring of the processing solution would promote penetration of the bleaching agent and fixing agent into the emulsion layer of the photographic material being processed and, as a result, the desilvering rate in processing the material would be elevated. The above-mentioned reinforced stirring means is more effective, when a bleaching accelerator is incorporated into the processing solution. Because of the means, therefore, the bleaching accelerating effect could remarkably be augmented, and the fixation preventing effect by the bleaching accelerator could be evaded.

The photographic material of the present invention can be processed with an automatic developing machine. It is desired that the automatic developing machine to be used for processing the material of the present invention is equipped with a photographic material-conveying means as described in JP A-60-191257, JP-A-60-191258 and JP-A-60-191259. As is noted from the related disclosure of JP-A-60-191257, the conveying means may noticeably reduce the carry-over amount from the previous bath to the subsequent bath and therefore it is extremely effective for preventing deterioration of the processing solution being used. Because of these reasons, the conveying means is especially effective for shortening the processing time in each processing step and for reducing the amount of the replenisher to each processing bath.

The silver halide color photographic material of the present invention is generally rinsed in water and/or stabilized, after being desilvered. The amount of the water to be used in the rinsing step can be set in a broad range, in accordance with the characteristic of the photographic material being processed (for example, depending upon the raw material components, such as the coupler and so on) or the use of the material, as well as the temperature of the rinsing water, the number of the rinsing tanks (the number of the rinsing stages), the replenishment system of normal current or countercurrent and other various kinds of conditions. Among these conditions, the relation between the number of the rinsing tanks and the amount of the rinsing water in a multi-stage countercurrent rinsing system can be obtained by the method described in *Journal of the Society of Motion Picture and Television Engineers,* Vol. 64, pages 248 to 253 (May, 1955).

According to the multi-stage countercurrent system described in the above-described reference, the amount of the rinsing water to be used can be reduced noticeably, but because of the prolongation of the residence time of the water in the rinsing tank, bacteria would propagate in the tank so that the floating substances generated by the propagation of bacteria would adhere to the surface of the material as it was processed. Accordingly, the above system would often have a problem. In the practice of processing the photographic material of the present invention, the method of reducing calcium and magnesium ions, which is described in JP-A-62-288838, can extremely effectively be used for overcoming this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms,* edited by Association of Sanitary Technique, Japan (1982, by Kogyo Gijutsukai, Japan), and *Encyclopeadia of Bactericidal and Fungicidal Agents,* edited by Nippon Bactericide and Fungicide Association, Japan (1986), can also be used.

The pH value of the rinsing water to be used for processing the photographic material of the present invention is from 4 to 9, preferably from 5 to 8. The temperature of the rinsing water and the rinsing time can also be set variously in accordance with the characteristics of the photographic material being processed as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may also be processed directly with a stabilizing solution in place of being rinsed with water. For the stabilization, any known methods, for example, as described in JP-A 57-8543, JP-A-58-14834 and JP-A-60-220345, can be employed.

In addition, the material can also be stabilized, following the rinsing step. An example thereof is a stabilizing bath containing a dye stabilizer and a surfactant, which is used as a final bath for picture-taking color photographic materials. As examples of dye stabilizers usable for the purpose, there are mentioned aldehydes such as formalin and glutaraldehyde, N-methylol compounds, hexamethylenetetramine and aldehyde-sulfite adducts. The stabilizing bath may also contain various chelating agents and fungicides.

The overflow from the rinsing and/or stabilizing solutions because of addition of replenishers thereto may be re-used in the other steps such as the previous desilvering step.

Where the photographic material of the present invention is processed with an automatic developing machine system and the processing solutions being used in the step are evaporated and thickened, it is desired to add water to the solutions so as to correct the concentration of the solutions.

The silver halide color photographic material of the present invention can contain a color developing agent for the purpose of simplifying and accelerating the processing of the material. For incorporation of a color developing agent into the photographic material, various precursors of the agent are preferably used. For example, there are mentioned indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A 53-135628, as the precursors.

The silver halide color photographic material of the present invention can contain various kinds of 1-phenyl-3-pyrazolidones, if desired, for the purpose of accelerating the color developability thereof. Specific examples of these compounds are described in JP-A-56-64339, JP A-57-144547 and JP-A-58-115438.

The processing solutions for the photographic material of the invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solution used.

The present invention may apply also to heat-developing photographic materials such as those described in U.S. Pat. No. 4,500,626, JP-A 60-133449, JP-A-59-218443, JP-A-61-238056, and European Patent 210,660A2.

Next, the present invention will be explained in more detail by way of the following examples, which, however, are not intended to restrict the scope of the present invention.

EXAMPLE 1

An aqueous solution prepared by dissolving 30 g of inactive gelatin and 6 g of potassium bromide in one liter of distilled water was stirred at 75° C., to which were added 35 cc of an aqueous solution containing 5.0 g of silver nitrate as dissolved therein and 35 cc of an aqueous solution containing 3.2 g of potassium bromide and 0.98 g of potassium iodide as dissolved therein, each at a flow rate of 70 cc/min for 30 minutes. Thereafter, the pAg value of the reaction system was elevated up to 10° C. and then ripened for 30 minutes to prepare a seed emulsion.

Next, a determined amount of one liter of an aqueous solution containing 145 g of silver nitrate as dissolved therein and the same molar amount of an aqueous solution of a mixture of potassium bromide and potassium iodide were added to the seed emulsion at a determined temperature and a determined pAg value and each at an addition speed near to the critical growing speed, to prepare a tabular core emulsion. Subsequently, the remaining amount of the aqueous silver nitrate solution and the same molar amount of an aqueous solution of a mixture of potassium bromide and potassium iodide having a different composition from that of the mixture as added to the step of preparing the core emulsion were added to the core emulsion each at an addition speed near to the critical growing speed, so as to cover the core grains in the emulsion. Accordingly, core/shell type silver iodobromide tabular grain emulsions 1 to 5 were prepared.

Control of the aspect ratio of the tabular grains formed was effected by adequately selecting the pAg value in the step of preparing the core and the step of covering the core with a shell thereover. The results are shown in Table 1 below.

TABLE 1

| Emulsion | Mean Aspect Ratio (1) | Mean Aspect Ratio (2) | Mean Grain Size (μm) | Mean Grain Thickness (μm) | Mean Iodine Content (mol %) |
|---|---|---|---|---|---|
| 1 | 1.5/1 | 1.2/1 | 0.86 | 0.67 | 7.6 |
| 2 | 2.8/1 | 2.2/1 | 1.01 | 0.55 | 7.6 |
| 3 | 4.6/1 | 3.6/1 | 1.63 | 0.36 | 7.6 |
| 4 | 6.7/1 | 5.2/1 | 1.74 | 0.30 | 7.6 |
| 5 | 11.7/1 | 9.8/1 | 2.10 | 0.21 | 7.6 |

Plural layers each having the composition mentioned below were coated on a subbing layer-coated cellulose triacetate support, to prepare a multi-layer color photographic material sample 101.

Compositions of Photographic Layers

The number for each component indicates the amount coated by way of a unit of g/m$^2$. The amount of silver halide coated is represented as the amount of silver coated therein. The amount of sensitizing dye coated is represented by way of a molar unit to mol of silver halide in the same layer.

| Sample 101: | |
|---|---|
| First Layer: Anti-halation Layer | |
| Black Colloidal Silver | 0.18 as Ag |
| Gelatin | 0.50 |
| Second Layer: Interlayer | |
| 2,5-Di-t-pentadecylhydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 0.80 |
| Third Layer: First Red-Sensitive Emulsion Layer | |
| Emulsion A | 0.25 as Ag |
| Emulsion B | 0.25 as Ag |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.020 |
| Gelatin | 0.75 |
| Fourth Layer: Second Red-Sensitive Emulsion Layer | |
| Emulsion G | 0.30 as Ag |
| Emulsion D | 0.50 as Ag |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.20 |
| EX-3 | 0.050 |
| EX-10 | 0.015 |
| EX-14 | 0.20 |
| EX-15 | 0.050 |
| U-1 | 0.020 |
| U-2 | 0.010 |
| U-3 | 0.020 |
| Gelatin | 1.00 |
| Fifth Layer: Third Red-Sensitive Emulsion Layer | |
| Emulsion 1 | 1.60 as Ag |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| Compound (11) | $4.0 \times 10^{-4}$ |
| EX-16 | 0.070 |
| EX-2 | 0.097 |
| EX-3 | 0.010 |
| EX-4 | 0.080 |
| HBS-1 | 0.10 |
| HBS-2 | 0.10 |
| Gelatin | 1.30 |
| Sixth Layer: Interlayer | |
| EX-5 | 0.040 |
| HBS-1 | 0.020 |
| Gelatin | 0.50 |
| Seventh Layer: First Green-Sensitive Emulsion Layer | |
| Emulsion A | 0.15 as Ag |
| Emulsion B | 0.15 as Ag |
| Sensitizing Dye IV | $3.0 \times 10^{-5}$ |
| Sensitizing Dye V | $1.0 \times 10^{-4}$ |
| Sensitizing Dye VI | $3.8 \times 10^{-4}$ |
| EX-1 | 0.021 |
| EX-6 | 0.26 |
| EX-7 | 0.030 |
| EX-8 | 0.050 |
| HBS-1 | 0.10 |
| HBS-3 | 0.010 |

-continued

| Sample 101: | |
|---|---|
| Gelatin | 0.63 |
| Eighth Layer: Second Green-Sensitive Emulsion Layer | |
| Emulsion C | 0.25 as Ag |
| Emulsion E | 0.20 as Ag |
| Sensitizing Dye IV | $2.1 \times 10^{-5}$ |
| Sensitizing Dye V | $7.0 \times 10^{-5}$ |
| Sensitizing Dye VI | $2.6 \times 10^{-4}$ |
| EX-6 | 0.094 |
| EX-7 | 0.026 |
| EX-8 | 0.025 |
| HBS-1 | 0.16 |
| HBS-3 | $8.0 \times 10^{-3}$ |
| Gelatin | 0.50 |
| Ninth Layer: Third Green-Sensitive Emulsion Layer | |
| Emulsion 1 | 1.00 as Ag |
| Sensitizing Dye IV | $3.5 \times 10^{-5}$ |
| Sensitizing Dye V | $8.0 \times 10^{-5}$ |
| Sensitizing Dye VI | $3.0 \times 10^{-4}$ |
| EX-1 | 0.013 |
| EX-11 | 0.065 |
| EX-13 | 0.019 |
| HBS-1 | 0.05 |
| HBS-2 | 0.10 |
| Gelatin | 1.00 |
| Tenth Layer: Yellow Filter Layer | |
| Yellow Colloidal Silver | 0.050 as Ag |
| EX-5 | 0.080 |
| HBS-1 | 0.030 |
| Gelatin | 0.50 |
| Eleventh Layer: First Blue-Sensitive Emulsion Layer | |
| Emulsion A | 0.080 as Ag |
| Emulsion B | 0.070 as Ag |
| Emulsion F | 0.070 as Ag |
| Sensitizing Dye VII | $3.5 \times 10^{-4}$ |
| EX-8 | 0.085 |
| EX-9 | 0.72 |
| HBS-1 | 0.20 |
| Gelatin | 1.10 |
| Twelfth Layer: Second Blue-Sensitive Emulsion Layer | |
| Emulsion 1 | 0.45 as Ag |
| Sensitizing Dye VII | $2.1 \times 10^{-4}$ |
| EX-8 | 0.050 |
| EX-9 | 0.15 |
| EX-10 | $7.0 \times 10^{-3}$ |
| HBS-1 | 0.050 |
| Gelatin | 0.78 |
| Thirteenth Layer: Third Blue-Sensitive Emulsion Layer | |
| Emulsion H | 0.50 as Ag |
| Emulsion G | 0.20 as Ag |
| Sensitizing Dye VII | $2.2 \times 10^{-4}$ |
| Compound (18) | $3.0 \times 10^{-4}$ |
| EX-9 | 0.20 |
| HBS-1 | 0.070 |
| Gelatin | 0.69 |
| Fourteenth Layer: First Protective Layer | |
| Emulsion I | 0.20 as Ag |
| U-4 | 0.11 |
| U-5 | 0.17 |
| HBS-1 | $5.0 \times 10^{-2}$ |
| Gelatin | 1.00 |
| Fifteenth Layer: Second Protective Layer | |
| H-1 | 0.40 |
| B-1 (diamater 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

In addition, all the layers contained W-1, W-2, W-3, B-4, B-5, F-1, F-2, F-3, F-4, F-5, F-6, F-7, F-8, F-9, F-10, F-11, F-12, F-13, and iron salt, lead salt, gold salt, platinum salt, iridium salt and rhodium salt, so as to have improved storability, processability, pressure resistance, fungicidal and bactericidal property, antistatic property and coatability.
Structural formulae of the compounds used as well as emulsions used are shown below.
EX-1
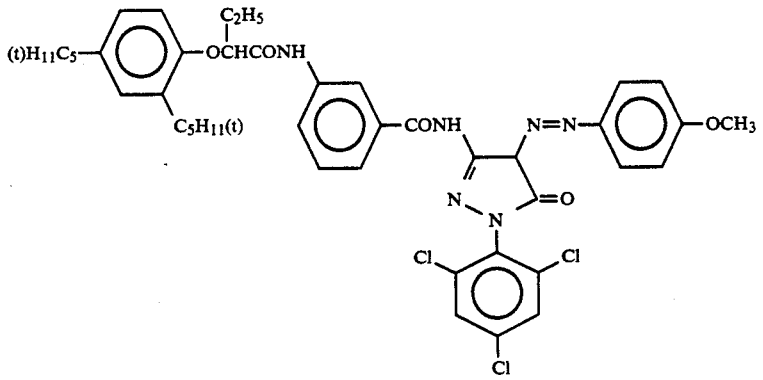
EX-2
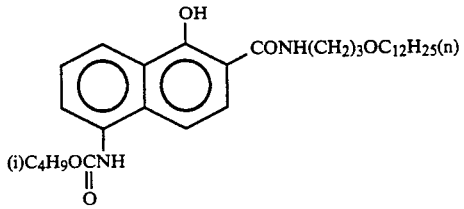
EX-3
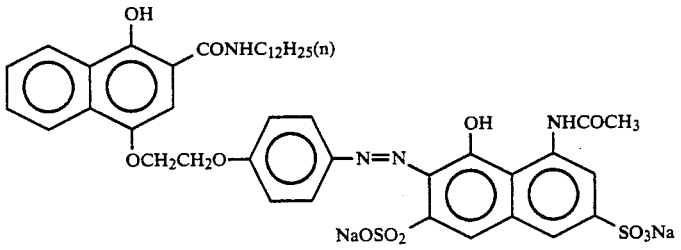
EX-4
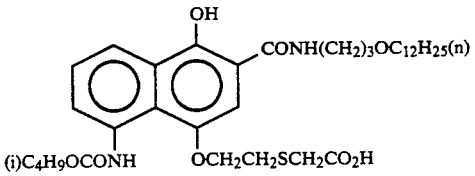
EX-5
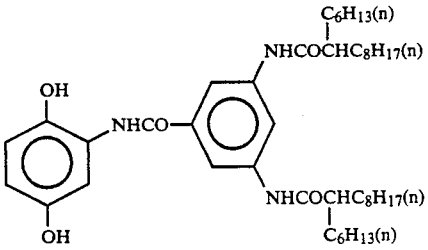
EX-6

-continued
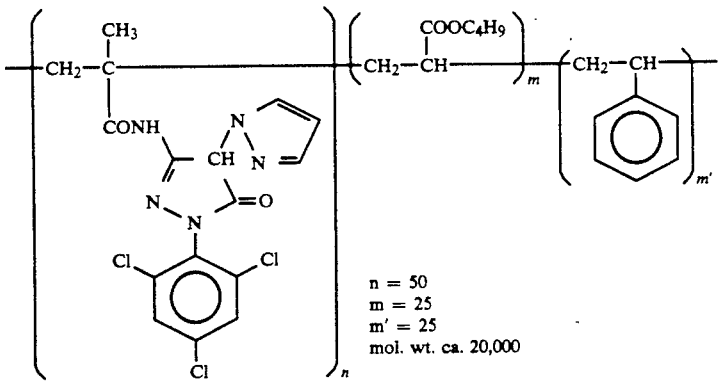
EX-7
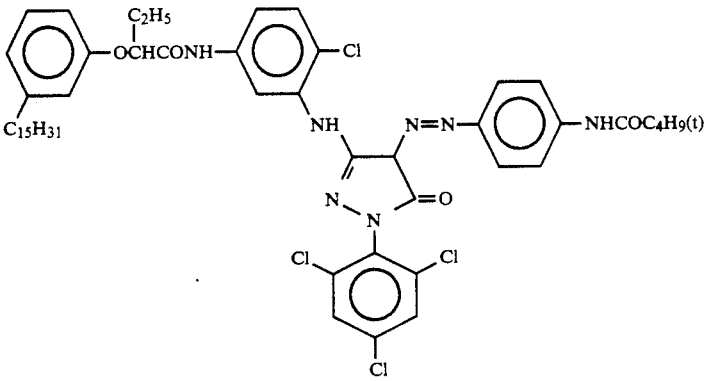
EX-8
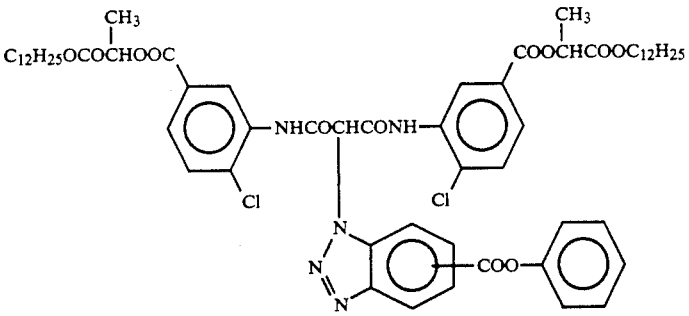
EX-9
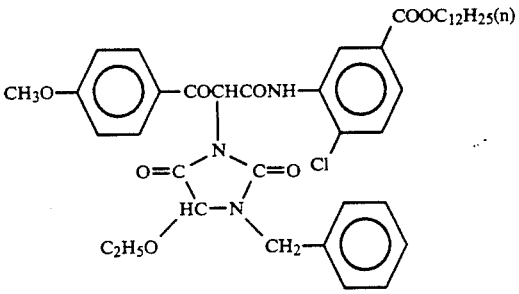
EX-10

-continued
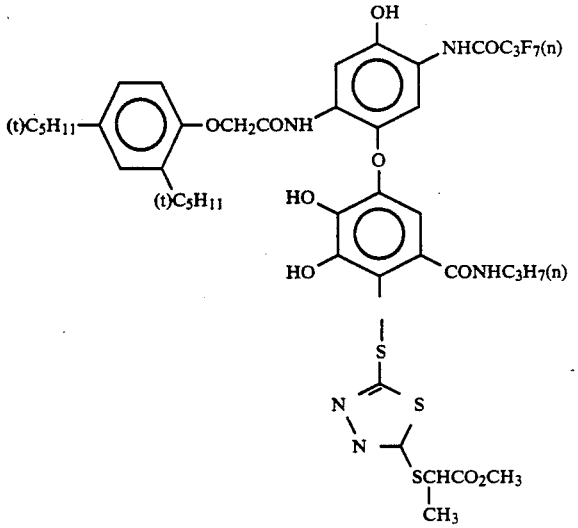
EX-11
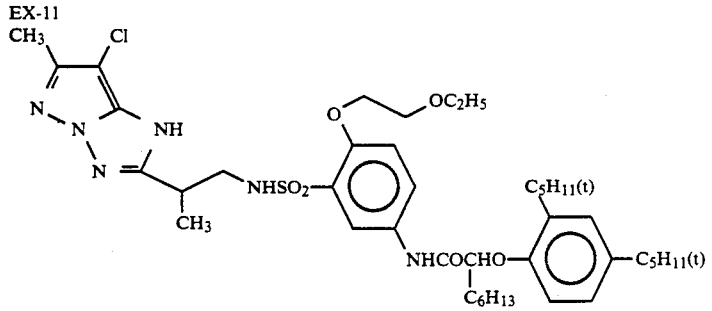
EX-12
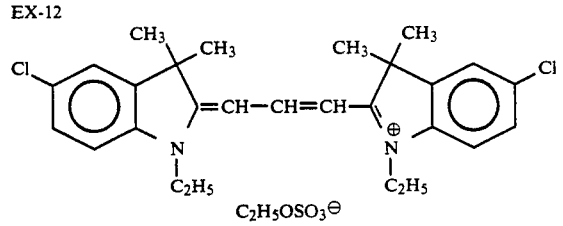
EX-13
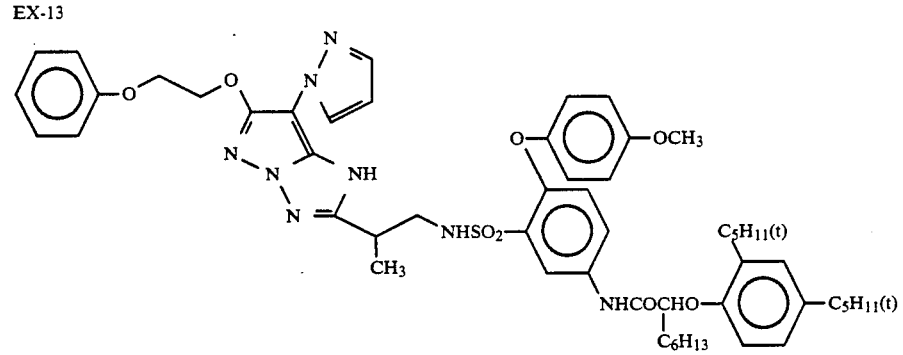
EX-14
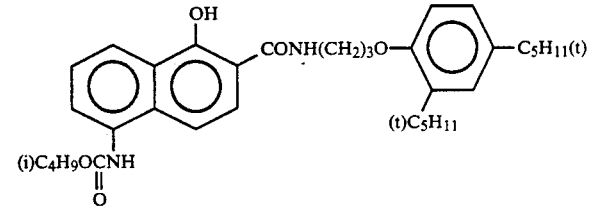

-continued
EX-15
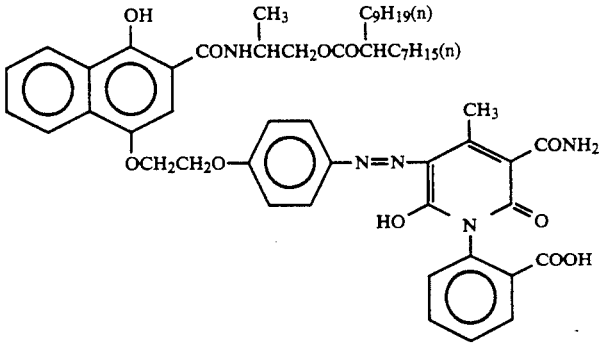
EX-16
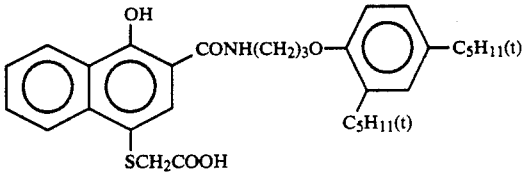
U-1
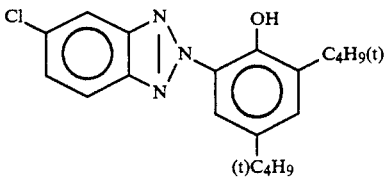
U-2
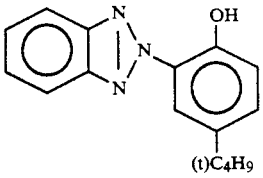
U-3
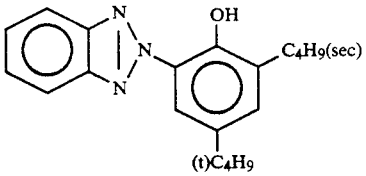
U-4
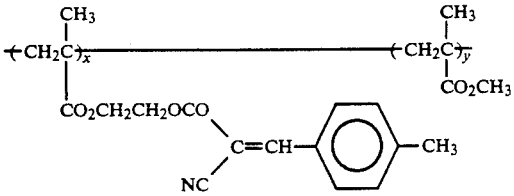
x:y = 70:30 (wt %)
U-5
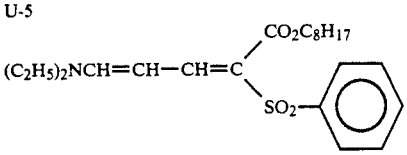

-continued
HBS-1 Tricresyl Phosphate
HBS-2 Di-n-butyl Phthalate
HBS-3
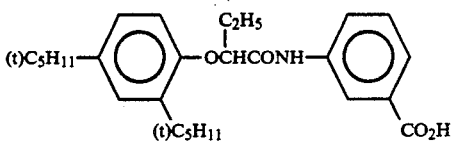
Sensitizing Dye I
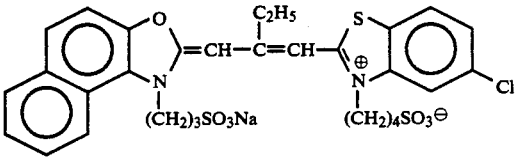
Sensitizing Dye II
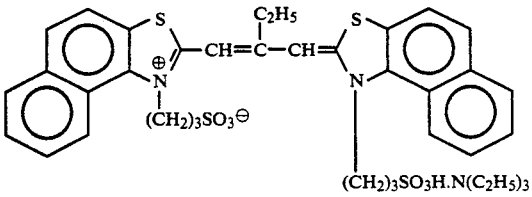
Sensitizing Dye III
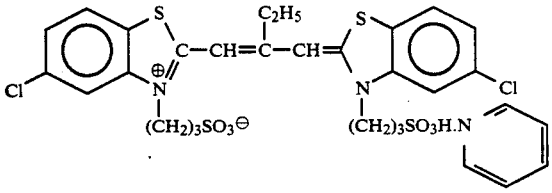
Sensitizing Dye IV
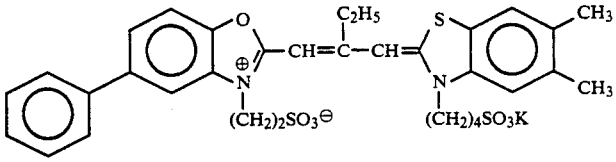
Sensitizing Dye V
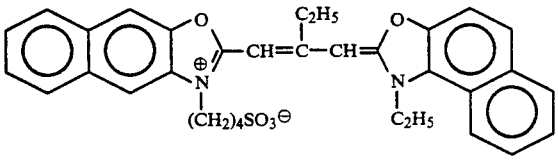
Sensitizing VI
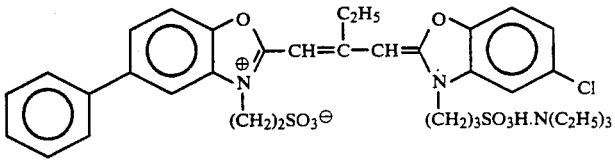
Sensitizing VII -continued
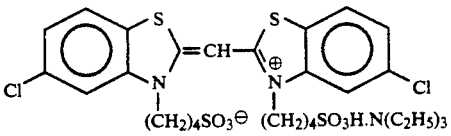
S-1
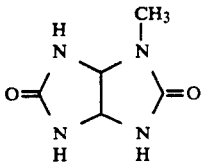
H-1
$CH_2{=}CH{-}SO_2{-}CH_2{-}CONH{-}CH_2$
$CH_2{=}CH{-}SO_2{-}CH_2{-}CONH{-}CH_2$
B-1
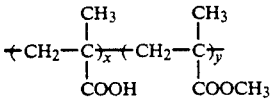
x/y = 10/90
B-2
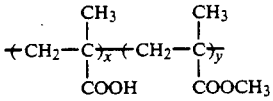
x/y = 40/60
B-3
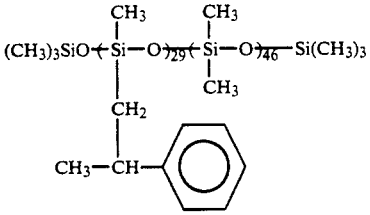
B-4
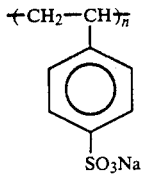
B-5
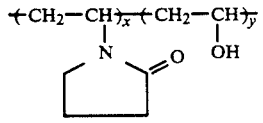
x/y = 70/30
W-1
$C_8F_{17}SO_2NHCH_2CH_2CH_2OCH_2CH_2\overset{\oplus}{N}(CH_3)_3$
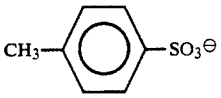
W-2
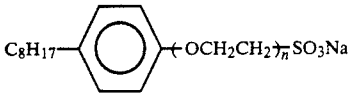
n = 2 ~ 4

-continued
W-3
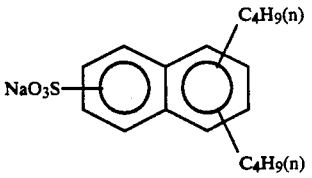
F-1
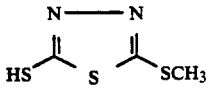
F-2
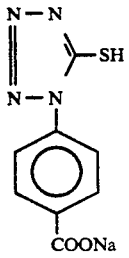
F-3
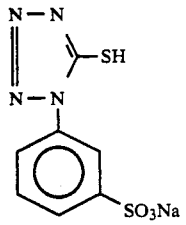
F-4
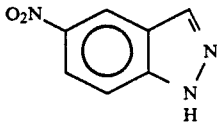
F-5
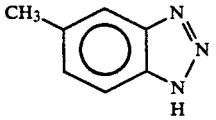
F-6
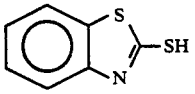
F-7
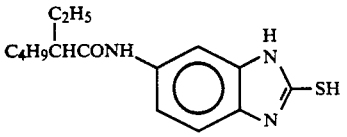
F-8

-continued
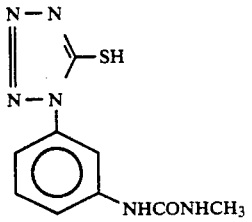
F-9
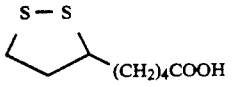
F-10
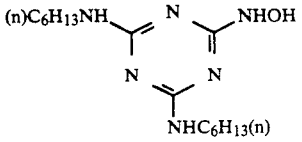
F-11
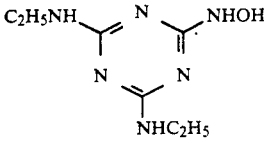
F-12
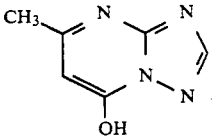
F-13
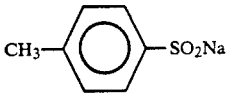
C-1 (Coupler (16) disclosed in U.S. Pat. No. 4,477,563)
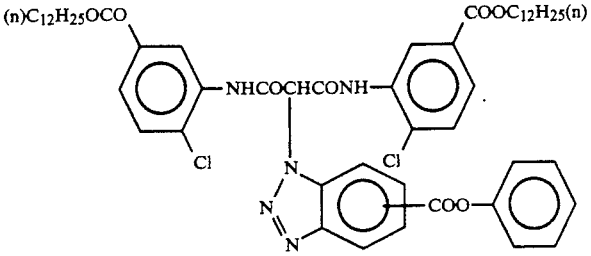
C-2 (Coupler similar to Coupler (40) disclosed in U.S. Pat. No. 3,632,345)

-continued

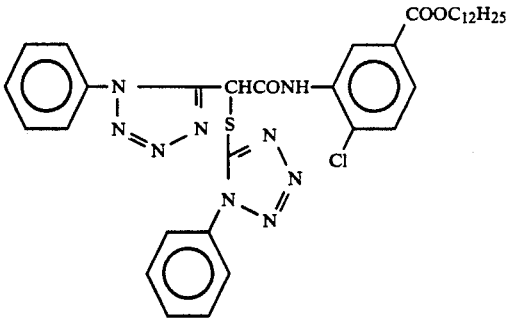

C-3 (Coupler of JP-A-63-261262)

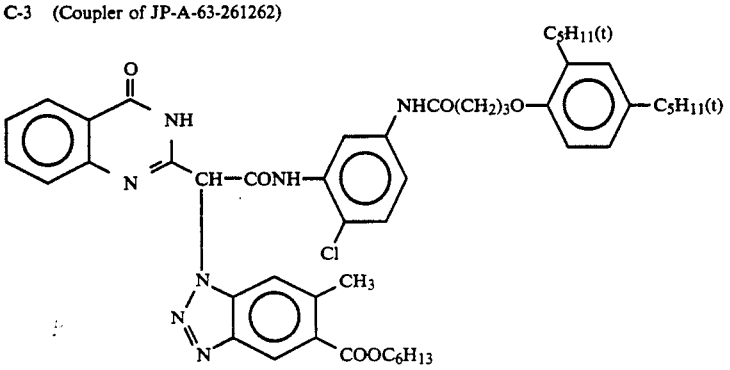

C-4 (Coupler of JP-A-2-28645)

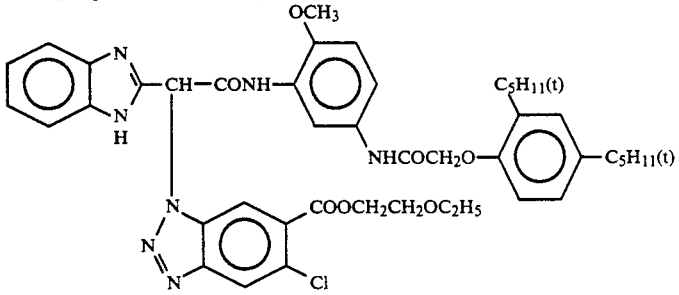

C-5 (Coupler of JP-A-2-2552)

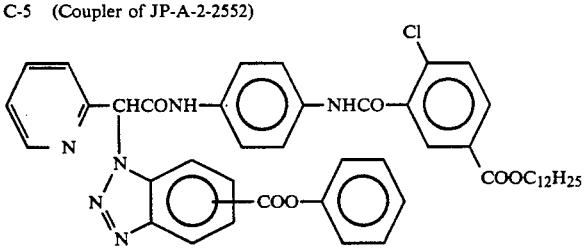

TABLE 2

| | Mean AgI Content (%) | Mean Grain Size (μm) | Fluctuation Coefficient to Grain Size (%) | Ratio of Diameter/ Thickness | Ratio of Silver Contents (as AgI content %) |
|---|---|---|---|---|---|
| Emulsion A | 4.0 | 0.45 | 27 | 1 | core/shell = 1/3 (13/1), two-layer structure grains |
| Emulsion B | 8.9 | 0.70 | 14 | 1 | core/shell = 3/7 (25/2), two-layer structure grains |
| Emulsion C | 10 | 0.75 | 17 | 1 | core/shell = 1/2 (24/3), two-layer structure grains |
| Emulsion D | 16 | 0.95 | 22 | 1 | core/shell = 4/6 (40/0), two-layer structure grains |
| Emulsion E | 10 | 0.95 | 18 | 1 | core/shell = 1/2 (24/3), two-layer structure grains |
| Emulsion F | 4.0 | 0.25 | 28 | 1 | core/shell = 1/3 (13/1), two-layer structure grains |
| Emulsion G | 14.0 | 0.75 | 17 | 1 | core/shell = 1/2 (42/0), two-layer structure grains |
| Emulsion H | 14.5 | 1.20 | 18 | 1 | core/shell = 37/63 (34/3), two-layer structure grains |
| Emulsion I | 1 | 0.07 | 15 | 1 | uniform grains |

Samples 102 to 105

Samples 102 to 105 were prepared in the same manner as in preparation of sample 101, except that emulsion 1 in the fifth layer, ninth layer and twelfth layer was replaced by one of emulsions 2 to 5, respectively.

Samples 106 to 120

Samples 106 to 120 were prepared in the same manner as in preparation of samples 101 to 105, except that EX-8 in the seventh layer, eighth layer, eleventh layer and twelfth layer was replaced by the same molar amount of a comparative coupler (C-1), the same molar amount of coupler (2) of the present invention, or 1.2 molar times of coupler (4) of the present invention, respectively.

Samples 121 to 128

Samples 121 to 128 were prepared in the same manner as above, except that the amounts of the emulsions and couplers in the respective layers were varied to such that all the samples could have almost the same gradation as indicated in Table 3 below.

Samples 129 and 130

Samples 129 and 130 were prepared in the same manner as in preparation of samples 111 and 113, respectively, except that compounds (11) and (18) were not added.

All these samples were imagewise exposed to white light and then processed for color development in accordance with the process mentioned below. In addition, after they were imagewise exposed to white light in the same way, they were stored under the condition of a temperature of 40° C. and a relative humidity of 40% for 14 days and then processed in the same way. Variation of the relative sensitivity of each sample before and after the storage was shown in Table 3 below. The photographic properties as obtained by examining the processed samples are also shown in Table 3 along with RMS value (value of yellow image measured with 48 μm diameter aperture) to indicate the graininess. Regarding the sharpness, MTF value of the magenta image of each of the processed samples was measured by an ordinary MTF method. These samples were uniformly exposed to green light with an exposure amount of one lux.sec., then imagewise exposed to blue light, and thereafter color-developed in the manner mentioned below. The color turbidity of each sample was obtained by subtracting the magenta density at the yellow fog density from the magenta density at an exposure amount giving a yellow density of (fog+1.0). The result obtained was also shown in Table 3.

In addition, the processed samples were exposed to a fluorescent lamp of 20,000 lux, and the change in the yellow density for each of the irradiated samples at the point having a yellow density of 2.5 before irradiation was measured. The result was also shown in Table 3.

TABLE 3

| Sample | Emulsion in 5th, 9th and 12th layers | Coupler in 7th, 8th, 11th and 12th layers | Compounds in 5th and 13th layers | Relative Sensitivity (1) | RMS Value × 1000 (2) | MTF Value of Magenta Image (25 cycle/mm) | Color Turbidity | Decrement of Density under Light Irradiation | Fluctuation of Relative Sensitivity |
|---|---|---|---|---|---|---|---|---|---|
| 101 (comparative tive sample) | 1 | EX-8 | (11)/(18) | 0.00 | 31.7 | 0.61 | −0.02 | 0.18 | 0.07 |
| 102 (comparative sample) | 2 | EX-8 | (11)/(18) | 0.00 | 30.8 | 0.63 | 0.00 | 0.18 | 0.04 |
| 103 (comparative sample) | 3 | EX-8 | (11)/(18) | 0.01 | 30.3 | 0.65 | 0.01 | 0.18 | 0.04 |
| 104 (comparative sample) | 4 | EX-8 | (11)/(18) | 0.02 | 30.3 | 0.65 | 0.01 | 0.18 | 0.03 |
| 105 (comparative sample) | 5 | EX-8 | (11)/(18) | 0.03 | 30.2 | 0.65 | 0.02 | 0.18 | 0.02 |
| 106 (comparative sample) | 1 | C-1 | (11)/(18) | 0.01 | 31.9 | 0.60 | −0.02 | 0.18 | 0.08 |
| 107 (comparative sample) | 2 | C-1 | (11)/(18) | 0.01 | 31.0 | 0.62 | 0.00 | 0.17 | 0.05 |
| 108 (comparative sample) | 3 | C-1 | (11)/(18) | 0.02 | 30.5 | 0.64 | 0.01 | 0.18 | 0.04 |
| 109 (comparative sample) | 4 | C-1 | (11)/(18) | 0.03 | 30.4 | 0.64 | 0.01 | 0.17 | 0.03 |
| 110 (comparative sample) | 5 | C-1 | (11)/(18) | 0.04 | 30.3 | 0.64 | 0.02 | 0.18 | 0.03 |
| 111 (comparative sample) | 1 | (2) | (11)/(18) | 0.01 | 31.4 | 0.62 | −0.04 | 0.04 | 0.04 |
| 112 (sample of the invention) | 2 | (2) | (11)/(18) | 0.01 | 30.5 | 0.64 | −0.02 | 0.04 | 0.02 |
| 113 (sample of the invention) | 3 | (2) | (11)/(18) | 0.02 | 29.9 | 0.66 | −0.01 | 0.04 | 0.02 |
| 114 (sample of the invention) | 4 | (2) | (11)/(18) | 0.03 | 29.8 | 0.66 | −0.01 | 0.04 | 0.01 |

TABLE 3-continued

| Sample | Emulsion in 5th, 9th and 12th layers | Coupler in 7th, 8th, 11th and 12th layers | Compounds in 5th and 13th layers | Relative Sensitivity (1) | RMS Value × 1000 (2) | MTF Value of Magenta Image (25 cycle/mm) | Color Turbidity | Decrement of Density under Light Irradiation | Fluctuation of Relative Sensitivity |
|---|---|---|---|---|---|---|---|---|---|
| 115 (sample of the invention) | 5 | (2) | (11)/(18) | 0.04 | 39.7 | 0.66 | −0.01 | 0.04 | 0.00 |
| 116 (comparative sample) | 1 | (4) | (11)/(18) | 0.01 | 31.4 | 0.61 | −0.04 | 0.04 | 0.05 |
| 117 (sample of the invention) | 2 | (4) | (11)/(18) | 0.01 | 30.5 | 0.63 | −0.02 | 0.04 | 0.02 |
| 118 (sample of the invention) | 3 | (4) | (11)/(18) | 0.02 | 29.9 | 0.65 | −0.01 | 0.04 | 0.02 |
| 119 (sample of the invention) | 4 | (4) | (11)/(18) | 0.03 | 29.8 | 0.65 | −0.01 | 0.04 | 0.02 |
| 120 (sample of the invention) | 5 | (4) | (11)/(18) | 0.04 | 29.8 | 0.65 | 0.00 | 0.04 | 0.01 |
| 121 (comparative sample) | 2 | C-2 | (11)/(18) | 0.01 | 29.5 | 0.57 | 0.06 | 0.15 | −0.04 |
| 122 (comparative sample) | 2 | C-3 | (11)/(18) | 0.00 | 29.8 | 0.59 | 0.03 | 0.12 | −0.01 |
| 123 (comparative sample) | 2 | C-4 | (11)/(18) | 0.00 | 30.2 | 0.61 | 0.01 | 0.12 | −0.04 |
| 124 (comparative sample) | 2 | C-5 | (11)/(18) | 0.00 | 30.2 | 0.61 | 0.01 | 0.13 | 0.02 |
| 125 (sample of the invention) | 3 | (6) | (11)/(18) | 0.01 | 30.7 | 0.65 | −0.01 | 0.05 | 0.01 |
| 126 (sample of the invention) | 3 | (7) | (11)/(18) | 0.01 | 30.1 | 0.65 | −0.01 | 0.05 | 0.01 |
| 127 (sample of the invention) | 3 | (11) | (11)/(18) | 0.01 | 30.2 | 0.66 | −0.01 | 0.05 | 0.00 |
| 128 (sample of the invention) | 3 | (12) | (11)/(18) | 0.01 | 30.3 | 0.65 | −0.02 | 0.05 | 0.01 |
| 129 (comparative sample) | 1 | (2) | — | 0.01 | 31.7 | 0.66 | −0.04 | 0.04 | 0.06 |
| 130 (sample of the invention) | 3 | (2) | — | 0.00 | 30.4 | 0.66 | −0.01 | 0.04 | 0.03 |

(1) Relative value of a logarithmic number of a reciprocal of the exposure amount for giving yellow density (fog + 0.5)
(2) RMS value at yellow density (fog + 0.5)

Color development of the above-mentioned samples was effected in accordance with the process mentioned below, using an automatic developing machine, until the cumulative amount of the replenisher added became three times that of the mother liquid tank capacity.

Color Development Process

| Step | Processing Time | Processing Temperature | Amount of Replenisher (*) | Tank Capacity |
|---|---|---|---|---|
| Color Development | 3 min 15 sec | 38° C. | 33 ml | 20 liters |
| Bleaching | 6 min 30 sec | 38° C. | 25 ml | 40 liters |
| Rinsing in Water | 2 min 10 sec | 24° C. | 1200 ml | 20 liters |
| Fixing | 4 min 20 sec | 38° C. | 25 ml | 30 liters |
| Rinsing in Water (1) | 1 min 05 sec | 24° C. | Counter-current cascade system from (2) to (1) | 10 liters |
| Rinsing in Water (2) | 1 min 00 sec | 24° C. | 1200 ml | 10 liters |
| Stabilization | 1 min 05 sec | 38° C. | 25 ml | 10 liters |
| Drying | 4 min 20 sec | 55° C. | | |

(*) Amount per meter of 35 mm-wide sample

Compositions of the processing solutions used in the process are mentioned below.

| | Mother Liquid (g) | Replenisher (g) |
|---|---|---|
| Color Developer: | | |
| Diethylenetriamine-pentaacetic Acid | 1.0 | 1.1 |
| 1-Hydroxyethyliene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-[N-ethyl-N-β-hydroxyethylamino]-2-methylaniline Sulfate | 4.5 | 5.5 |
| Water to make | 1.0 liter | 1.0 liter |
| pH | 10.05 | 10.10 |
| Bleaching Solution: | | |
| Sodium Ethylenediaminetetraacetato/Iron(III) Trihydrate | 100.0 | 120.0 |
| Disodium Ethylenediaminetetraacetate | 10.0 | 10.0 |
| Ammonium Bromide | 140.0 | 160.0 |
| Ammonium Nitrate | 30.0 | 35.0 |
| Aqueous Ammonia (27%) | 6.5 ml | 4.0 ml |
| Water to make | 1.0 liter | 1.0 liter |
| pH | 6.0 | 5.7 |
| Fixing Solution: | | |
| Disodium Ethylenediaminetetraacetate | 0.5 | 0.7 |
| Sodium Sulfite | 7.0 | 8.0 |
| Sodium Bisulfite | 5.0 | 5.5 |
| Ammonium Thiosulfate (70% aqueous solution) | 170.0 ml | 200.0 ml |
| Water to make | 1.0 liter | 1.0 liter |
| pH | 6.7 | 6.6 |
| Stabilizing Solution: | | |
| Formalin (37%) | 2.0 ml | 3.0 ml |
| Polyoxyethylene-p-monononylphenyl Ether (mean polymerization degree 10) | 0.3 | 0.45 |
| Disodium Ethylenediaminetetraacetate | 0.05 | 0.08 |
| Water to make | 1.0 liter | 1.0 liter |
| pH | 5.0 to 8.0 | 5.0 to 8.0 |

From the results in Table 3 above, it is understood that the samples of the present invention have a high sensitivity and excellent graininess, sharpness and color reproducibility. In addition, it is also noted that there are free from fluctuation of the photographic properties during the period between exposure and development and they have an excellent color image storability. Further, it is noted that addition of compound (11) and compound (18) of formula (A) to the samples causes further improvement of the photographic properties (especially, graininess and sensitivity).

EXAMPLE 2

Emulsion 6 (Embodiment of the Invention)

To one liter of 0.7 wt. % gelatin solution containing 0.04M potassium bromide, were simultaneously added 25 cc of aqueous 2M silver nitrate solution containing gelatin and 25 cc of aqueous 2M potassium bromide solution containing gelatin, at 30° C. while vigorously stirring over a period of one minute. Then, the whole was heated up to 75° C., and 300 cc of 10 wt. % gelatin solution was added thereto. Next, 30 cc of aqueous 1M silver nitrate solution was added thereto over a period of 5 minutes, and thereafter 10 cc of 25 wt. % aqueous ammonia was added thereto. This was then ripened at 75° C. After ripening, ammonia in the reaction system was neutralized, and aqueous 1M silver nitrate solution and aqueous 1M potassium bromide solution were simultaneously added to and blended with the reaction system both at such an accelerated flow rate that the flow rate at the finish was 5 times that at the start while maintaining the pBr value of the system to be 2.3. The total amount of the aqueous silver nitrate solution added was 600 cc. The thus formed emulsion was washed with water by an ordinary flocculation method, and a dispersed gelatin was added thereto to obtain 800 g of a hexagonal tabular silver halide emulsion (seed emulsion A). The seed emulsion A contained monodispersed hexagonal tabular grains having a mean projected area circle corresponding diameter (grain size) of 1.0 μm, a mean thickness of 0.18 μm and a fluctuation coefficient of 11%. Next, 250 g of the seed emulsion A was taken out, and 800 cc of distilled water, 30 g of gelatin and 6.5 g of potassium were added thereto and then heated up to 75° C. With stirring, aqueous 1M silver nitrate solution and aqueous 1M alkali halide solution (containing a mixture of 90 mol % of potassium bromide and 10 mol % of potassium iodide) were simultaneously added thereto both at such an accelerated flow rate that the flow rate at the finish was 3 times that at the start, whereupon the pBr value of the system was maintained to be 1.6. The total amount of the aqueous silver nitrate solution added was 600 cc. Further, aqueous 1M silver nitrate solution and aqueous 1M potassium bromide solution were simultaneously added to the reaction system both at such an accelerated flow rate that the flow rate at the finish was 1.5 times that at the start, while maintaining the pBr value of the system to be 1.6. The total amount of the aqueous silver nitrate solution added was 200 cc.

The emulsion thus prepared was washed with water in the same manner as above, and a dispersed gelatin was added thereto to obtain a monodispersed hexagonal tabular silver halide emulsion (emulsion 6). The emulsion 6 thus obtained contained 92%, to the total projected area, of hexagonal tabular grains, and the hexagonal tabular grains had a mean grain size of 1.75 μm, a mean thickness of 0.29 μm, a mean aspect ratio of 6/1 and a fluctuation coefficient of 16%.

Emulsion 7 (Embodiment of the Invention)

Seed emulsion B was prepared in the same manner as in preparation of emulsion 6, except that the amount of the aqueous 1M silver nitrate solution as added at the second time was varied to 20 cc and the amount of the aqueous ammonia was changed to 8 cc. Next, the seed emulsion B was grown in the same manner as in preparation of emulsion 6 to prepare emulsion 7, provided that the pBr value in the growing system was kept to be 1.5. The emulsion 7 thus obtained contained 90%, to the total projected area, of hexagonal tabular grains, and the hexagonal tabular grains therein had a mean grain size of 2.1 μm, a mean thickness of 0.21 μm, a mean aspect ratio of 10/1 and a fluctuation coefficient of 19%.

Emulsion 8 (Embodiment of the Invention)

Seed emulsion C was prepared in the same manner as in preparation of emulsion 6, except that the amount of the aqueous 1M silver nitrate solution as added at the second time was varied from 30 cc to 10 cc while no aqueous ammonia was added and that the pBr value of the reaction system in the third reaction was varied from 2.3 to 1.7. Next, the seed emulsion C was grown in the same manner as in preparation of emulsion 6 to prepare emulsion 8. The emulsion 8 thus obtained contained 62%, to the total projected area, of hexagonal tabular grains, and the hexagonal tabular grains therein had a mean grain size of 2.0 μm, a mean thickness of 0.17 μm, a mean aspect ratio of 12/1 and a fluctuation coefficient of 37%.

To each of emulsions 6, 7, 8 and 1, was added a mixture of sensitizing dyes I, IV, V and VI (0.2/0.1/0.3, by mol) in an amount of 70% of the saturated adsorption amount to each emulsion. They were then kept at 60° C. for 20 minutes and thereafter subjected to optimum chemical sensitization with sodium thiosulfate, chloroauric acid and potassium thiocyanate added thereto, at 60° C. and pH of 6.5. Accordingly, emulsion 6-1, emulsion 7-1, emulsion 8-1 and emulsion 1-1 as shown in Table 4 below were prepared.

TABLE 4

| Emulsion | Mean Aspect Ratio (1) | Mean Aspect Ratio (2) | Mean Aspect Ratio (3) | Mean Grain Diameter (μm) | Mean Grain Thickness (μm) | Fluctuation Coefficient of Grain Diameter | Proportion of Hexagonal Tabular Grains (%) (4) | Relative Standard Deviation (%) of Intra-granular AgI Content |
|---|---|---|---|---|---|---|---|---|
| 6-1 | 4.9/1 | 7.2/1 | 6.0/1 | 1.75 | 0.29 | 0.15 | 92 | 13 |
| 7-1 | 13/1 | 11/1 | 10/1 | 2.10 | 0.21 | 0.19 | 90 | 16 |
| 8-1 | 21/1 | 17/1 | 12/1 | 2.00 | 0.17 | 0.37 | 62 | 24 |
| 1-1 | 1.5/1 | 1.2/1 | 1.1/1 | 0.86 | 0.67 | 0.25 | 10 | 22 |

(1) (2): Refer to Table 1.
(3): Mean value of all grains.
(4): Proportion of the projected area of hexagonal tabular grains to the total projected area of all emulsion grains.
(5): Measured on the basis of the standard as defined in JP-A-60-143332.

Samples 201 to 204

Samples 201 to 204 were prepared in the same manner as in preparation of sample 101, except that emulsion 1 in the ninth layer was replaced by emulsion 6-1, 7-1, 8-1 and 1-1, respectively, and that 0.010 g/m2 of EX-8 was added to the ninth layer without adding sensitizing dyes IV, V, and VI thereto.

Samples 205 to 212

Samples 205 to 212 were prepared in the same manner as in preparation of samples 201 to 204, respectively, except that EX-8 in the seventh, eighth, ninth, eleventh and twelfth layers was replaced by coupler (2) and coupler (42) of the present invention.

Samples 213 and 214

Samples 213 and 214 were prepared in the same manner as in preparation of sample 209, except that emulsion 6-1 in the ninth layer was replaced by a mixture with another emulsion as indicated in Table 5 below.

The relative sensitivity, RMS value and MTF value of the magenta image of each of these samples were obtained in the same manner as in Example 1. Development of the samples was effected by the process mentioned below.

Color Development Process

| Step | Processing Time | Processing Temperature | Amount of Replenisher (*) | Tank Capacity |
|---|---|---|---|---|
| Color Development | 3 min 15 sec | 37.8° C. | 25 ml | 10 liters |
| Bleaching | 45 sec | 38° C. | 5 ml | 4 liters |
| Bleach-Fixing (1) | 45 sec | 38° C. | — | 4 liters |
| Bleach-Fixing (2) | 45 sec | 38° C. | 30 ml | 4 liters |
| Rinsing in | 20 sec | 38° C. | — | 2 liters |

-continued

Color Development Process

| Step | Processing Time | Processing Temperature | Amount of Replenisher (*) | Tank Capacity |
|---|---|---|---|---|
| Water (1) Rinsing in | 20 sec | 38° C. | 30 ml | 2 liters |
| Water (2) Stabilization | 20 sec | 38° C. | 20 ml | 2 liters |
| Drying | 1 min | 55° C. | | |

(*): Amount per meter of 35 mm-wide sample

Bleach-fixing and rinsing were effected each by a countercurrent cascade system from (2) to (1). All the overflow from the bleaching bath was introduced into the bleach-fixing bath (2).

The amount of carryover of the bleach-fixing solution to the rinsing step was 2 ml per meter of 35 mm-wide sample being processed.

Compositions of the processing solutions used above are mentioned below.

| | Mother Liquid (g) | Replenisher (g) |
|---|---|---|
| Color Developer: | | |
| Diethylenetriaminepenta-acetic Acid | 5.0 | 6.0 |
| Sodium Sulfite | 4.0 | 5.0 |
| Potassium Carbonate | 30.0 | 37.0 |
| Potassium Bromide | 1.3 | 0.5 |
| Potassium Iodide | 1.2 mg | — |
| Hydroxylamine Sulfate | 2.0 | 3.6 |
| 4-[N-ethyl-N-β-hydroxy-ethylamino]-2-methylaniline Sulfate | 4.7 | 6.2 |
| Water to make | 1.0 liter | 1.0 liter |
| pH | 10.00 | 10.15 |
| Bleaching Solution: | | |
| Ammonium 1,3-Diamino-propanetetraacetato/ Iron(III) Monohydrate | 144.0 | 206.0 |
| 1,3-Diaminopropanetetra-acetic Acid | 2.8 | 4.0 |
| Ammonium Bromide | 34.0 | 120.0 |
| Ammonium Nitrate | 17.5 | 25.0 |
| Aqueous Ammonia (27%) | 10.0 ml | 1.8 ml |
| Acetic Acid (98%) | 51.1 | 73.0 |
| Water to make | 1.0 liter | 1.0 liter |
| pH | 4.3 | 3.4 |
| Bleach-Fixing Solution: | | |
| Ammonium Ethylenediamine-tetraacetato/Iron(III) Dihydrate | 50.0 | — |
| Disodium Ethylenediamine-tetraacetate | 5.0 | 25.0 |
| Ammonium Sulfite | 12.0 | 20.0 |
| Ammonium Thiosulfate (aqueous solution, 700 g/liter) | 290.0 ml | 320.0 ml |
| Aqueous Ammonia (27%) | 6.0 ml | 15.0 ml |

-continued

| | Mother Liquid (g) | Replenisher (g) |
|---|---|---|
| Water to make | 1.0 liter | 1.0 liter |
| pH | 6.8 | 8.0 |

Rinsing Water

Mother liquid and replenisher were same.

City water was passed through a mixed bed type column as filled with an H-type strong acidic cation-exchange resin (Amberlite IR-120B, produced by Rhom & Haas Co.) and an OH-type strong basic anion-exchange resin (Amberlite IRA-400, produced by Rhom & Haas Co.) so that both the calcium ion concentration and the magnesium ion concentration in the water were reduced to 3 mg/liter, respectively. Next, 20 ml/liter of sodium dichloroisocyanurate and 150 mg/liter of sodium sulfate were added to the resulting water, which had a pH value falling within the range of from 6.5 to 7.5. This was used as the rinsing water.

Stabilizing Solution

Mother liquid and replenisher were same.

| Surfactant | |
|---|---|
| $[C_{10}H_{21}—O—(CH_2CH_2O)_{10}—H]$ | 1.2 ml |
| Ethylene Glycol | 0.4 g |
| Water to make | 1.0 liter |
| pH | 5.0 to 7.0 |

sharpness than other comparative samples not containing couplers of the present invention. In addition, it is also noted that the samples of the present invention having emulsion (6-1) and/or emulsion (7-1) both having a high hexagonal tabular grain content have a much higher sensitivity and a much better graininess.

EXAMPLE 3

Samples 301 to 305 were prepared in the same manner as in preparation of sample 113, except that EX-9 in the eleventh layer and the twelfth layer was replaced by the same molar amount of coupler (3), (10), (13), (16) and (43) of the present invention. These samples were exposed and then developed in the same manner as in Example 1. As a result, all the processed samples had a high color density and a better graininess.

EXAMPLE 4

The present example demonstrates the superiority of yellow couplers of the present invention. Specifically, since yellow couplers of the present invention have an excellent coloring capacity, the amount of them to be in photographic materials may be reduced and additionally, photographic materials containing them have an excellent color image storability. By combination of such excellent yellow couplers of the present invention and tabular grain emulsions of the present invention, photographic materials of the present invention have an extremely improved sharpness. In addition, incorporation of tabular grains having dislocation lines into photographic materials of the present invention advantageously results in further improvement of the pressure resistance of the photographic materials.

TABLE 5

| Sample | Emulsion of 9th layer | Coupler in 7th, 8th, 9th, 11th and 12th layers | Relative Sensitivity (1) | RMS Value (× 1000) (2) | MTF Value, Magenta Image (25 cycle/mm) |
|---|---|---|---|---|---|
| 201 (comparative sample) | 6-1 | EX-8 | 0.00 | 26.4 | 0.62 |
| 202 (comparative sample) | 7-1 | EX-8 | −0.02 | 26.5 | 0.63 |
| 203 (comparative sample) | 8-1 | EX-8 | −0.02 | 26.8 | 0.63 |
| 204 (comparative sample) | 1-1 | EX-8 | −0.04 | 28.4 | 0.61 |
| 205 (sample of the invention) | 6-1 | (2) | 0.01 | 26.2 | 0.64 |
| 206 (sample of the invention) | 7-1 | (2) | 0.03 | 26.3 | 0.65 |
| 207 (sample of the invention) | 8-1 | (2) | −0.01 | 26.6 | 0.65 |
| 208 (comparative sample) | 1-1 | (2) | −0.03 | 28.3 | 0.62 |
| 209 (sample of the invention) | 6-1 | (42) | 0.01 | 26.3 | 0.64 |
| 210 (sample of the invention) | 7-1 | (42) | 0.03 | 26.4 | 0.65 |
| 211 (sample of the invention) | 8-1 | (42) | 0.00 | 26.7 | 0.65 |
| 212 (comparative sample) | 1-1 | (42) | −0.03 | 28.4 | 0.62 |
| 213 (sample of the invention | 6-1/7-1 | (42) | 0.01 | 26.3 | 0.65 |
| 214 (sample of the invention) | 6-1/1-1 | (42) | −0.02 | 26.9 | 0.64 |

(1) Relative value of a logarithmic number of a reciprocal of the exposure amount for giving magenta density (fog + 0.5)
(2) RMS value at magenta density (fog + 0.5)

As is apparent from the results in Table 5 above, the samples of the present invention each had a higher sensitivity and better graininess and sharpness than other comparative samples not having emulsions of the present invention, and the former had better graininess and Preparation of Emulsions 6 g of potassium iodide and 23 g of inactive gelatin were dissolved in 3.7 liters of distilled water. The resulting aqueous solution was stirred well, and aqueous 14% potassium bromide solution and aqueous 20% silver nitrate solution were added thereto, while stirring well, by a double jet method both at a constant flow rate over a period of one minute, at 45° C. and under the condition of pAg of 9.6 (addition (I)). In addition (I), 2.40% of all the silver amount was consumed. Next, 3300 cc of aqueous 17% gelatin solution was added thereto and stirred at 45° C., and thereafter aqueous 20% silver nitrate solution was added thereto at a constant flow rate until pAg of the reaction system reached 8.40 (addition (II)). In addition (II), 5.0% of all the silver amount was consumed. The temperature of the reaction system was elevated up to 75° C., and 35 μl of aqueous 25% $NH_3$ solution was added thereto. After it was allowed to stand as it was for 15 minutes, 510 μl of 1N $H_2SO_4$ was added thereto for neutralization. Further, 20% potassium bromide solution containing potassium iodide and aqueous 33% silver nitrate solution were added to the reaction system by a double jet method over a period of 80 minutes, whereby 8.3 g of potassium iodide was added to the system (addition (III)). In addition (III), 92.6% of all the silver amount was consumed. During addition (III), the temperature was maintained at 75° C. and the pAg value was maintained at 8.10. The amount of silver nitrate used for preparing the emulsion was 425 g. Next, the emulsion was desalted by an ordinary flocculation method. This was thereafter subjected to optimal gold/sulfur sensitization in the presence of sensitizing dyes S-5 and S-6, to obtain tabular AgBrI emulsion 1 (AgI=2.0 mol %).

Emulsion 2 was prepared in the same manner as in the preparation of emulsion 1, except that potassium iodide was not in the halide solution as added in addition (III) but 830 ml of aqueous 1% potassium iodide solution was added in the course of addition (III) at the time when 40% of all the silver amount was consumed, over a period of about 90 seconds while addition of the silver nitrate solution and the potassium bromide solution was interrupted, the flow rate of the other solutions in addition (III) being accelerated three times.

Emulsion 3 was prepared in the same manner as in the preparation of emulsion 2, except that the aqueous potassium bromide solution was added just before addition of the aqueous potassium iodide solution and the pAg was adjusted to be 9.0.

Emulsion 4 was prepared in the same manner as in preparation of emulsion 2, except that the temperature was varied to 30° C. just before addition of the aqueous potassium iodide solution. (After addition of the aqueous potassium iodide solution, double jet addition of the aqueous potassium bromide solution and the aqueous silver nitrate solution was carried out under the condition of 30° C. and pAg of 8.1.)

In all the emulsions 1 to 4 prepared above, silver halide grains therein had a similar sphere-corresponding diameter of 0.7 μm and had a mean aspect ratio (grain diameter/grain thickness) falling within the range of from 6.5 to 7.0.

Emulsions 1 to 4 were directly observed with a transmission electronic microscope for determining dislocations, if any, of the grains, in accordance with the method described in Example 1-(2) of Japanese Patent Application No. 63-220238. As a result, no dislocations were seen in emulsion 1. In emulsions 2 to 4, 50% by number or more grains were found to each have 10 or more dislocations. As opposed to emulsion 2, emulsions 3 and 4 were found to have intragranular uniform dislocation lines.

In accordance with the method described in European Patent 147868A, the intragranular iodine distribution of each of emulsions 1 to 4 was obtained. The results obtained are shown in Table 6 below.

TABLE 6

| Emulsion | 1 | 2 | 3 | 4 |
|---|---|---|---|---|
| Intra-granular Iodine Distribution (%) | 20 | 65 | 30 | 15 |

Formation of Sample 401

A subbing layer was coated on both surfaces of a 205 μm-thick cellulose triacetate film support. Plural layers each having the composition mentioned below was coated over the support to prepare a multi-layer color photographic material sample. This was called sample 401.

Amounts of the components in each composition coated were per $m^2$ of the sample. Amounts of silver halide and colloidal silver were represented by the equivalent weight of silver therein.

| | |
|---|---|
| First Layer: Anti-halation Layer | |
| Black Colloidal Silver | 0.25 g |
| Gelatin | 1.9 g |
| Ultraviolet Absorbent U-1 | 0.04 g |
| Ultraviolet Absorbent U-2 | 0.1 g |
| Ultraviolet Absorbent U-3 | 0.1 g |
| Ultraviolet Absorbent U-4 | 0.1 g |
| Ultraviolet Absorbent U-6 | 0.1 g |
| Additive P-1 | 0.1 g |
| Additive F-10 | 0.2 g |
| High Boiling Point Organic Solvent Oil-1 | 0.1 g |
| Second Layer: Interlayer | |
| Gelatin | 0.40 g |
| Compound Cpd-D | 10 mg |
| Dye D-4 | 0.4 mg |
| High Boiling Point Organic Solvent Oil-3 | 40 mg |
| Dye D-6 | 0.1 g |
| Third Layer: Interlayer | |
| Additive M-1 | 0.05 g |
| Gelatin | 0.4 g |
| Fourth Layer: Low-Sensitivity Red-Sensitive Emulsion Layer | |
| Emulsion A | 0.2 g as Ag |
| Emulsion B | 0.3 g as Ag |
| Additive F-14 | 1 mg |
| Gelatin | 0.8 g |
| Compound Cpd-K | 0.05 g |
| Coupler C-1 | 0.15 g |
| Coupler C-2 | 0.05 g |
| Coupler C-9 | 0.05 g |
| Coupler C-10 | 0.10 g |
| Compound Cpd-D | 10 mg |
| Additive F-2 | 0.1 mg |
| High Boiling Point Organic Solvent Oil-2 | 0.10 g |
| Additive F-12 | 0.5 mg |
| Fifth Layer: Middle-Sensitivity Red-Sensitive Emulsion Layer | |
| Emulsion B | 0.2 g as Ag |
| Emulsion C | 0.3 g as Ag |
| Gelatin | 0.8 g |
| Additive F-13 | 0.05 mg |
| Coupler C-1 | 0.2 g |
| Coupler C-2 | 0.05 g |
| Coupler C-3 | 0.2 g |

-continued

| | |
|---|---|
| Additive F-2 | 0.1 mg |
| High Boiling Point Organic Solvent Oil-2 | 0.1 g |
| Sixth Layer: High-Sensitivity Red-Sensitive Emulsion Layer | |
| Emulsion D | 0.4 g as Ag |
| Gelatin | 1.1 g |
| Coupler C-3 | 0.7 g |
| Coupler C-1 | 0.3 g |
| Additive P-1 | 0.1 g |
| Additive F-1 | 0.1 mg |
| Seventh Layer: Interlayer | |
| Gelatin | 0.6 g |
| Color Mixing Preventing Agent Cpd-L | 0.05 g |
| Additive F-1 | 1.5 mg |
| Additive F-7 | 2.0 mg |
| Additive Cpd-N | 0.02 g |
| Additive M-1 | 0.3 g |
| Color Mixing Preventing Agent Cpd-K | 0.05 g |
| Ultraviolet Absorbent U-1 | 0.1 g |
| Ultraviolet Absorbent U-6 | 0.1 g |
| Dye D-1 | 0.02 g |
| Dye D-6 | 0.05 g |
| Eighth Layer: Interlayer | |
| Surface and inside fogged silver iodobromide emulsion (mean grain size 0.06 μm; fluctuation coefficient 16%; AgI content 0.3 mol %) | 0.02 g as Ag |
| Gelatin | 1.0 g |
| Additive P-1 | 0.2 g |
| Color Mixing Preventing Agent Cpd-J | 0.1 g |
| Color Mixing Preventing Agent Cpd-M | 0.05 g |
| Color Mixing Preventing Agent Cpd-A | 0.1 g |
| Ninth Layer: Low-Sensitivity Green-Sensitive Emulsion Layer | |
| Inside fogged silver iodobromide emulsion (mean grain size 0.1 μm; AgI content 0.1 mol %) | 0.05 g as Ag |
| Emulsion E | 0.3 g as Ag |
| Emulsion F | 0.1 g as Ag |
| Emulsion G | 0.1 g as Ag |
| Gelatin | 0.5 g |
| Coupler C-4 | 0.20 g |
| Coupler C-7 | 0.10 g |
| Coupler C88 | 0.10 g |
| Coupler C-11 | 0.10 g |
| Compound Cpd-B | 0.03 g |
| Compound Cpd-E | 0.02 g |
| Compound Cpd-F | 0.02 g |
| Compound Cpd-G | 0.02 g |
| Compound Cpd-H | 0.02 g |
| Compound Cpd-D | 10 mg |
| Additive F-5 | 0.1 mg |
| Additive F-3 | 0.2 mg |
| Additive F-11 | 0.5 mg |
| High Boiling Point Organic Solvent Oil-2 | 0.2 g |
| Tenth Layer: Middle-Sensitivity Green-Sensitive Emulsion Layer | |
| Emulsion G | 0.3 g as Ag |
| Emulsion H | 0.1 g as Ag |
| Gelatin | 0.6 g |
| Coupler C-4 | 0.1 g |
| Coupler C-7 | 0.1 g |
| Coupler C-8 | 0.1 g |
| Coupler C-11 | 0.05 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| Additive F-5 | 0.08 mg |
| High Boiling Point Organic Solvent Oil-2 | 0.01 g |
| Eleventh Layer: High-Sensitivity Green-Sensitive Emulsion Layer | |
| Emulsion I | 0.5 g as Ag |
| Gelatin | 1.1 g |
| Coupler C-4 | 0.4 g |
| Coupler C-7 | 0.2 g |

-continued

| | |
|---|---|
| Coupler C-8 | 0.2 g |
| Coupler C-12 | 0.1 g |
| Coupler C-9 | 0.05 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| Additive F-2 | 0.3 mg |
| High Boiling Point Organic Solvent Oil-2 | 0.04 g |
| Additive F-13 | 0.05 mg |
| Twelfth Layer: Interlayer | |
| Gelatin | 0.8 g |
| Additive F-1 | 2.0 mg |
| Additive F-8 | 2.0 mg |
| Dye D-1 | 0.1 g |
| Dye D-3 | 0.07 g |
| Dye D-8 | 0.03 g |
| Dye D-2 | 0.05 g |
| Thirteenth Layer: Yellow Filter Layer | |
| Yellow Colloidal Sivler | 0.1 g as Ag |
| Gelatin | 1.3 g |
| Dye D-5 | 0.05 g |
| Color Mixing Preventing Agent Cpd-5 | 0.01 g |
| Additive F-4 | 0.3 mg |
| High Boiling Point Organic Solvent Oil-1 | 0.01 g |
| Dye D-7 | 0.03 g |
| Additive M-2 | 0.01 g |
| Fourteenth Layer: Interlayer | |
| Gelatin | 0.6 g |
| Dye D-9 | 0.02 g |
| Fifteenth Layer: Low-Sensitivity Blue-Sensitive Emulsion Layer | |
| Emulsion K | 0.2 g as Ag |
| Emulsion L | 0.2 g as Ag |
| Gelatin | 0.9 g |
| Coupler C-5 | 0.6 g |
| Additive F-2 | 0.2 mg |
| Additive F-5 | 0.4 mg |
| Additive F-8 | 0.05 mg |
| Sixteenth Layer: Middle-Sensitivity Blue-Sensitive Emulsion Layer | |
| Emulsion L | 0.1 g as Ag |
| Emulsion M | 0.4 g as Ag |
| Gelatin | 0.7 g |
| Coupler C-6 | 0.5 g |
| Additive F-2 | 0.04 mg |
| Additive F-8 | 0.04 mg |
| Seventeenth Layer: High-Sensitivity Blue-Sensitive Emulsion Layer | |
| Emulsion N | 0.4 g as Ag |
| Gelatin | 0.7 g |
| Coupler C-6 | 0.5 g |
| Additive F-2 | 0.4 mg |
| Additive F-8 | 0.02 mg |
| Additive F-9 | 1 mg |
| Eighteenth Layer: First Protective Layer | |
| Gelatin | 0.9 g |
| Ultraviolet Absorbent U-1 | 0.04 g |
| Ultraviolet Absorbent U-2 | 0.01 g |
| Ultraviolet Absorbent U-3 | 0.03 g |
| Ultraviolet Absorbent U-4 | 0.03 g |
| Ultraviolet Absorbent U-5 | 0.05 g |
| Ultraviolet Absorbent U-6 | 0.05 g |
| High Boiling Point Organic Solvent Oil-1 | 0.02 g |
| Formalin Scavenger Cpd-C | 0.2 g |
| Formalin Scavenger Cpd-I | 0.4 g |
| Latex Dispersion of Ethyl Acrylate | 0.05 g |
| Dye D-3 | 0.05 g |
| Additive Cpd-J | 0.02 g |
| Additive F-1 | 1.0 mg |
| Additive Cpd-N | 0.01 g |
| Additive F-6 | 1.0 mg |
| Additive F-7 | 0.5 mg |
| Additive M-2 | 0.05 g |
| Nineteenth Layer: Second Protective Layer | |
| Gelatin | 0.7 g |

-continued

| | |
|---|---|
| Silver Iodobromide Emulsion (mean grain size 0.06 μm, fluctuation coefficient 16%, AgI content 1.0 mol %) | 0.1 g |
| Polymethyl Methacrylate (mean grain size 1.5 μm) | 0.1 g |
| Copolymer of Methyl Methacrylate/ Acrylic Acid (1/1) (mean grain size 1.5 μm) | 0.1 g |
| Silicone Oil | 0.03 g |
| Surfactant W-1 | 3.0 mg |
| Surfactant W-2 | 0.03 g |
| Twentieth Layer: Backing Layer | |
| Gelatin | 10 g |
| Ultraviolet Absorbent U-1 | 0.05 g |
| Ultraviolet Absorbent U-2 | 0.02 g |
| High Boiling Point Organic Solvent Oil-1 | 0.01 g |
| Twenty-first Layer: Backing Protecting Layer | |
| Gelatin | 5 g |
| Polymethyl Methacrylate (mean grain size 1.5 μm) | 0.03 g |
| Copolymer of Methyl Methacrylate/ Acrylic acid (4/6) (mean grain size 1.5 μm) | 0.1 g |
| Surfactant W-1 | 1 mg |
| Surfactant W-2 | 10 mg |

Each silver halide layer contained additive F-1.

Each layer contained, in addition to the above-mentioned components, gelatin hardening agent H-1, coating aid surfactants W-3 and W-4, and emulsification aid surfactants W-5 and W-6.

In addition, as antiseptic and fungicidal components, phenol, 1,2-benzisothiazolin-3-one, 2-phenoxyethanol, phenyl isothiocyanate and phenethyl alcohol were added to the layers.

Structural formulae of the compounds used above are mentioned below.

C-1

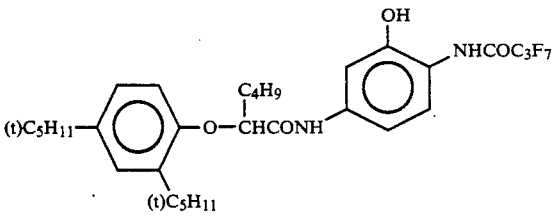

C-2

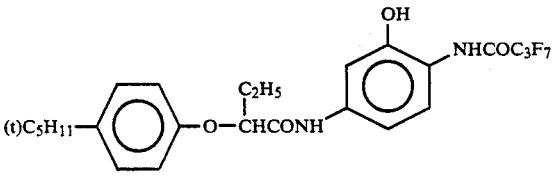

C-3

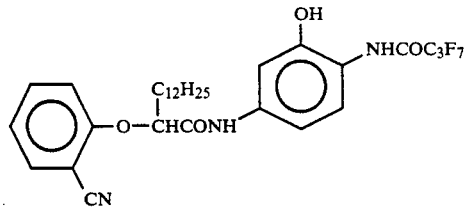

C-4

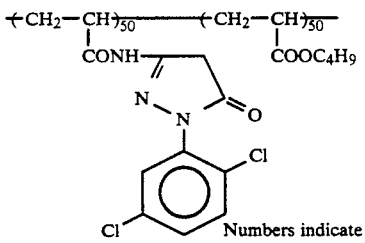

Numbers indicate % by weight.
average molecular weight:
about 25,000

C-5

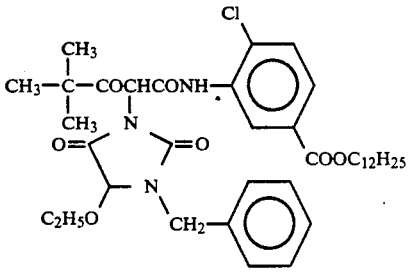

C-6

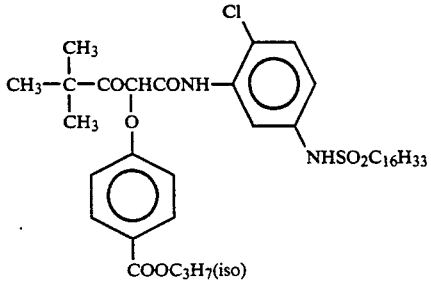

C-7

-continued
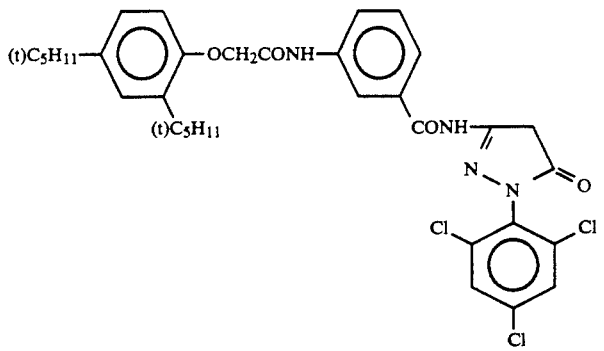
C-8
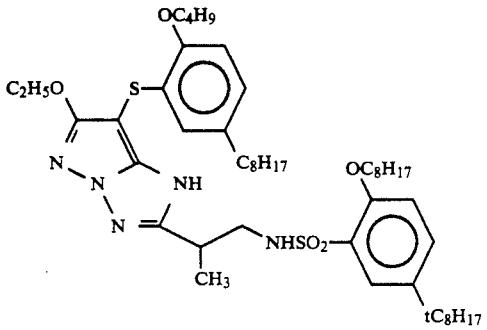
C-9
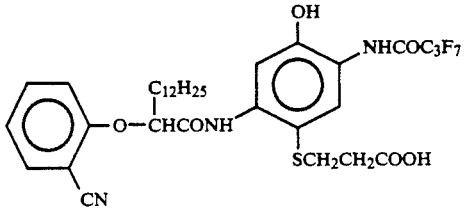
C-10
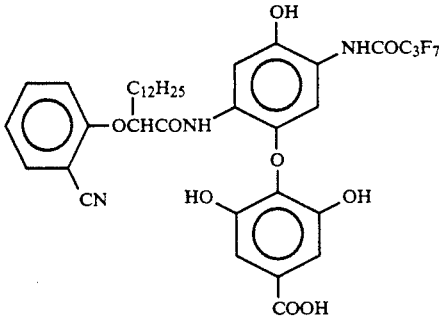
C-11
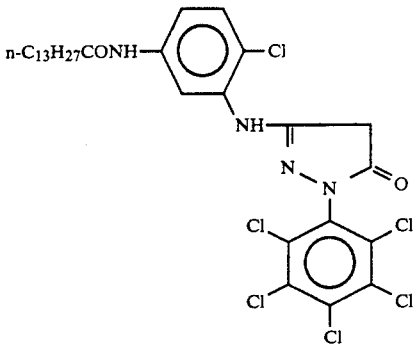
C-12
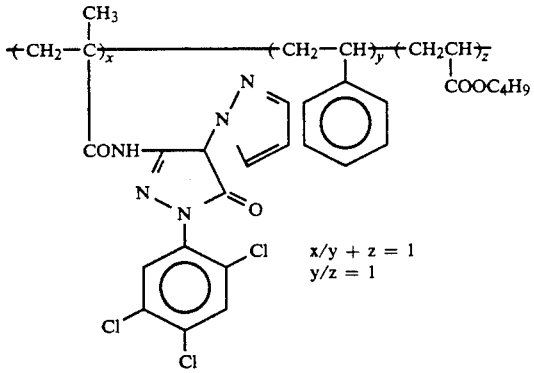
Oil-1
Dibutyl phthalate
Oil-2
Tricresyl phosphate
Oil-3
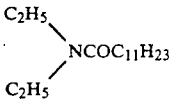
Cpd-A
Cpd-B

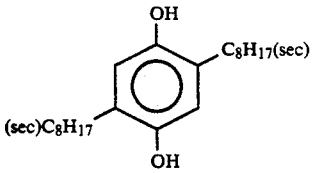
Cpd-C
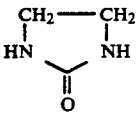
Cpd-E
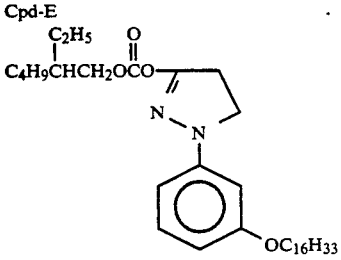
Cpd-G
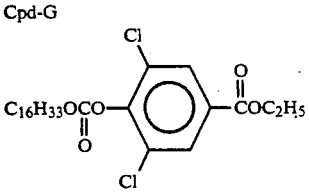
Cpd-I
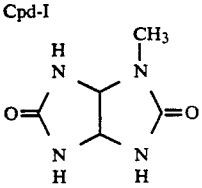
Cpd-K
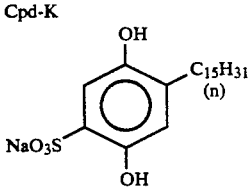
Cpd-M
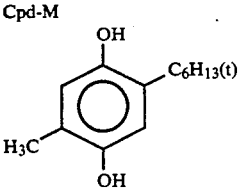
U-1
-continued
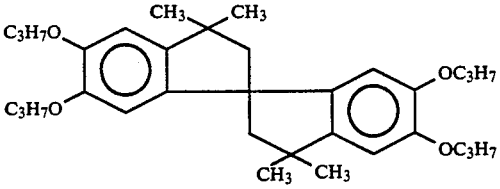
Cpd-D
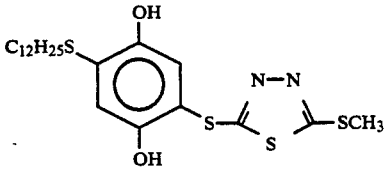
Cpd-F
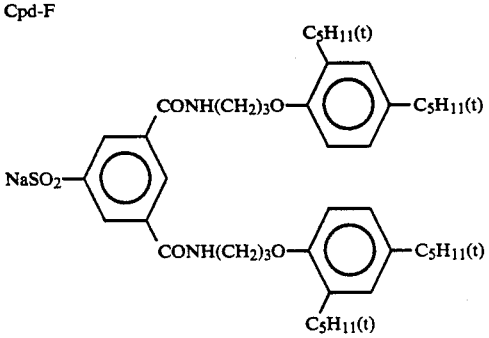
Cpd-H
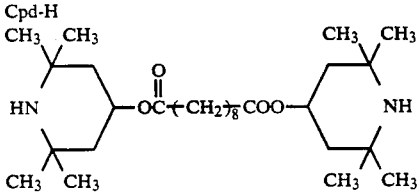
Cpd-J
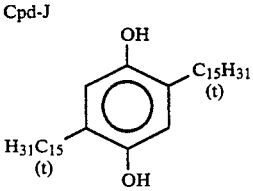
Cpd-L
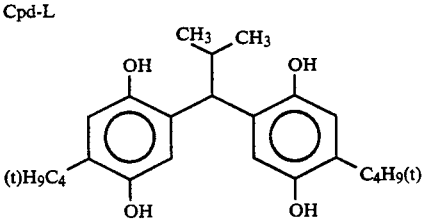
Cpd-N
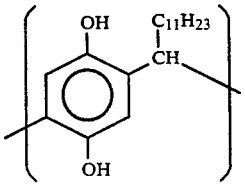
U-2

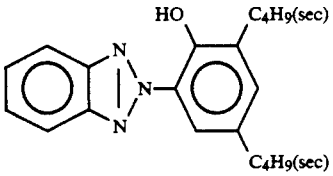
-continued
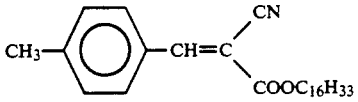
U-3
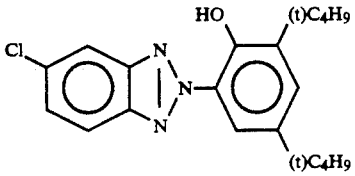
U-4
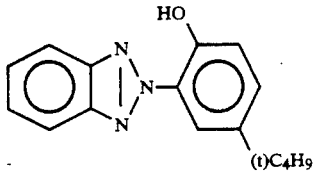
U-5
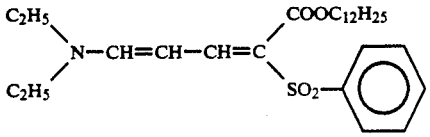
U-6
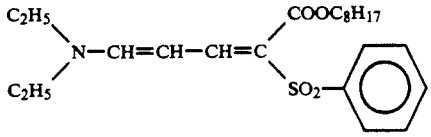
S-1
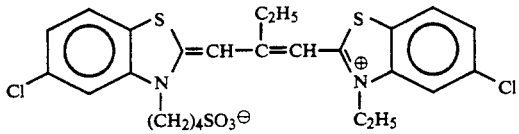
S-2
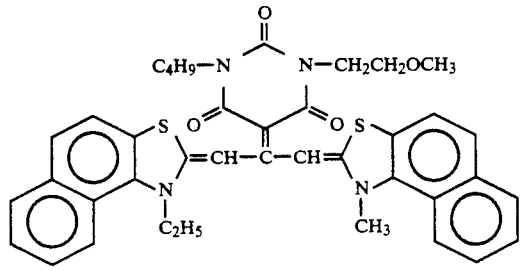
S-3
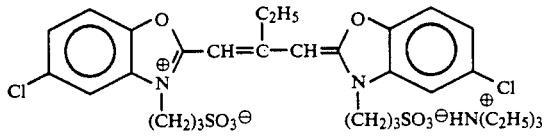
S-4
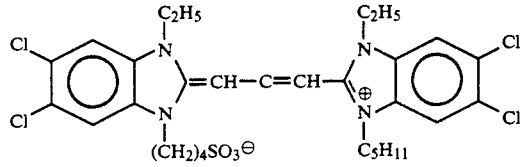
S-5
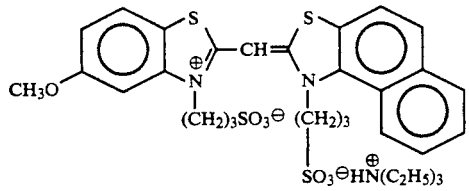
S-6
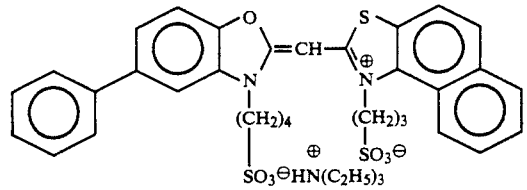
S-7
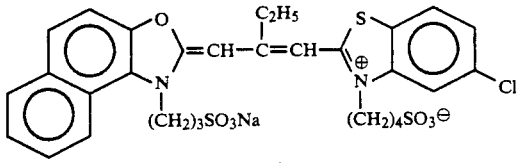
S-8
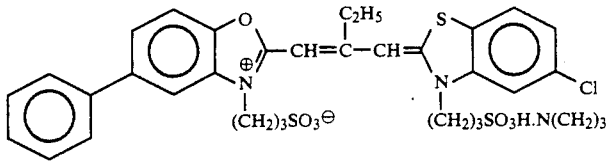

-continued
S-9
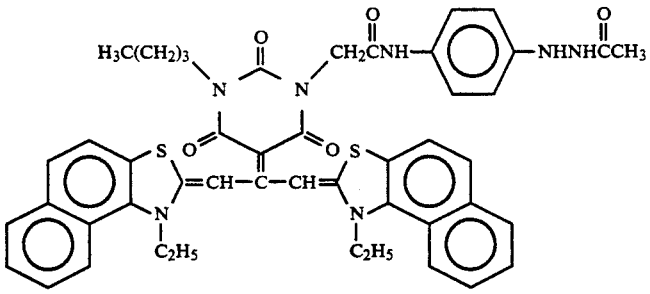
S-10
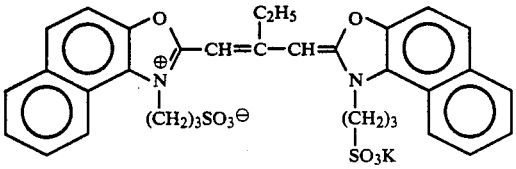
S-11
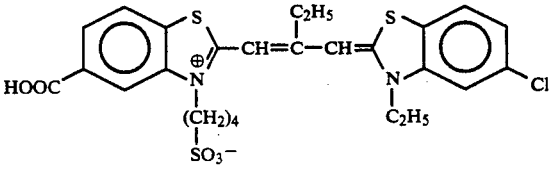
D-1
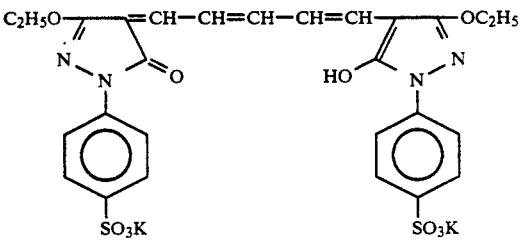
D-2
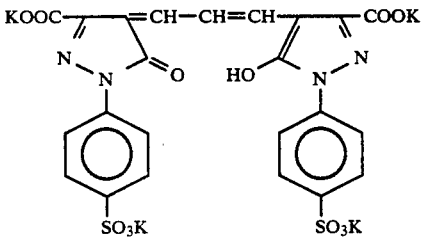
D-3
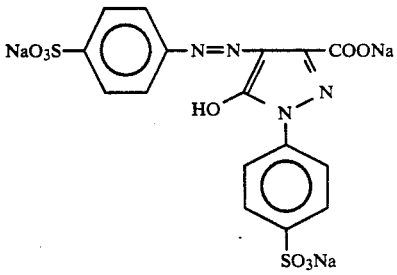
D-4
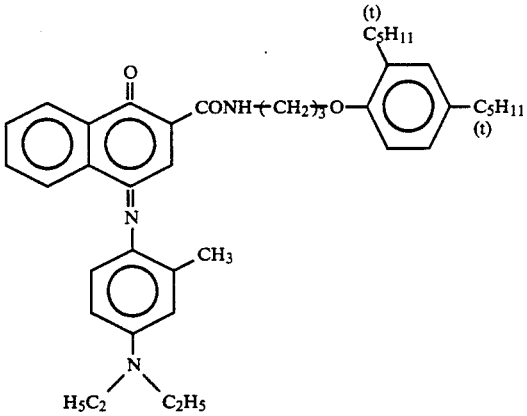
D-5
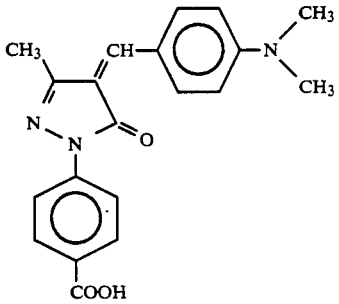
D-6

-continued
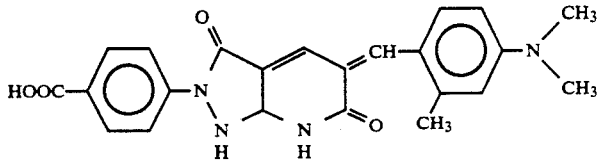
D-7
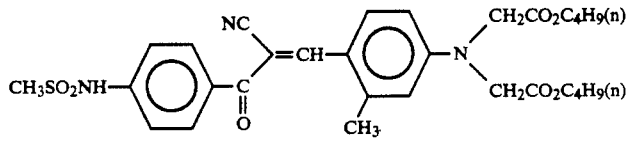
D-8
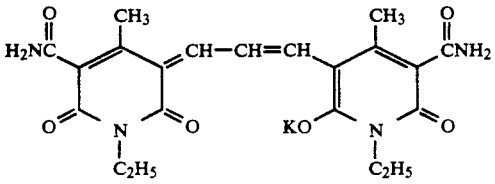
D-9
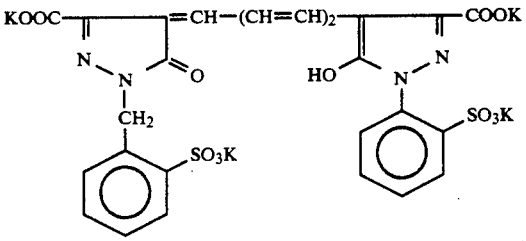
H-1
$CH_2{=}CHSO_2CH_2CONHCH_2$
$CH_2{=}CHSO_2CH_2CONHCH_2$
W-1
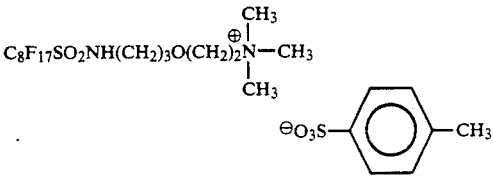
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
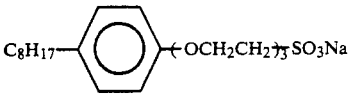
W-5
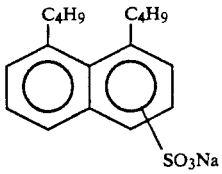
W-6
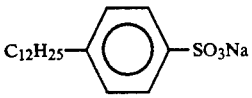
P-1
$\leftarrow CH_2{-}CH(CONHC_4H_9(t)) \rightarrow$
M-1
$\leftarrow CH_2{-}CH(COOC_4H_9) \rightarrow$
M-2
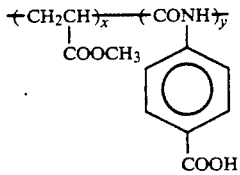
x/y = 1/1
F-1
F-2

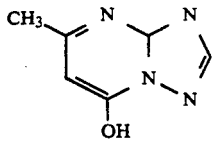
-continued
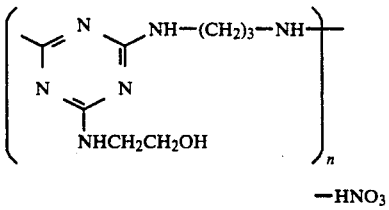
F-3
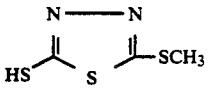
F-4
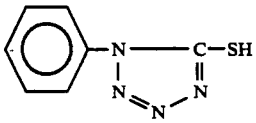
F-5
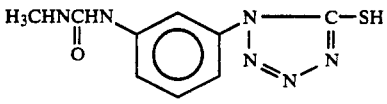
F-6
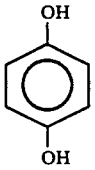
F-7
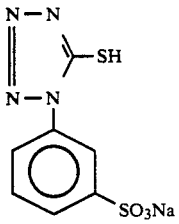
F-8
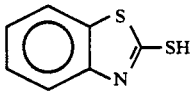
F-9
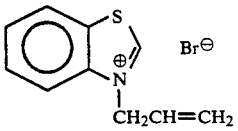
F-10
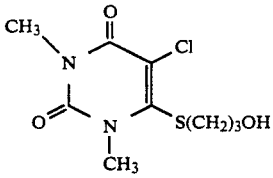
F-11
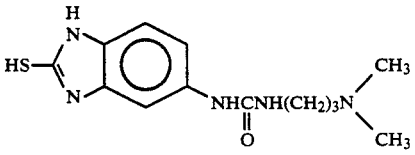
F-12
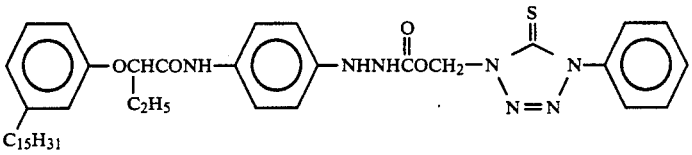
F-13

-continued

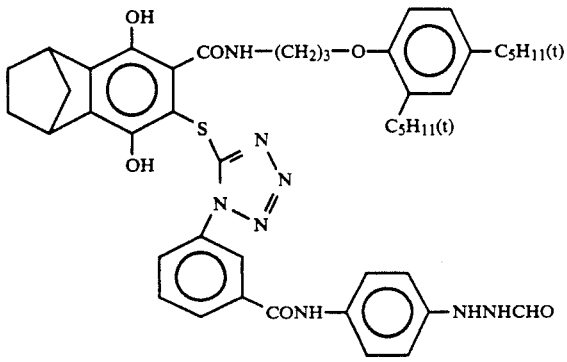

F-14

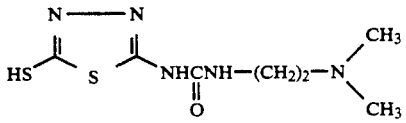

Silver Iodobromide emulsions used in preparing sample 401 are described below.

| Emulsion | Characteristic of Grains | Mean Grain Size (μm) | Variation Coefficient (%) | AgI Content (%) |
|---|---|---|---|---|
| A | Monodispersed tetradecahedral grains | 0.35 | 16 | 4.5 |
| B | Monodispersed cubic internal latent image type grains | 0.45 | 10 | 5.0 |
| C | Monodispersed tetradecahedral grains | 0.60 | 18 | 4.0 |
| D | Polydispersed twin plane grains (mean aspect ration 1.5) | 1.10 | 25 | 3.0 |
| E | Monodispersed cubic grains | 0.30 | 17 | 4.0 |
| F | Monodispersed cubic grains | 0.40 | 16 | 4.0 |
| G | Monodispersed cubic internal latent image type grains | 0.50 | 11 | 4.5 |
| H | Monodispersed tetradecahedral grains | 0.65 | 9 | 3.5 |
| I | Polydispersed twin plane grains (mean aspect ration 1.5) | 1.20 | 28 | 3.0 |
| K | Monodispersed tetradecahedral grains | 0.60 | 17 | 2.0 |
| L | Monodispersed octahedral grains | 0.80 | 14 | 2.0 |
| M | Monodispersed octahedral grains | 1.00 | 18 | 4.0 |
| N | Polydispersed twin plane grains (mean aspect ration 1.5) | 1.45 | 27 | 3.5 |

Emulsions A to N were color-sensitized each in the manner as mentioned below.

| Emulsion | Sensitizing Dyes Added | Amount (g) of Dye Added per mol of Silver Halide | Time of Adding Dyes |
|---|---|---|---|
| A | S-9 | 0.002 | Just after chemical sensitization |
| | S-1 | 0.125 | Just after chemical sensitization |
| | S-11 | 0.125 | Just after chemical sensitization |
| B | S-1 | 0.01 | Just after formation of grains |
| | S-2 | 0.25 | Just after formation of grains |
| C | S-1 | 0.02 | Just after chemical sensitization |
| | S-9 | 0.002 | Just after chemical sensitization |
| | S-2 | 0.25 | Just after chemical sensitization |

-continued

| | | | |
|---|---|---|---|
| D | S-11 | 0.10 | Just before initiation of chemical sensitization |
| | S-2 | 0.01 | Just before initiation of chemical sensitization |
| | S-7 | 0.01 | Just before initiation of chemical sensitization |
| E | S-3 | 0.5 | Just after chemical sensitization |
| | S-10 | 0.05 | Just after chemical sensitization |
| | S-4 | 0.1 | Just after chemical sensitization |
| F | S-3 | 0.3 | Just after chemical sensitization |
| | S-4 | 0.1 | Just after chemical sensitization |
| G | S-3 | 0.25 | Just after formation of grains |
| | S-4 | 0.08 | Just after formation of grains |
| H | S-3 | 0.2 | During formation of grains |
| | S-10 | 0.1 | Just after chemical sensitization |
| | S-4 | 0.06 | During formation of grains |
| I | S-3 | 0.3 | Just before initiation of chemical sensitization |
| | S-4 | 0.07 | Just before initiation of chemical sensitization |
| | S-8 | 0.1 | Just before initiation of chemical sensitization |
| K | S-5 | 0.2 | During formation of grains |
| | S-6 | 0.05 | During formation of grains |
| L | S-5 | 0.22 | Just after formation of grains |
| | S-6 | 0.06 | Just after formation of grains |
| M | S-5 | 0.15 | Just after chemical sensitization |
| | S-6 | 0.04 | Just after chemical sensitization |
| N | S-5 | 0.22 | Just after formation of grains |
| | S-6 | 0.06 | Just after formation of grains |

Sample 402 was prepared in the same manner as in the preparation of sample 401, except that coupler C-6 in each of the sixteenth layer and seventeenth layer was replaced by the same weight of coupler C-5.

Sample 403 was prepared in the same manner as in the preparation of sample 401, except that coupler C-6 in each of the sixteenth layer and seventeenth layer was replaced by 80% by weight of compound (46) of the present invention.

Samples 404 to 406 were prepared in the same manner as in preparation of samples 401 to 403, respectively, except that emulsion K and emulsion L in the fifteenth layer and emulsion L in the sixteenth layer each were replaced by the same amount, as silver, of emulsion 1.

Samples 407, 408 and 409 were prepared in the same manner as in the preparation of sample 406, except that emulsion I in the fifteenth layer and sixteenth layer was replaced by emulsion 2 (sample 407), emulsion 3 (sample 408) and emulsion 4 (sample 409), respectively.

All the samples 401 to 409 thus prepared were developed in accordance with the process mentioned below, and the photographic characteristics of the samples were examined. The yellow density of the non-exposed area of each sample was measured to obtain Dmax(Y). After each of the non-exposed samples was folded at a determined angle and then developed to examine the fluctuation, if any, of the density between the folded sample and the non-folded sample. Each sample was imagewise exposed and then stored in a dark room under the condition of 80° C. and 70% RH for one week, whereupon fluctuation, if any, of the yellow density between the stored sample and the fresh (non-stored) sample was examined to evaluate the color image storability. For evaluation of the color image storability, the fluctuation, if any, of the density of the part of having a yellow density of 3.0 just after development was checked for the sample before and after the storage. Regarding the sharpness of the test samples, the MTF value of the magenta image of each sample was measured by an ordinary MTF method. The results obtained are shown in Table 7 below.

Color development process as applied to the samples is as follows:

Color Development Process

| Step | Time | Temperature |
|---|---|---|
| First Development | 6 min | 38° C. |
| Rinsing in Water | 2 min | 38° C. |
| Reversal | 2 min | 38° C. |
| Color Development | 6 min | 38° C. |
| Compensation | 2 min | 38° C. |
| Bleaching | 6 min | 38° C. |
| Fixing | 4 min | 38° C. |
| Rinsing in Water | 4 min | 38° C. |
| Stabilization | 1 min | room temperature |
| Drying | | |

Compositions of the processing solutions used in the process are mentioned below.

| | |
|---|---|
| First Developer: | |
| Water | 700 ml |
| 5-Sodium Nitrilo-N,N,N-trimethylene-phosphonate | 2 g |
| Sodium Sulfite | 30 g |
| Hydroquinone/Monosodium Sulfonate | 20 g |

-continued

| | |
|---|---|
| Potassium Carbonate | 33 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide | 2 mg |
| Water to make | 1000 ml |
| Reversal Solution: | |
| Water | 700 ml |
| 5-Sodium Nitrilo-N,N,N-trimethylene-phosphonate | 3 g |
| Stannous Chloride (dihydrate) | 1 g |
| P-aminophenol | 0.1 g |
| Sodium Hydroxide | 8 g |
| Glacial Acetic Acid | 15 ml |
| Water to make | 1000 ml |
| Color Developer: | |
| Water | 700 ml |
| 5-Sodium Nitrilo-N,N,N-tri-Methylenephosphonate | 3 g |
| Sodium Sulfite | 7 g |
| Trisodium Phosphate (12-hydrate) | 36 g |
| Potassium Bromide | 1 g |
| Potassium Iodide | 90 mg |
| Sodium Hydroxide | 3 g |
| Citrazinic Acid | 1.5 g |
| N-ethyl-N-(β-methanesulfonamido-ethyl)-3-methyl-4-aminianiline Sulfate | 11 g |
| 3,6-Dithiaoctane-1,8-diol | 1 g |
| Water to make | 1000 ml |
| Compensating Solution: | |
| Water | 700 mg |
| Sodium Sulfite | 12 g |
| Sodium Ethylenediaminetetra-acetate (dihydrate) | 8 g |
| Thioglycerin | 0.4 ml |
| Water to make | 1000 ml |
| Bleaching Solution: | |
| Water | 800 ml |
| Sodium Ethyleneidaminetetra-acetate (dihydrate) | 2 g |
| Ammonium Ethylenediaminetetra-acetate/Iron(III) (dihydrate) | 120 g |
| Potassium Bromide | 100 g |
| Ammonium Nitrate | 10 g |
| Water to make | 1000 ml |
| Fixing Solution: | |
| Water | 800 ml |
| Sodium Thiosulfate | 80.0 g |
| Sodium Sulfite | 5.0 g |
| Sodium Bisulfite | 5.0 g |
| Water to make | 1000 ml |
| Stabilizing Solution: | |
| Water | 800 ml |
| Formalin (37 wt. %) | 5.0 ml |
| Polyoxyethylene-p-monononylphenyl Ether (mean polymerization degree 10) | 0.5 ml |
| Water to make | 1000 ml |

After fixation, the processed samples were rinsed with a rinsing solution comprising the components mentioned below, whereupon the same results were obtained.

| Rinsing Solution | |
|---|---|
| Disodium Ethylenediaminetetraacetate | 0.4 g |
| Water to make | 1000 ml |
| Sodium Hydroxide to make | pH of 7.0 |

TABLE 7

| Sample No. | Coupler in 16th and 17th layers: Compound | Amount Coated ($g/m^2$) | Emulsion: 15th layer | 16th layer | Photographic Properties: Dmax(Y) | Fading | MTF(*1) | Pressure Resistance(*2) |
|---|---|---|---|---|---|---|---|---|
| 401 (comparative sample) | C-6 | 1.0 | K, L | L, M | 3.41 | −0.32 | 0.20 | 2 |
| 402 (comparative sample) | C-5 | 1.0 | K, L | L, M | 3.02 | −0.09 | 0.20 | 2 |
| 403 (comparative sample) | (46) | 0.8 | K, L | L, M | 3.42 | −0.05 | 0.22 | 2 |
| 404 (comparative sample) | C-6 | 1.0 | 1 | 1, M | 3.40 | −0.32 | 0.23 | 1 |
| 405 (comparative sample) | C-5 | 1.0 | 1 | 1, M | 3.00 | −0.09 | 0.23 | 1 |
| 406 (sample of the invention) | (46) | 0.8 | 1 | 1, M | 3.41 | −0.05 | 0.26 | 1 |
| 407 (sample of the invention) | (46) | 0.8 | 2 | 2, M | 3.42 | −0.05 | 0.26 | 3 |
| 408 (sample of the invention) | (46) | 0.8 | 3 | 3, M | 3.42 | −0.05 | 0.26 | 4 |
| 409 (sample of the invention) | (46) | 0.8 | 4 | 4, M | 3.41 | −0.05 | 0.26 | 5 |

(*1)MTF: Value of magenta image at 60 cycle/mm.
(*2)Pressure Resistance: Variation of density in the folded part was judged with the naked eye, and pressure resistance was evaluated by 5-rank evaluation where 5 was the best and 1 was the worst.

From the results in Table 7 above, it is noted that the samples each containing yellow coupler (46) of the present invention gave Dmax(Y) of the same level as that of comparative samples containing comparative compound (C-6), the amount of coupler (46) in the former being 20% smaller than that of compound (C-6) in the latter, and that the former faded less than the latter after storage and therefore had a higher color image storability than the latter In addition, the former samples of the present invention each had a higher MTF value than the latter comparative samples The samples containing comparative compound (C-5) gave a lower Dmax(Y) than the samples containing yellow coupler (46) of the present invention, though the amount of compound (C-5) in the former was 20% larger than that of yellow coupler (46) in the latter. In addition, the former comparative samples were inferior to the latter samples of the present invention in the color image storability and MTF.

By employment of tabular emulsions 1 to 4 of the present invention, MTF of the photographic material samples was improved. In particular, the effect was more noticeable in combination of the tabular emulsions and yellow coupler (46).

Combination of yellow coupler (46) and tabular emulsion 1 was apt to worsen the pressure resistance of the photographic material. However, the problem was greatly improved by the use of tabular emulsion 2 having dislocation lines. In addition, it was further more improved by the use of tabular emulsion 3 or 4 having dislocation lines and having a smaller AgI content fluctuation.

As is obvious from the above-mentioned explanation and examples, the silver halide color photographic materials of the present invention are far superior to any other conventional ones in that (a) the former have a high sensitivity and excellent graininess, pressure resistance, color reproducibility and sharpness, (b) the former have an improved yellow image storability, (c) the former are free from fluctuation of photographic properties during storage, and (d) the cost of the former is low and the image quality thereof is excellent.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having at least one light-sensitive emulsion layer on a support, in which at least 50%, as the total projected area, of all the silver halide grains in at least one light-sensitive emulsion layer are tabular grains having a mean aspect ratio of 2 or more and at least one layer constituting the material contains a coupler selected from the group consisting of a coupler of the following formula (I), a coupler of the following formula (II) and combinations thereof:

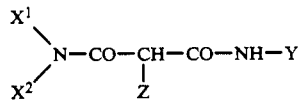
(I)

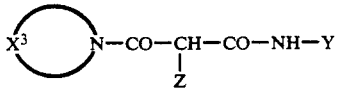
(II)

wherein $X^1$ and $X^2$ each represents an alkyl group, an aryl group, or a heterocyclic group;

$X^3$ represents an organic residue forming a nitrogen-containing heterocyclic group along with >N— in the formula;

Y represents an aryl group or a heterocyclic group; and

Z represents a group capable of being released from the formula when the coupler of the formula reacts with an oxidation product of a developing agent.

2. The silver halide color photographic material as in claim 1, wherein the couplers of formulae (I) and (II) are selected from the group consisting of those couplers of formulae (III), (IV) and (V):

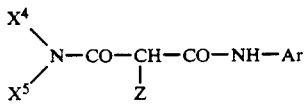
(III)

-continued

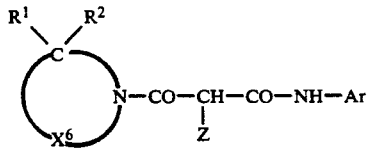

(IV)

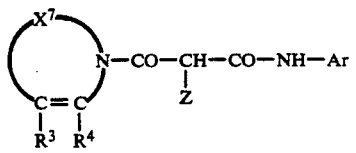

(V)

wherein Z has the same meaning as that defined in formula (I);

$X^4$ represents an alkyl group;

$X^5$ represents an alkyl group or an aromatic group;

Ar represents a phenyl group having at least one substituent at the ortho-position;

$X^6$ represents an organic residue capable of forming a nitrogen-containing monocyclic or condensed ring heterocyclic group along with $—C(R^1R^2)—N<$ in the formula;

$X^7$ represents an organic residue capable of forming a nitrogen-containing monocyclic or condensed ring heterocyclic group along with $—C(R^3)=C(R^4)—N<$ in the formula; and $R^1$, $R^2$, $R^3$ and $R^4$ each represent a hydrogen atom or a substituent.

3. The silver halide color photographic material as in claim 2, wherein the couplers of formulae (I) and (II) are selected from the group consisting of those couplers of formulae (IV) and (V).

4. The silver halide color photographic material as in claim 1, which contains a compound of formula (A):

$$Q—SM^1 \quad (A)$$

wherein Q represents a heterocyclic residue having at least one substituent group selected from the group consisting of $—SO_3M^2$, $—COOM^2$, —OH and $—NR^1R^2$ bonded thereto directly or indirectly;

$M^1$ and $M^2$ independently represents a hydrogen atom, an alkali metal, a quaternary ammonium group, or a quaternary phosphonium group; and $R^1$ and $R^2$ independently represents a hydrogen atom, or a substituted or unsubstituted alkyl group.

5. The silver halide color photographic material as in claim 4, wherein the compound of formula (A) is selected from mercapto-heterocyclic compounds of formulae (B) and (C):

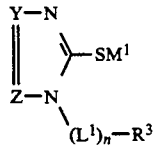

(B)

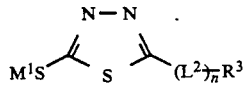

(C)

wherein Y and Z independently represents a nitrogen atom or $CR^4$;

$R^4$ represents a hydrogen atom, a substituted or unsubstituted alkyl group, or a substituted or unsubstituted aryl group;

$R^3$ represents an organic residue substituted by at least one substituent selected from the group consisting of $—SO_3M^2$, $—COOM^2$, —OH and $—NR^1R^2$;

$L^1$ represents a linking group selected from the group consisting of —S—, —O—, —N=, —CO—, —SO— and $—SO_2—$;

n represents 0 or 1;

X represents a sulfur atom, an oxygen atom, or $—N(R^5)—$;

$R^5$ represents a hydrogen atom, a substituted or unsubstituted alkyl group, or a substituted or unsubstituted aryl group;

$L^2$ represents $—CONR^6—$, $—NR^6CO—$, $—SO_2NR^6—$, $—NR^6SO_2—$, —OCO—, —COO—, —S—, $—NR^6—$, —CO—, —SO—, —OCOO—, $—NR^6CONR^7—$, $—NR^6COO—$, $—OCONR^6—$, or $—NR^6SO_2NR^7—$;

$R^6$ and $R^7$ each represent a hydrogen atom, a substituted or unsubstituted alkyl group, or a substituted or unsubstituted aryl group; and $M^2$ has the same meaning as that defined in formula (A).

6. The silver halide color photographic material as in claim 1, wherein the tabular silver halide grains in the emulsion layer is in the form of a monodispersed emulsion having a variation coefficient to the grain size of 0.25 or less.

7. The silver halide color photographic material as in claim 1, wherein 50% or more, as the total projected area, of all the tabular silver halide grains are hexagonal tabular silver halide grains having parallel two hexagonal layers as the outer surfaces, and the two hexagonal layers constituting the hexagonal tabular grain each have a ratio of the maximum side to the minimum side of 2 or less.

8. The silver halide color photographic material as in claim 1, wherein one and the same layer contains two or more kinds of the tabular silver halide grains or contains the tabular silver halide grains along with other silver halide grains.

9. The silver halide color photographic material as in claim 6, wherein one and the same layer contains two or more kinds of the tabular silver halide grains or contains the tabular silver halide grains along with other silver halide grains.

10. The silver halide color photographic material as in claim 7, wherein one and the same layer contains two or more kinds of the hexagonal tabular silver halide grains or contains the hexagonal tabular silver halide grains along with other silver halide grains.

11. The silver halide color photographic material as in claim 1, wherein 50% by number or more tabular silver halide each have 10 or more dislocation lines per one grain.

12. The silver halide color photographic material as in claim 1, wherein the tabular silver halide grains each have a relative standard deviation of the silver iodide content of 30% or less.

13. The silver halide color photographic material as in claim 1, wherein $X^1$ and $X^2$ each represent a substituted or unsubstituted alkyl group having from 1 to 30 carbon atoms.

14. The silver halide color photographic material as in claim 1, wherein $X^1$, $X^2$ and Y each represent a substituted or unsubstituted heterocyclic group having from 3 to 12 members and having from 1 to 20 carbon atoms, and having a hetero atom selected from the group consisting of a nitrogen atom, an oxygen atom and a sulfur atom.

15. The silver halide color photographic material as in claim 1, wherein $X^1$, $X^2$ and Y each represent a substituted or unsubstituted aryl group having from 6 to 20 carbon atoms.

16. The silver halide color photographic material as in claim 1, wherein $X^3$ represents a substituted or unsubstituted heterocyclic group having from 3 to 12 members and having from 1 to 20 carbon atoms, and having in addition to at least one nitrogen atom, at least one hetero atom selected from the group consisting of an oxygen atom and a sulfur atom.

17. The silver halide color photographic material as in claim 13, wherein $X^1$ represents a substituted or unsubstituted alkyl group having from 1 to 10 carbon atoms.

18. The silver halide color photographic material as in claim 1, wherein Y represents a phenyl group having at least one substituent at the ortho position.

19. The silver halide color photographic material as in claim 1, wherein Y represents a 5-membered or 6-membered nitrogen-containing heterocyclic group bonded to the coupling position of the formula via the nitrogen atom of the group, an aromatic oxy group, a 5-membered or 6-membered heterocyclic oxy group, or a 5-membered or 6-membered heterocyclic thio group.

20. The silver halide color photographic material as in claim 1, wherein the total amount of yellow coupler to be incorporated into the photographic material is from 0.0001 to 0.80 $g/m^2$ if the split-off group Z of the coupler contains a photographically useful group, or if Z does not contain a photographically useful group, the amount is from 0.001 to 1.20 $g/m^2$,

21. The silver halide color photographic material as in claim 5, wherein the organic residue $R^3$ is an alkyl group having from 1 to 20 carbon atoms, or an aryl group having from 6 to 20 carbon atoms.

22. The silver halide color photographic material as in claim 4, wherein the amount of compound (A) is from $1\times10^{-7}$ to $1\times10^{-3}$ $mol/m^2$.

* * * * *

UNITED STATES PATENT AND TRADEMARK OFFICE

CERTIFICATE OF CORRECTION

PATENT NO. : 5,298,383

DATED : March 29, 1994

INVENTOR(S) : Keiji MIHAYASHI et al.

It is certified that error appears in the above-indentified patent and that said Letters Patent is hereby corrected as shown below:

In column 58, after Table 1 and before line 59 insert the following:

--(1) The aspect ratio of each of 1000 emulsion grains was measured, grains corresponding to 50% of the total projected area were selected from those having a larger aspect ratio, and the mean value of the aspect ratio of the selected grains was obtained.

(2) In the same manner as in (1), grains corresponding to 85% of the total projected area were selected from those having a larger aspect ratio, and the mean value of the aspect ratio of the selected grains was obtained.--

Signed and Sealed this

Second Day of January, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,298,383

DATED : March 29, 1994

INVENTOR(S) : Keiji MIHAYASHI et al.

It is certified that error appears in the above-indentified patent and that said Letters Patent is hereby corrected as shown below:

In Table 4 at col. 85-86, lines 21-22, last column of Table, change

"Intra-granular

AgI Content" to

--Inter-granular

AgI Content (5)--

Signed and Sealed this

Fifth Day of March, 1996

Bruce Lehman

BRUCE LEHMAN

*Commissioner of Patents and Trademarks*

*Attest:*

*Attesting Officer*